US009381758B2

(12) United States Patent
Tanaka

(10) Patent No.: US 9,381,758 B2
(45) Date of Patent: Jul. 5, 2016

(54) CARRIER DEVICE AND INKJET PRINTER HAVING THE SAME, AND CARRYING METHOD

(71) Applicant: Roland DG Corporation, Hamamatsu-shi, Shizuoka (JP)

(72) Inventor: Ippei Tanaka, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 14/728,043

(22) Filed: Jun. 2, 2015

(65) Prior Publication Data

US 2015/0352864 A1 Dec. 10, 2015

(30) Foreign Application Priority Data

Jun. 4, 2014 (JP) ..... 2014-115443
Sep. 1, 2014 (JP) ..... 2014-177221
Apr. 16, 2015 (JP) ..... 2015-083951

(51) Int. Cl.
*B41J 11/04* (2006.01)
*B41J 15/16* (2006.01)
*B65H 23/02* (2006.01)
(Continued)

(52) U.S. Cl.
CPC ..... *B41J 15/16* (2013.01); *B41J 11/008* (2013.01); *B65H 18/103* (2013.01); *B65H 23/0216* (2013.01); *B65H 23/035* (2013.01); *B65H 2301/331* (2013.01); *B65H 2301/443243* (2013.01); *B65H 2404/152* (2013.01);
(Continued)

(58) Field of Classification Search
CPC ..... B65H 23/00; B65H 23/048; B65H 2301/331; B41J 15/16; B41J 15/165; B41J 15/046; B41J 11/0045
See application file for complete search history.

(56) References Cited

U.S. PATENT DOCUMENTS 5,717,984 A * 2/1998 Wong ..... B65G 39/16 198/806
RE36,154 E * 3/1999 Mattei ..... A24C 5/20 83/358
(Continued)

FOREIGN PATENT DOCUMENTS

EP 2 657 168 A2 10/2013
GB 2 065 871 A 7/1981
(Continued)

OTHER PUBLICATIONS

Official Communication issued in corresponding European Patent Application No. 15170248.7, mailed on Jan. 8, 2016.

*Primary Examiner* — Stephen Meier
*Assistant Examiner* — John P Zimmermann
(74) *Attorney, Agent, or Firm* — Keating and Bennett, LLP

(57) ABSTRACT

A carrier device includes a medium accommodating section configured to accommodate a roll medium, a carrying section configured to carry a medium in a secondary scanning direction, a re-rolling section configured to re-roll the medium having been carried, a dancer roller configured to apply a predetermined tension on the medium being carried from the carrying section toward the re-rolling section, a first bar-shaped member disposed between the medium accommodating section and the carrying section configured to press the medium so as to alter the carrying path of the medium; and a second bar-shaped member disposed between the carrying section and the re-rolling section configured to press the medium so as to alter the carrying path of the medium.

10 Claims, 33 Drawing Sheets

(51) Int. Cl.
*B65H 23/035* (2006.01)
*B65H 18/10* (2006.01)
*B41J 11/00* (2006.01)

(52) U.S. Cl.
CPC ..... *B65H2404/62* (2013.01); *B65H 2801/06* (2013.01); *B65H 2801/36* (2013.01)

(56) References Cited

U.S. PATENT DOCUMENTS

| | | | | |
|---|---|---|---|---|
| 7,794,078 | B2 * | 9/2010 | Coenen et al. | 347/104 |
| 9,145,262 | B2 * | 9/2015 | Eagleson | B65G 39/16 |
| 2005/0002718 | A1 * | 1/2005 | Winter et al. | 400/579 |
| 2008/0094443 | A1 * | 4/2008 | Miyazaki | 347/19 |
| 2008/0264995 | A1 * | 10/2008 | Henn et al. | 226/195 |
| 2011/0128337 | A1 * | 6/2011 | Muir et al. | 347/104 |
| 2012/0050438 | A1 * | 3/2012 | Wada | 347/104 |

FOREIGN PATENT DOCUMENTS

| | | | |
|---|---|---|---|
| JP | 2004-314565 | A | 11/2004 |
| JP | 4399151 | B2 | 1/2010 |
| JP | 2010-280472 | A | 12/2010 |

* cited by examiner

CARRIER DEVICE AND INKJET PRINTER HAVING THE SAME, AND CARRYING METHOD

The present application claims priority based on Japanese Patent Application Nos. 2014-115443, 2014-177221 and 2015-083951, filed on Jun. 4, 2014, Sep. 1, 2014 and Apr. 16, 2015, respectively, the disclosures of which are hereby incorporated by reference in their entirety.

BACKGROUND OF THE INVENTION

1. Field of the Invention

The present invention relates to a carrier device and an inkjet printer having the same, and a carrying method.

2. Description of the Related Art

Carrier devices for carrying a long web of medium, and inkjet printers for printing an intended image by discharging ink from an ink head onto a medium being carried by a carrier device have been known in the art.

Carrier devices include roll-to-roll-type carrier devices, for example. With roll-to-roll-type carrier devices, a long web of medium, rolled in a roll, is unrolled to be carried, and the medium having been carried is re-rolled into a roll.

An inkjet printer having a roll-to-roll-type carrier device performs an intended printing operation by discharging ink onto a medium while moving the ink head in a direction perpendicular to the medium-carrying direction (secondary scanning direction).

FIGS. 27A to 27C show a known inkjet printer 200 having a roll-to-roll-type carrier device 215. As shown in FIG. 27A, the carrier device 215 includes a roll medium accommodating section 208, a carrying section 227 (see FIG. 27C), a dancer roller 212, and a re-rolling section 210. As shown in FIG. 27C, the carrying section 227 includes grid rolls 224 provided on a platen 222, and pinch rolls 226 arranged to be in contact with the grid rolls 224. By driving the grid rolls 224 with a medium 300 sandwiched between the grid rolls 224 and the pinch rolls 226, the medium 300 unrolled from a roll medium RM is carried in the secondary scanning direction. The carrying section 227 carries the medium 300 sandwiched between the grid rolls 224 and the pinch rolls 226 in the secondary scanning direction.

The dancer roller 212 gives a predetermined tension on the long web of the medium 300 being carried. With the dancer roller 212 applying a tension on the medium 300, it is possible to appropriately carry the medium 300 onto the platen 222 without wrinkling or slacking the medium 300, and it is possible to re-roll the medium 300 having been carried without the medium 300 running askew and without wrinkling or slacking the medium 300.

That is, with the carrier device 215, the medium 300 unrolled from the roll medium RM disposed in the roll medium accommodating section 208 is carried by the grid rolls 224, and the medium 300 having been carried is re-rolled by the re-rolling section 210 while a predetermined tension is applied on the medium 300 by the dancer roller 212.

However, with the inkjet printer 200 having such a conventional carrier device 215, a center axis RO of the roll medium RM disposed in the roll medium accommodating section 208 may not be parallel to the X axis or a center axis LO of the re-rolling section 210 may not be parallel to the X axis due to part precision errors in various parts, and the like.

Where the center axis RO of the roll medium RM or the center axis LO of the re-rolling section 210 is not parallel to the X axis, the length of a right side edge 300*a* and the length of a left side edge 300*b* of the medium 300 unrolled from the roll medium RM differ from each other. Therefore, even with a predetermined tension applied on the medium 300 by the dancer roller 212, the medium 300 is re-rolled askew at the re-rolling section 210. When a print result on the medium 300 is transferred by using the medium 300 having been re-rolled askew, for example, problems will arise such as a misalignment of the transfer of the print result, thus failing to properly perform the transfer process.

SUMMARY OF THE INVENTION

Preferred embodiments of the present invention provide a carrier device and an inkjet printer, with which it is possible to easily rectify a medium running askew.

A carrier device according to a preferred embodiment of the present invention includes a medium accommodating section configured to accommodate a roll medium which extends in a primary scanning direction and which is formed by rolling a web of medium; a carrying section configured to carry the medium unrolled from the roll medium in a secondary scanning direction perpendicular to the primary scanning direction; a re-rolling section extending in the primary scanning direction, the re-rolling section configured to re-roll the medium having been carried; a dancer section configured to apply a predetermined tension on the medium being carried from the carrying section toward the re-rolling section; a first altering section disposed between the medium accommodating section and the carrying section, the first altering section configured to press the medium being carried from the medium accommodating section toward the carrying section so as to alter a carrying path of the medium; and a second altering section disposed between the carrying section and the re-rolling section, the second altering section configured to press the medium being carried from the carrying section toward the re-rolling section so as to alter the carrying path of the medium.

According to a preferred embodiment of the present invention, the first altering section includes a first bar member extending in the primary scanning direction, the first altering section configured to press the medium being carried from the medium accommodating section toward the carrying section; the first bar member is configured so that an inclination angle thereof is adjustable with respect to a center axis of the roll medium; the second altering section includes a second bar member extending in the primary scanning direction, the second altering section configured to press the medium being carried from the carrying section toward the re-rolling section; and the second bar member is configured so that an inclination angle thereof is adjustable with respect to a center axis of the re-rolling section.

According to a preferred embodiment of the present invention, the first altering section includes a first support shaft including a first movable portion to which one end of the first bar member is connected, and a second support shaft including a second movable portion to which the other end of the first bar member is connected; the first bar member is inclined with respect to the center axis of the roll medium by individually moving the first movable portion and the second movable portion; the second altering section includes a third support shaft including a third movable portion to which one end of the second bar member is connected, and a fourth support shaft including a fourth movable portion to which the other end of the second bar member is connected; and the second bar member is inclined with respect to the center axis of the re-rolling section by individually moving the third movable portion and the fourth movable portion.

An inkjet printer according to a preferred embodiment of the present invention includes an ink head configured to move in the primary scanning direction and to discharge ink onto the medium, and a carrier device according to any of the preferred embodiments of the present invention described above.

An inkjet printer according to a preferred embodiment of the present invention includes a sensor configured to read one end, in the primary scanning direction, of the medium being carried by the carrying section; a creating section configured to create a first marking including a plurality of marks arranged starting from a first central position and spaced apart from one another by a predetermined interval; a second marking including a plurality of marks arranged starting from a second central position and spaced apart from one another by an interval that is the predetermined interval plus or minus an amount of shift in a print result to be introduced when the carrying path is altered by the first altering section; and a third marking including a plurality of marks arranged starting from a third central position and spaced apart from one another by an interval that is the predetermined interval plus or minus an amount of shift in a print result to be introduced when the carrying path is altered by the second altering section; a reading section configured to read a first end and a second end by using the sensor when the carrying path of the medium is altered by the first altering section, wherein the first end is one end in the primary scanning direction of the medium at a first position and the second end is one end in the primary scanning direction of the medium at a second position that is a position to be reached after the medium is carried by a predetermined amount from the first position, and configured to read a third end and a fourth end by using the sensor when the carrying path of the medium is altered by the second altering section, wherein the third end is one end in the primary scanning direction of the medium at a third position and the fourth end is one end in the primary scanning direction of the medium at a fourth position that is a position to be reached after the medium is carried by a predetermined amount from the third position; and a print controller configured or programmed to control the ink head so as to print, at the second position, the first marking so that the first central position is located a predetermined distance away in the primary scanning direction from a point corresponding to the first end and to print the second marking so that the second central position is located the predetermined distance away in the primary scanning direction from the second end, and so as to print, at the fourth position, the first marking so that the first central position is located the predetermined distance away in the primary scanning direction from a point corresponding to the third end and to print the third marking so that the third central position is located the predetermined distance away in the primary scanning direction from the fourth end.

According to a preferred embodiment of the present invention, the first altering section includes a first adjustment mechanism configured to adjust the carrying path of the medium; the second marking includes a plurality of marks arranged starting from the second central position and spaced apart from one another by an interval that is the predetermined interval plus or minus an amount of shift in a print result to be introduced when the first adjustment mechanism is adjusted by one step; the second altering section includes a second adjustment mechanism configured to adjust the carrying path of the medium; and the third marking includes a plurality of marks arranged starting from the third central position and spaced apart from one another by an interval that is the predetermined interval plus or minus an amount of shift in a print result to be introduced when the second adjustment mechanism is adjusted by one step.

According to a preferred embodiment of the present invention, a number of the plurality of marks of the second marking and a number of the plurality of marks of the third marking are smaller than a number of steps in which the first adjustment mechanism is adjustable and a number of steps in which the second adjustment mechanism is adjustable, respectively.

According to a preferred embodiment of the present invention, a number of the plurality of marks of the second marking and a number of the plurality of marks of the third marking are different from each other, and a number of the plurality of marks of the first marking is equal to a larger one of the number of the plurality of marks of the second marking and the number of the plurality of marks of the third marking.

A carrying method according to a preferred embodiment of the present invention is a carrying method for use with an inkjet printer, the inkjet printer including a medium accommodating section configured to accommodate a roll medium which extends in a primary scanning direction and which is formed by rolling a web of medium; a carrying section configured to carry the medium unrolled from the roll medium in a secondary scanning direction perpendicular to the primary scanning direction; a re-rolling section configured to re-roll the medium having been carried; a dancer section configured to apply a predetermined tension on the medium being carried from the carrying section toward the re-rolling section; a first altering section disposed between the medium accommodating section and the carrying section, the first altering section configured to press the medium being carried from the medium accommodating section toward the carrying section so as to alter a carrying path of the medium; a second altering section disposed between the carrying section and the re-rolling section, the second altering section configured to press the medium being carried from the carrying section toward the re-rolling section so as to alter the carrying path of the medium; an ink head configured to move in the primary scanning direction and discharging ink onto the medium; and a sensor configured to read one end, in the primary scanning direction, of the medium being carried by the carrying section, wherein the carrying method is a method for carrying the medium, unrolled from the roll medium, from the medium accommodating section to the carrying section and for re-rolling and collecting the medium having been carried from the carrying section to the re-rolling section, the carrying method including: creating a first marking including a plurality of marks arranged starting from a first central position and spaced apart from one another by a predetermined interval; a second marking including a plurality of marks arranged starting from a second central position and spaced apart from one another by an interval that is the predetermined interval plus or minus an amount of shift in a print result to be introduced when the carrying path is altered by the first altering section; and a third marking including a plurality of marks arranged starting from a third central position and spaced apart from one another by an interval that is the predetermined interval plus or minus an amount of shift in a print result to be introduced when the carrying path is altered by the second altering section; reading a first end which is one end in the primary scanning direction of the medium at a first position, carrying the medium by a predetermined amount from the first position to a second position, then printing, at the second position, the first marking so that the first central position is located a predetermined distance away in the primary scanning direction from a point corresponding to the first end, reading a second end which is one end in the primary scanning direction of the medium at the second position, and printing, at the second position, the second marking so that the second central position is located the predetermined distance away in the primary scanning direction from the second end; and reading a third end which is one end in the primary scanning direction of the medium at a third position, carrying the medium by a predetermined amount from the third position to a fourth position, then printing, at the fourth position, the first marking so that the first central position is located the predetermined distance away in the primary scanning direction from a point corresponding to the third end, reading a fourth end which is one end in the primary scanning direction of the medium at the fourth position, and printing, at the fourth position, the third marking so that the third central position is located the predetermined distance away in the primary scanning direction from the fourth end.

According to a preferred embodiment of the present invention, the first altering section includes a first adjustment mechanism configured to adjust the carrying path of the medium; the second marking includes a plurality of marks arranged starting from the second central position and spaced apart from one another by an interval that is the predetermined interval plus or minus an amount of shift in a print result to be introduced when the first adjustment mechanism is adjusted by one step; the second altering section includes a second adjustment mechanism configured to adjust the carrying path of the medium; and the third marking includes a plurality of marks arranged starting from the third central position and spaced apart from one another by an interval that is the predetermined interval plus or minus an amount of shift in a print result to be introduced when the second adjustment mechanism is adjusted by one step.

According to a preferred embodiment of the present invention, a number of the plurality of marks of the second marking and a number of the plurality of marks of the third marking are smaller than a number of steps in which the first adjustment mechanism is adjustable and a number of steps in which the second adjustment mechanism is adjustable, respectively.

According to a preferred embodiment of the present invention, where a number of the plurality of marks of the second marking and a number of the plurality of marks of the third marking are different from each other, and a number of the plurality of marks of the first marking is equal to a larger one of the number of the plurality of marks of the second marking and the number of the plurality of marks of the third marking.

According to various preferred embodiments of the present invention, it is possible to provide a carrier device and an inkjet printer having the same and a carrying method, with which it is possible to easily rectify the medium running askew.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
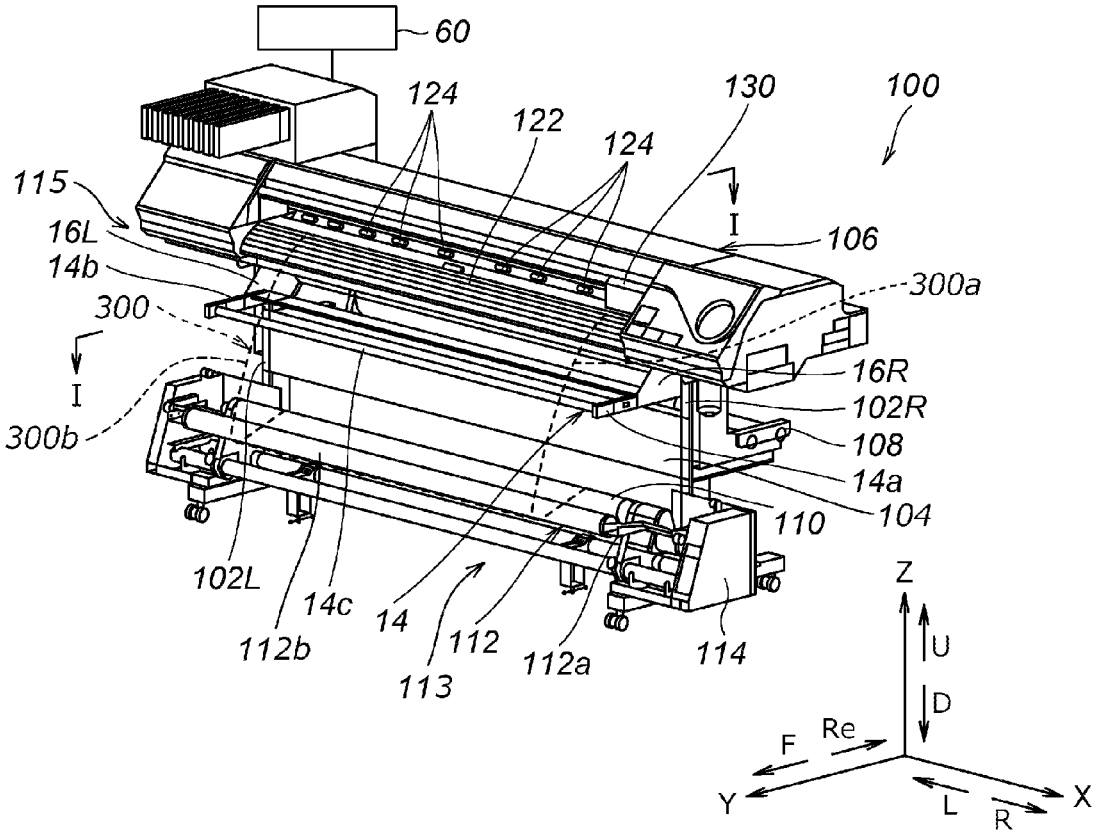
FIG. 1 is a front perspective view showing a structure of an inkjet printer according to a preferred embodiment of the present invention.
Figure 2:
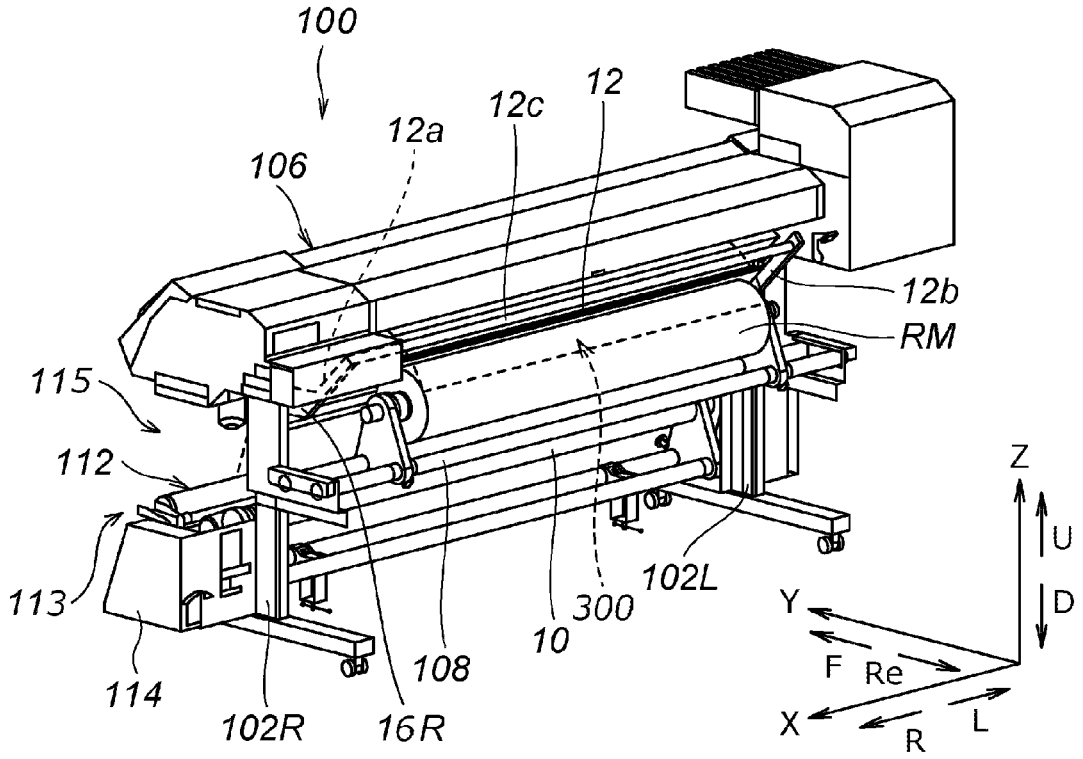
FIG. 2 is a back perspective view showing a structure of the inkjet printer according to a preferred embodiment of the present invention.
Figure 3:
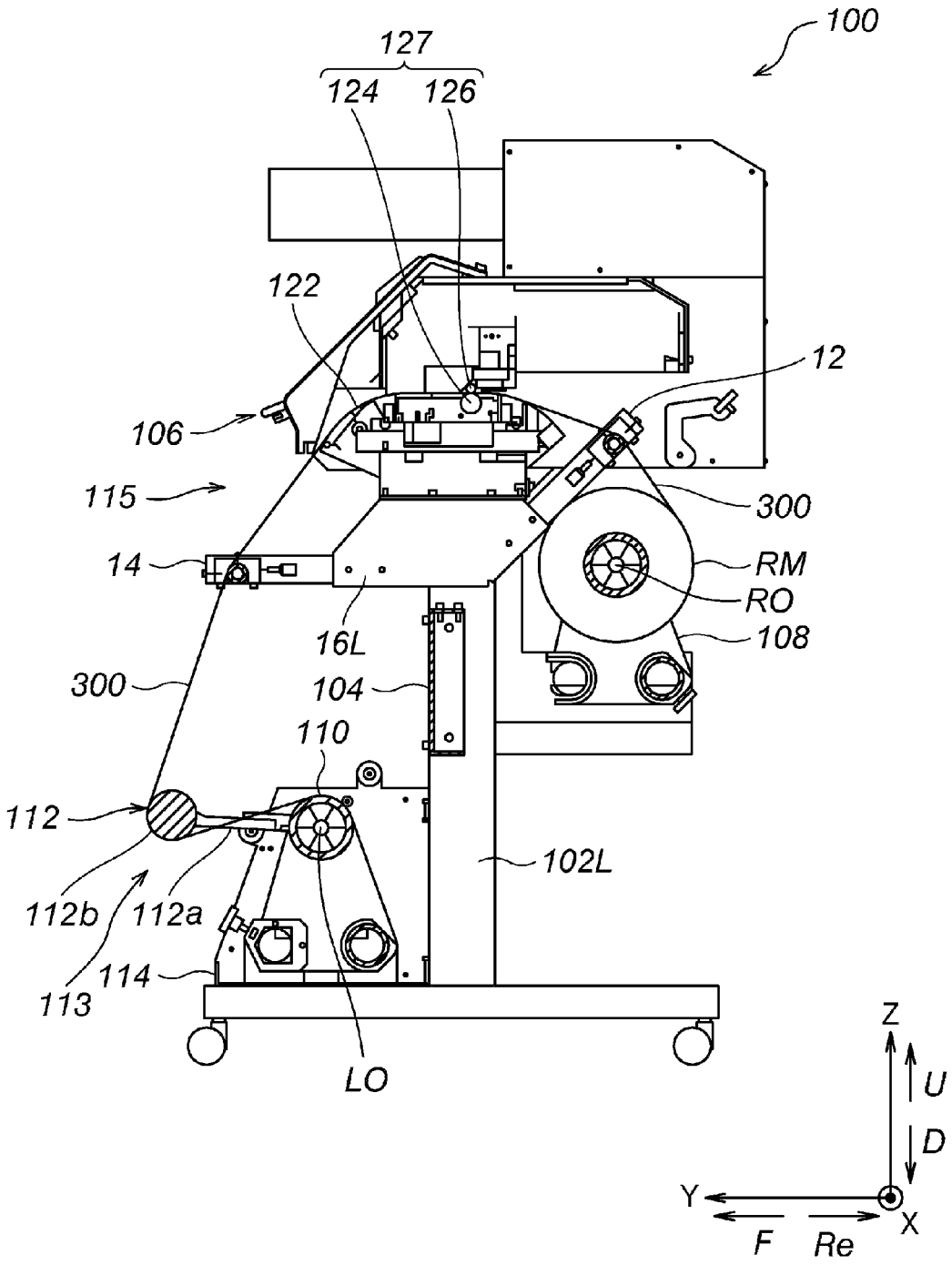
FIG. 3 is a cross-sectional view taken along line I-I of FIG. 1.

Preferred embodiments of the present invention will now be described with reference to the drawings. FIG. 1 is a front perspective view showing a structure of an inkjet printer 100 including a carrier device 115. FIG. 2 is a back perspective view showing a structure of the inkjet printer 100 including the carrier device 115. FIG. 3 is a cross-sectional view taken along line I-I of FIG. 1.

The term "medium" as used herein refers to paper such as plain paper, resin materials such as PVC and polyester, and various recording media of various materials such as aluminum, iron and wood, for example.

As used herein, the width direction of the medium 300 is referred to as the "primary scanning direction" as necessary. The direction perpendicular to the primary scanning direction is referred to as the "secondary scanning direction" as necessary.

The term"inkjet printing" as used herein refers to a printing method based on inkjet techniques known in the art, e.g., continuous printing such as binary deflection printing or continuous deflection printing, and on-demand printing such as thermal printing or piezoelectric printing, for example.

The terms "left", "right", "up" and "down", as used in the description below, refer to these directions as seen from a user present in front of the inkjet printer 100. Moreover, the direction from the inkjet printer 100 toward the user will be referred to as "front", and the opposite direction as "rear". The designations F, Re, L, R, U and D, as used in the figures, refer to front, rear, left, right, up and down, respectively. The character "X" in the figures denotes the X axis, representing the primary scanning direction. In the present preferred embodiment, the primary scanning direction is the left-right direction. The character "Y" in the figures denotes the Y axis, representing the secondary scanning direction. The secondary scanning direction is a direction perpendicular to the primary scanning direction. In the present preferred embodiment, the secondary scanning direction is the front-rear direction. The character "Z" in the figure denotes the Z axis, representing the up-down direction. Note that these designations of direction are used herein for the purpose of illustration, and should not be construed as being restrictive.

As shown in FIG. 1, the inkjet printer 100 includes a pair of left and right side members 102L and 102R, a support member 104, a main body 106, a support base 114, an ink head 130, and the carrier device 115.

The inkjet printer 100 is connected to a microcomputer 60. The inkjet printer 100 is controlled by the microcomputer 60.

The support member 104 is disposed between the side member 102L and the side member 102R. The support member 104 couples together the side member 102L and the side member 102R. The support member 104 extends in the X axis direction.

As shown in FIG. 2, the support base 114 is disposed at a lower portion of the side members 102L and 102R.

As shown in FIG. 1, the main body 106 is disposed over the side member 102L and the side member 102R. The main body 106 is provided with a platen 122.

The ink head 130 is provided in the main body 106. The ink head 130 is disposed at a position opposing the platen 122 to be described below. The ink head 130 is disposed above the platen 122. The ink head 130 moves in the primary scanning direction (the X axis direction). The ink head 130 discharges ink onto the medium 300 to be described below being carried in the secondary scanning direction over the platen 122.

The carrier device 115 includes a roll medium accommodating section 108, a re-rolling device 113, a carrying section 127, a first bar-shaped member 12, and a second bar-shaped member 14.

The roll medium accommodating section 108 is disposed behind the support member 104. A medium rolled in a roll (hereinafter referred to as a "roll medium RM") is disposed in the roll medium accommodating section 108. The roll medium RM is disposed with its center axis RO (see FIG. 3) parallel to the X axis. Note that the center axis of the roll medium RM is the rotation center axis about which the roll medium RM rotates to reel out the medium 300.

The re-rolling device 113 includes a re-rolling section 110 and a dancer roller 112. The re-rolling device 113 re-rolls the medium 300 with a predetermined tension applied on the medium 300.

The re-rolling section 110 is disposed in front of the side member 102L and the side member 102R. The re-rolling section 110 is rotatably provided on the support base 114. The re-rolling section 110 extends in the X axis direction. The re-rolling section 110 is disposed with its center axis LO parallel to the X axis. The re-rolling section 110 is rotated by a driving device (not shown) about the X axis. The re-rolling section 110 is capable of securing the medium 300 having been carried. The re-rolling section 110 re-rolls the medium 300 having been carried. The re-rolling section 110 is rotated by a driving device (not shown) about the X axis when it is detected by a sensor (not shown) provided on the dancer roller 112 that the dancer roller 112 has reached a predetermined inclination.

The dancer roller 112 is rotatably disposed forward of the re-rolling section 110. The dancer roller 112 includes a support shaft 112*a* provided on the support base 114, and a bar member 112*b* provided on the support shaft 112*a*. The support shaft 112*a* is provided with a sensor (not shown). The sensor detects the inclination of the support shaft 112*a* (i.e., the inclination of the dancer roller 112). The support shaft 112*a* rotates the bar member 112*b* about the X axis while the bar member 112*b* is parallel to the X axis direction. The positional relationship between the dancer roller 112, the main body 106 and the re-rolling section 110 is determined so that when the medium 300 being carried is re-rolled on the re-rolling section 110, the bar member 112*b* is in contact with the back surface of the medium 300, thus restricting the inclination of the dancer roller 112.

The dancer roller 112 contacts the back surface (i.e., the surface onto which ink has not been discharged) of the medium 300 being carried while the medium 300 is re-rolled on the re-rolling section 110, thus applying a predetermined tension on the medium 300 by the own weight of the dancer roller 112. The medium 300 being carried is under a constant tension acting in a downward-forward diagonal direction by the own weight of the dancer roller 112 (i.e., the support shaft 112*a* and the bar member 112*b*).

The carrying section 127 includes grid rolls 124 provided on the platen 122, and pinch rolls 126 provided on the main body 106 so as to be in contact with the grid rolls 124. A plurality of grid rolls 124 and a plurality of pinch rolls 126 are provided along the X axis direction. By driving the grid rolls 124 while the medium 300 is sandwiched between the grid rolls 124 and the pinch rolls 126, the medium 300 unrolled from the roll medium RM is carried in the secondary scanning direction. The carrying section 127 carries the medium 300 sandwiched between the grid rolls 124 and the pinch rolls 126 in the secondary scanning direction. The carrying section 127 carries the medium 300 forward and backward.

As shown in FIG. 3, the first bar-shaped member 12 is disposed between the main body 106 and the roll medium accommodating section 108. The first bar-shaped member 12 extends in the X axis direction (primary scanning direction).

As shown in FIG. 2, the first bar-shaped member 12 includes a support shaft 12*a*, a support shaft 12*b*, and a bar member 12*c*. The support shaft 12*a* is attached to a rear portion of a plate-shaped member 16R provided on the side member 102R. The support shaft 12*a* may be attached directly to the side member 102R. The support shaft 12*a* is inclined by 45±2 degrees, for example, with respect to the horizontal plane (the XZ plane). The support shaft 12*b* is attached to a rear portion of a plate-shaped member 16L provided on the side member 102L. The support shaft 12*b* may be attached directly to the side member 102L. The support shaft 12*b* is disposed inclined by the same angle as the support shaft 12*a*. One end 12*cx* (see FIG. 5A) of the bar member 12*c* is connected to the support shaft 12*a*. The other end 12*cy* (see FIG. 5A) of the bar member 12*c* is connected to the support shaft 12*b*. The bar member 12*c* extends in the X axis direction (primary scanning direction).

The first bar-shaped member 12 is configured so that the bar member 12*c* contacts the back surface of the medium 300 so as to press the medium 300 from the back surface thereof before the medium 300 unrolled from the roll medium RM is carried to the platen 122. The first bar-shaped member 12 pushes up the medium 300 in an upward-rearward diagonal direction. The first bar-shaped member 12 changes the carrying path of the medium 300 by pushing up the medium 300 in an upward-rearward diagonal direction.

Figure 4:
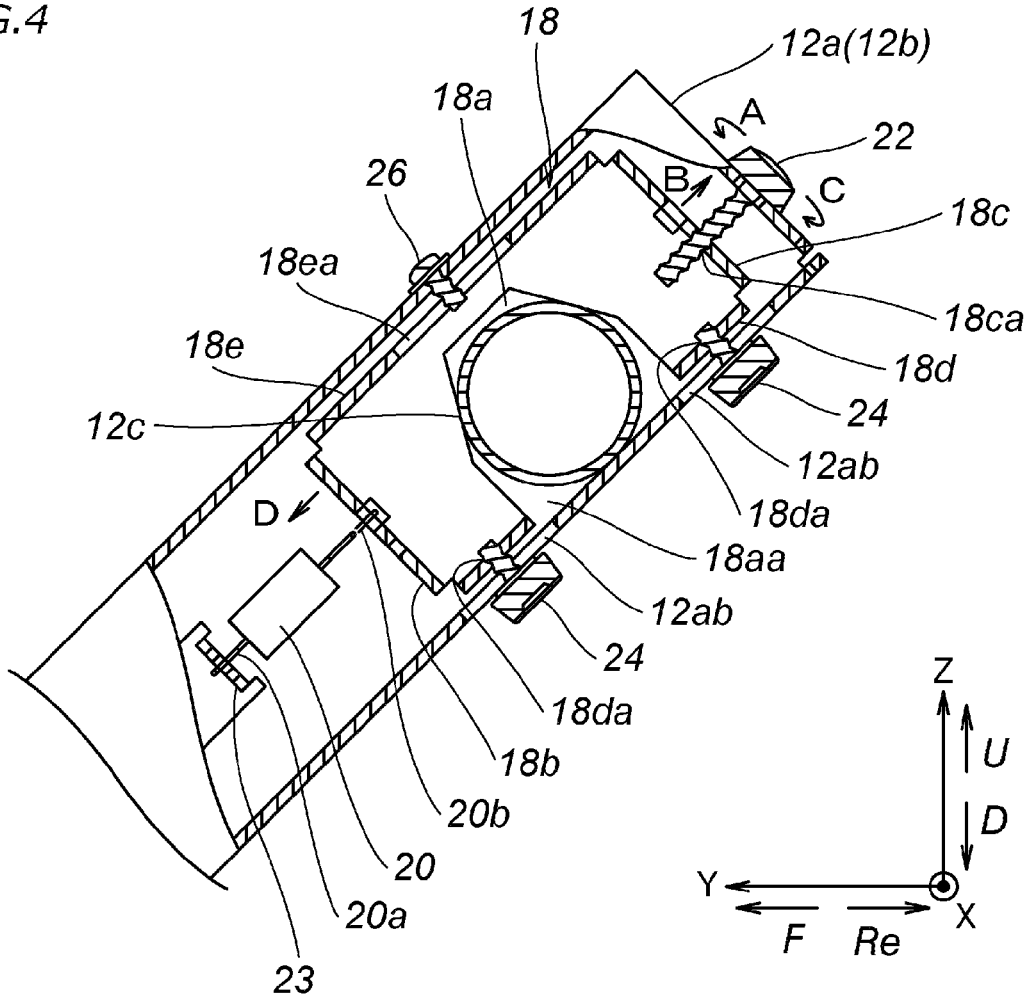
FIG. 4 is a cross-sectional view showing a portion of a support shaft of a first bar-shaped member.

As shown in FIG. 4, the support shaft 12*a* includes a movable portion 18 and a spring 20. The movable portion 18 is disposed inside the support shaft 12*a*. The movable portion 18 moves inside the support shaft 12*a* along the extension direction of the support shaft 12*a*. The one end 12*cx* of the bar member 12*c* is connected to the movable portion 18.

The movable portion 18 preferably has a box shape, for example. A recess 18*a* is provided in the movable portion 18. The recess 18*a* preferably has a shape such that the one end 12*cx* of the bar member 12*c* is capable of being inserted therein. The movable portion 18 includes an opening 18*aa* located in the central portion of a side surface 18*d* of the movable portion 18.

A side surface 18*b* of the movable portion 18 is connected to the spring 20. The spring 20 is provided on a protrusion 23 in the support shaft 12*a*. The side surface 18*b* is a surface facing in a downward-forward diagonal direction. A screw hole 18*ca* is provided in a side surface 18*c* opposite to the side surface 18*b*. A screw 22, as a first adjustment mechanism, which is inserted into the support shaft 12*a* is engaged with the screw hole 18*ca*. With the screw 22 engaged with the screw hole 18*ca*, the spring 20 is constantly urging the movable portion 18 in a downward-forward diagonal direction.

A pair of screw holes 18*da* are provided in the side surface 18*d*, with the opening 18*aa* located therebetween. Screws 24 inserted through elongated holes 12*ab* in the support shaft 12*a* are engaged respectively with the pair of screw holes 18*da*. The longitudinal dimension of each elongated hole 12*ab* lies in the extension direction of the support shaft 12*a*. An elongated hole 18*ea* is provided in a side surface 18*e* opposite to the side surface 18*d*. A pin 26 fixed on the support shaft 12*a* is inserted through the elongated hole 18*ea*. The longitudinal dimension of the elongated hole 18*ea* lies in the extension direction of the support shaft 12*a*.

When the screw 22 is turned in the direction of arrow A of FIG. 4 with the screws 24 loosened, the movable portion 18 moves in the direction of arrow B of FIG. 4 against the urging force of the spring 20. On the other hand, when the screw 22 is turned in the direction of arrow C of FIG. 4 with the screws 24 loosened, the movable portion 18 moves in the direction of arrow D of FIG. 4 by the urging force of the spring 20 and the own weight of the movable portion 18. The movable portion 18 is movable within the extent of the longitudinal dimension of the elongated holes 12*ab* and the longitudinal dimension of the elongated hole 18*ea*. Note that the positions of the elongated holes 12*ab* and the elongated hole 18*ea* are determined so that the bar member 12*c* pushes up the medium 300 upward even when the movable portion 18 is at the lowest position.

The movable portion 18, having been moved to an intended position within its movable extent in the support shaft 12*a*, is fixed on the support shaft 12*a* by tightening the screws 24. Thus, the one end 12*cx* of the bar member 12*c* is sandwiched between the movable portion 18 and an inner surface 12*x* of the support shaft 12*a*. As a result, the one end 12*cx* of the bar member 12*c* is fixed on the support shaft 12*a*.

As shown in FIG. 4, the support shaft 12*b* includes a movable portion 18 and a spring 20. The movable portion 18 is disposed inside the support shaft 12*b*. The movable portion 18 moves inside the support shaft 12*b* along the extension direction of the support shaft 12*b*. The other end 12*cy* of the bar member 12*c* is connected to the movable portion 18. Note that the support shaft 12*b* is generally left-right symmetric with respect to the support shaft 12*a*. Thus, members and sections of like functions to those of the support shaft 12*a* are denoted by like reference signs, and detailed descriptions of the support shaft 12*b* will be omitted.

With the first bar-shaped member 12, the positions of the one end 12*cx* and the other end 12*cy* of the bar member 12*c* are adjusted by turning the screw 22 of the support shaft 12*a* and the screw 22 of the support shaft 12*b*. Thus, the bar member 12*c* is fixed inclined (fixed while being inclined) by an angle within a predetermined range with respect to the X axis. That is, the bar member 12*c* is able to be fixed inclined by an angle within a predetermined range with respect to the center axis RO of the roll medium RM.

Referring to FIGS. 5A to 5H, how the bar member 12*c* is moved will be described. In FIGS. 5A to 5H, the solid line represents the first initial position of the bar member 12*c*, and the broken line represents the moved position of the bar member 12*c*. Herein, the first initial position is defined as the position of the movable portion 18 of the support shaft 12*a*, the movable portion 18 of the support shaft 12*b* and the bar member 12*c* when the pin 26 is located at the center of the elongated hole 18*ea*, the screws 24 are at the center of the respective elongated holes 12*ab*, and the bar member 12*c* is parallel to the X axis, as shown in FIG. 4.

Figure 5A:
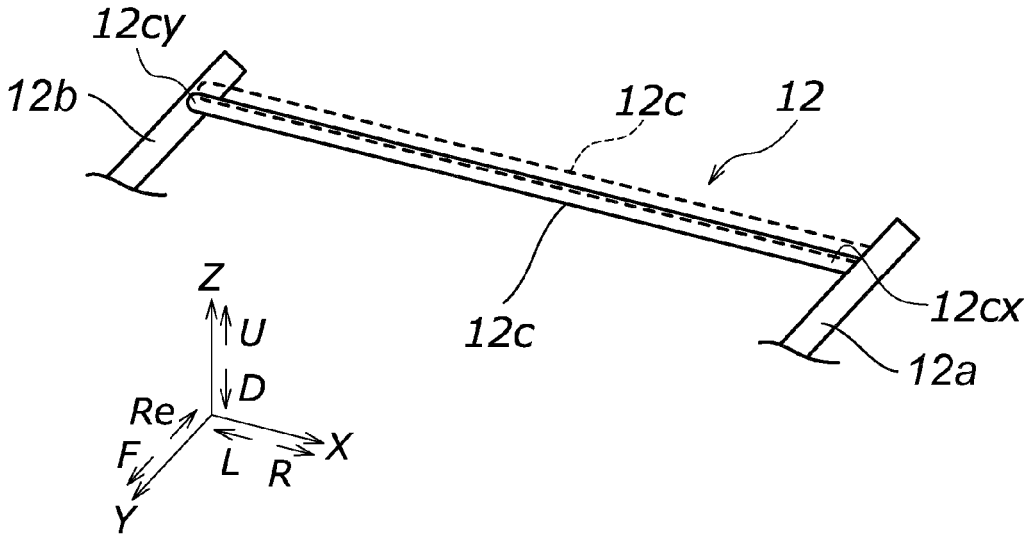
FIG. 5A is a diagram showing an initial position and a moved position of a bar member of the first bar-shaped member.

As shown in FIG. 5A, by moving the movable portions 18 of the support shaft 12*a* and the support shaft 12*b* by the same length in the direction of arrow B of FIG. 4 from the first initial position, it is possible to move the bar member 12*c* in an upward-rearward diagonal direction while being parallel to the X axis, and the bar member 12*c* is capable of being fixed there.

Figure 5B:
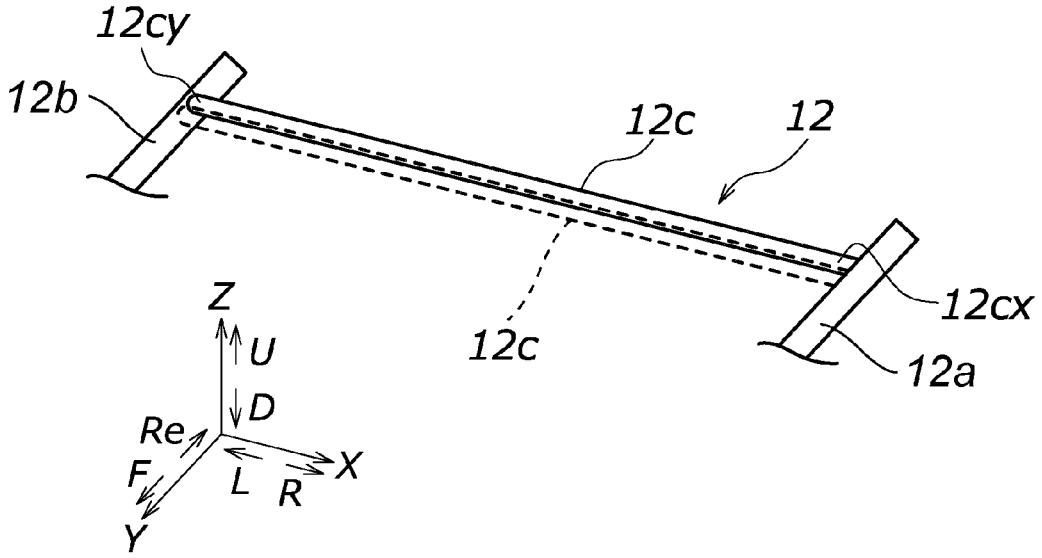
FIG. 5B is a diagram showing an initial position and a moved position of the bar member of the first bar-shaped member.

As shown in FIG. 5B, by moving the movable portions 18 of the support shaft 12*a* and the support shaft 12*b* by the same length in the direction of arrow D of FIG. 4 from the first initial position, it is possible to move the bar member 12*c* in a downward-forward diagonal direction while being parallel to the X axis, and the bar member 12*c* is capable of being fixed there.

Figure 5C:
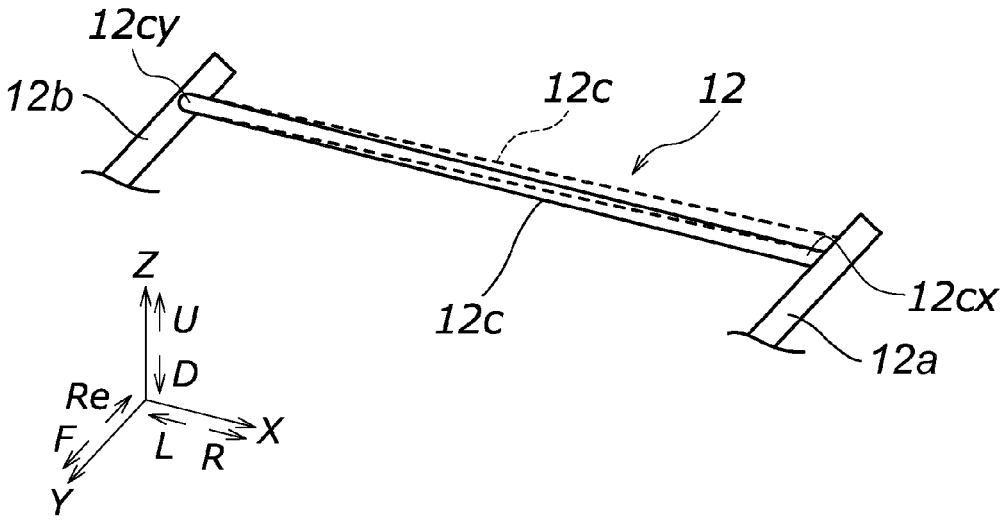
FIG. 5C is a diagram showing an initial position and a moved position of the bar member of the first bar-shaped member.

As shown in FIG. 5C, by moving only the movable portion 18 of the support shaft 12*a* in the direction of arrow B of FIG. 4 from the first initial position, it is possible to fix the bar member 12*c* inclined with respect to the X axis. That is, the one end 12*cx* of the bar member 12*c* is moved in an upward-rearward diagonal direction and fixed there. The bar member 12*c* is fixed so as to be inclined in a downward-forward diagonal direction as observed from the one end 12*cx* toward the other end 12*cy*.

Figure 5D:
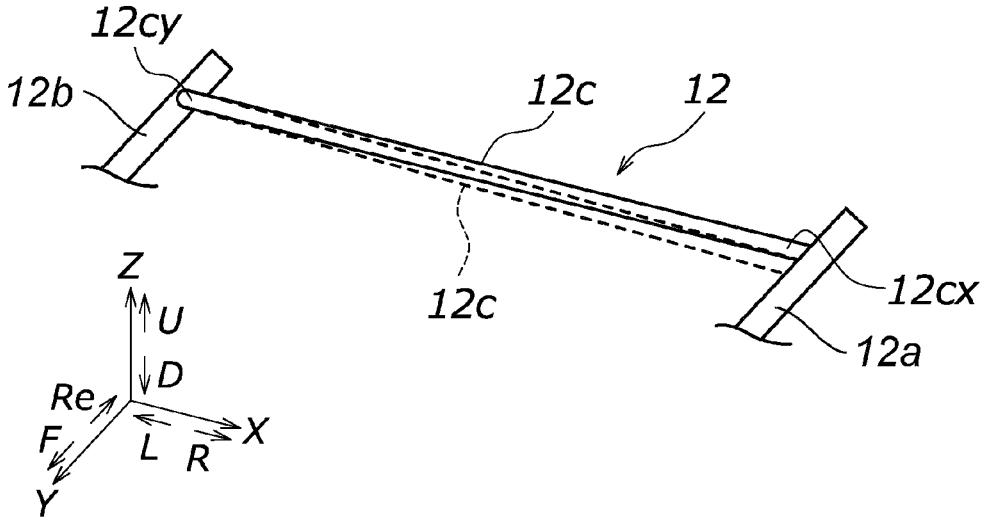
FIG. 5D is a diagram showing an initial position and a moved position of the bar member of the first bar-shaped member.

As shown in FIG. 5D, by moving only the movable portion 18 of the support shaft 12*a* in the direction of arrow D of FIG. 4 from the first initial position, it is possible to fix the bar member 12*c* inclined with respect to the X axis. That is, the one end 12*cx* of the bar member 12*c* is moved in a downward-forward diagonal direction and fixed there. The bar member 12*c* is fixed so as to be inclined in an upward-rearward diagonal direction as observed from the one end 12*cx* toward the other end 12*cy*.

Figure 5E:
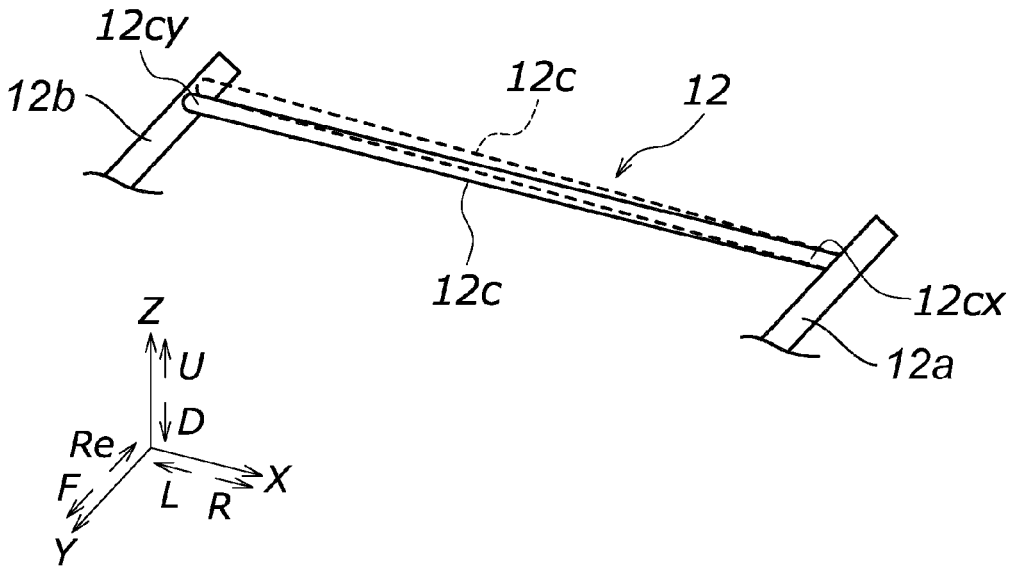
FIG. 5E is a diagram showing an initial position and a moved position of the bar member of the first bar-shaped member.

As shown in FIG. 5E, by moving only the movable portion 18 of the support shaft 12*b* in the direction of arrow B of FIG. 4 from the first initial position, it is possible to fix the bar member 12*c* inclined with respect to the X axis. That is, the other end 12*cy* of the bar member 12*c* is moved in an upward-rearward diagonal direction and fixed there. The bar member 12*c* is fixed so as to be inclined in an upward-rearward diagonal direction as observed from the one end 12*cx* toward the other end 12*cy*. Note that the bar member 12*c* is located farther in an upward-rearward diagonal direction as compared with a case where only the movable portion 18 of the support shaft 12*a* is moved in the direction of arrow D of FIG. 4.

Figure 5F:
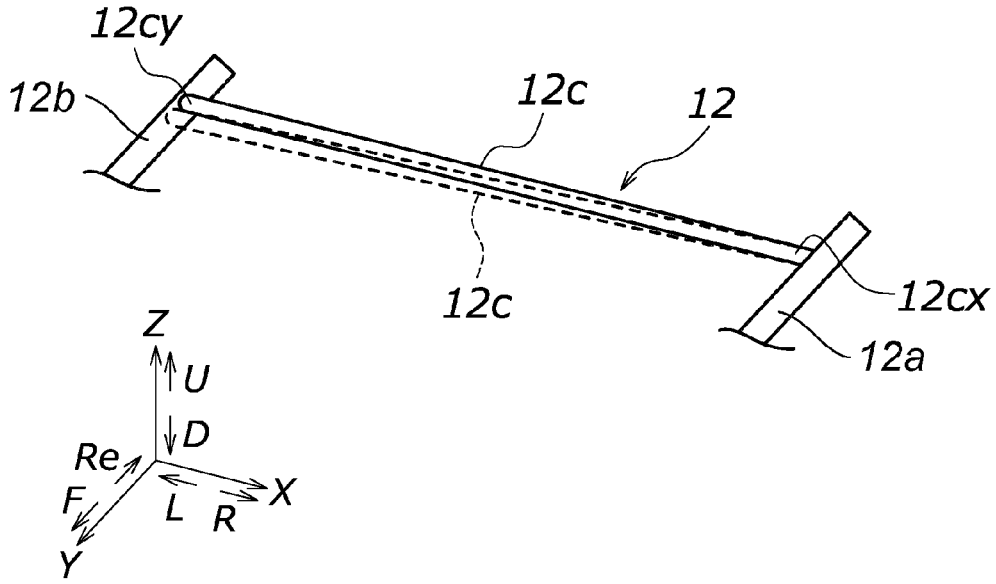
FIG. 5F is a diagram showing an initial position and a moved position of the bar member of the first bar-shaped member.

As shown in FIG. 5F, by moving only the movable portion 18 of the support shaft 12*b* in the direction of arrow D of FIG. 4 from the first initial position, it is possible to fix the bar member 12*c* inclined with respect to the X axis. That is, the other end 12*cy* of the bar member 12*c* is moved in a downward-forward diagonal direction and fixed there. The bar member 12*c* is fixed so as to be inclined in a downward-forward diagonal direction as observed from the one end 12*cx* toward the other end 12*cy*. Note that the bar member 12*c* is located farther in a downward-forward diagonal direction as compared with a case where only the movable portion 18 of the support shaft 12*a* is moved in the direction of arrow B of FIG. 4.

Figure 5G:
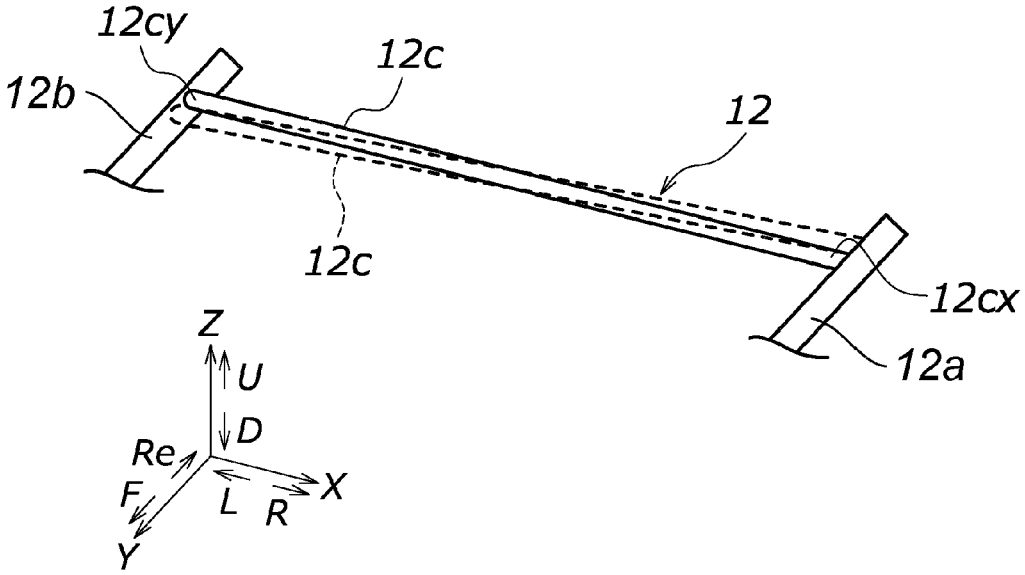
FIG. 5G is a diagram showing an initial position and a moved position of the bar member of the first bar-shaped member.

As shown in FIG. 5G, by moving the movable portion 18 of the support shaft 12*a* in the direction of arrow B of FIG. 4 from the first initial position and moving the movable portion 18 of the support shaft 12*b* in the direction of arrow D of FIG. 4 from the first initial position, it is possible to fix the bar member 12*c* inclined with respect to the X axis. That is, the one end 12*cx* of the bar member 12*c* and the other end 12*cy* of the bar member 12*c* are moved in an upward-rearward diagonal direction and in a downward-forward diagonal direction, respectively, and fixed there. The bar member 12*c* is fixed so as to be inclined in a downward-forward diagonal direction as observed from the one end 12*cx* toward the other end 12*cy*. Note that the inclination angle of the bar member 12*c* with respect to the center axis RO of the roll medium RM is able to be made larger as compared with a case where only the movable portion 18 of the support shaft 12*a* is moved in the direction of arrow B of FIG. 4 or only the movable portion 18 of the support shaft 12*b* is moved in the direction of arrow D of FIG. 4.

Figure 5H:
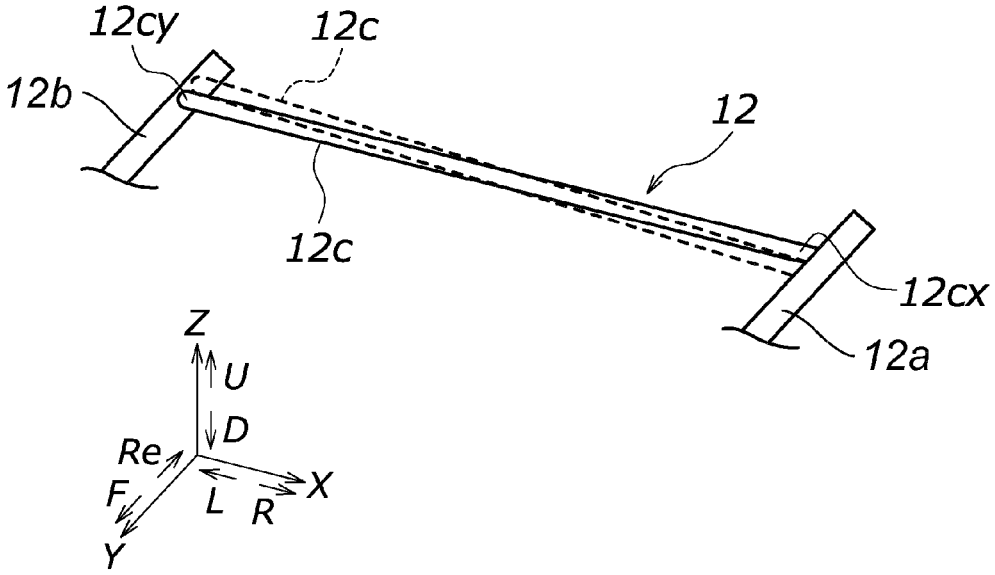
FIG. 5H is a diagram showing an initial position and a moved position of the bar member of the first bar-shaped member.

As shown in FIG. 5H, by moving the movable portion 18 of the support shaft 12*a* in the direction of arrow D of FIG. 4 from the first initial position and moving the movable portion 18 of the support shaft 12*b* in the direction of arrow B of FIG.

4 from the first initial position, it is possible to fix the bar member 12*c* inclined with respect to the X axis. That is, the one end 12*cx* of the bar member 12*c* and the other end 12*cy* of the bar member 12*c* are moved in a downward-forward diagonal direction and in an upward-rearward diagonal direction, respectively, and fixed there. The bar member 12*c* is fixed so as to be inclined in an upward-forward diagonal direction as observed from the one end 12*cx* toward the other end 12*cy*. Note that the inclination angle of the bar member 12*c* with respect to the center axis RO of the roll medium RM is able to be made larger as compared with a case where only the movable portion 18 of the support shaft 12*a* is moved in the direction of arrow D of FIG. 4 or only the movable portion 18 of the support shaft 12*b* is moved in the direction of arrow B of FIG. 4.

Note that the direction of movement and the amount of movement of the movable portions 18 of the support shaft 12*a* and the support shaft 12*b* are adjusted steplessly by the screws 22. Therefore, the inclination angle of the bar member 12*c* with respect to the center axis RO of the roll medium RM is suitably determined by adjusting the screws 22.

As shown in FIG. 3, the second bar-shaped member 14 is disposed between the main body 106 and the dancer roller 112. The second bar-shaped member 14 extends in the X axis direction (primary scanning direction).

As shown in FIG. 1, the second bar-shaped member 14 includes a support shaft 14*a*, a support shaft 14*b*, and a bar member 14*c*. The support shaft 14*a* is attached to a front portion of the plate-shaped member 16R provided on the side member 102R. The support shaft 14*a* may be attached directly to the side member 102R. The support shaft 14*a* extends in the secondary scanning direction. The support shaft 14*b* is attached to a front portion of the plate-shaped member 16L provided on the side member 102L. The support shaft 14*a* may be attached directly to the side member 102L. The support shaft 14*b* extends in the secondary scanning direction. One end 14*cx* (see FIG. 7A) of the bar member 14*c* is connected to the support shaft 14*a*. The other end 14*cy* (see FIG. 7A) of the bar member 14*c* is connected to the support shaft 14*b*. The bar member 14*c* extends in the X axis direction (primary scanning direction).

The second bar-shaped member 14 is configured so that the bar member 14*c* contacts the back surface of the medium 300 so as to press the medium 300 from the back surface thereof before the medium 300 having been carried from the platen 122 contacts the dancer roller 112. The second bar-shaped member 14 pushes out the medium 300 forward. The second bar-shaped member 14 changes the carrying path of the medium 300 by pushing out the medium 300 forward.

As shown in FIG. 5, the support shaft 14*a* includes a movable portion 38 and a spring 40. The movable portion 38 is disposed inside the support shaft 14*a*. The movable portion 38 moves inside the support shaft 14*a* along the extension direction of the support shaft 14*a*. The one end 14*cx* of the bar member 14*c* is connected to the movable portion 38.

The movable portion 38 preferably has a box shape, for example. A recess 38*a* is provided in the movable portion 38. The recess 38*a* preferably has a shape such that the one end 14*cx* of the bar member 14*c* is capable of being inserted therein. The movable portion 38 includes an opening 38*aa* located in the central portion of a side surface 38*d* of the movable portion 38.

A side surface 38*b* of the movable portion 38 is connected to the spring 40. The spring 40 is provided on a protrusion 43 in the support shaft 14*a*. The side surface 38*b* is a surface facing rearward. A screw hole 38*ca* is provided in a side surface 38*c* opposite to the side surface 38*b*. A screw 42, as a second adjustment mechanism, which is inserted into the support shaft 14*a* is engaged with the screw hole 38*ca*. With the screw 42 engaged with the screw hole 38*ca*, the spring 40 is constantly urging the movable portion 38 rearward.

A pair of screw holes 38*da* are provided in the side surface 38*d*, with the opening 38*aa* located therebetween. Screws 44 inserted through elongated holes 14*ab* in the support shaft 14*a* are engaged respectively with the pair of screw holes 38*da*. The longitudinal dimension of each elongated hole 14*ab* lies in the extension direction of the support shaft 14*a*. An elongated hole 38*ea* is provided in a side surface 38*e* opposite to the side surface 38*d*. A pin 46 fixed on the support shaft 14*a* is inserted through the elongated hole 38*ea*. The longitudinal dimension of the elongated hole 38*ea* lies in the extension direction of the support shaft 14*a*.

Figure 6:
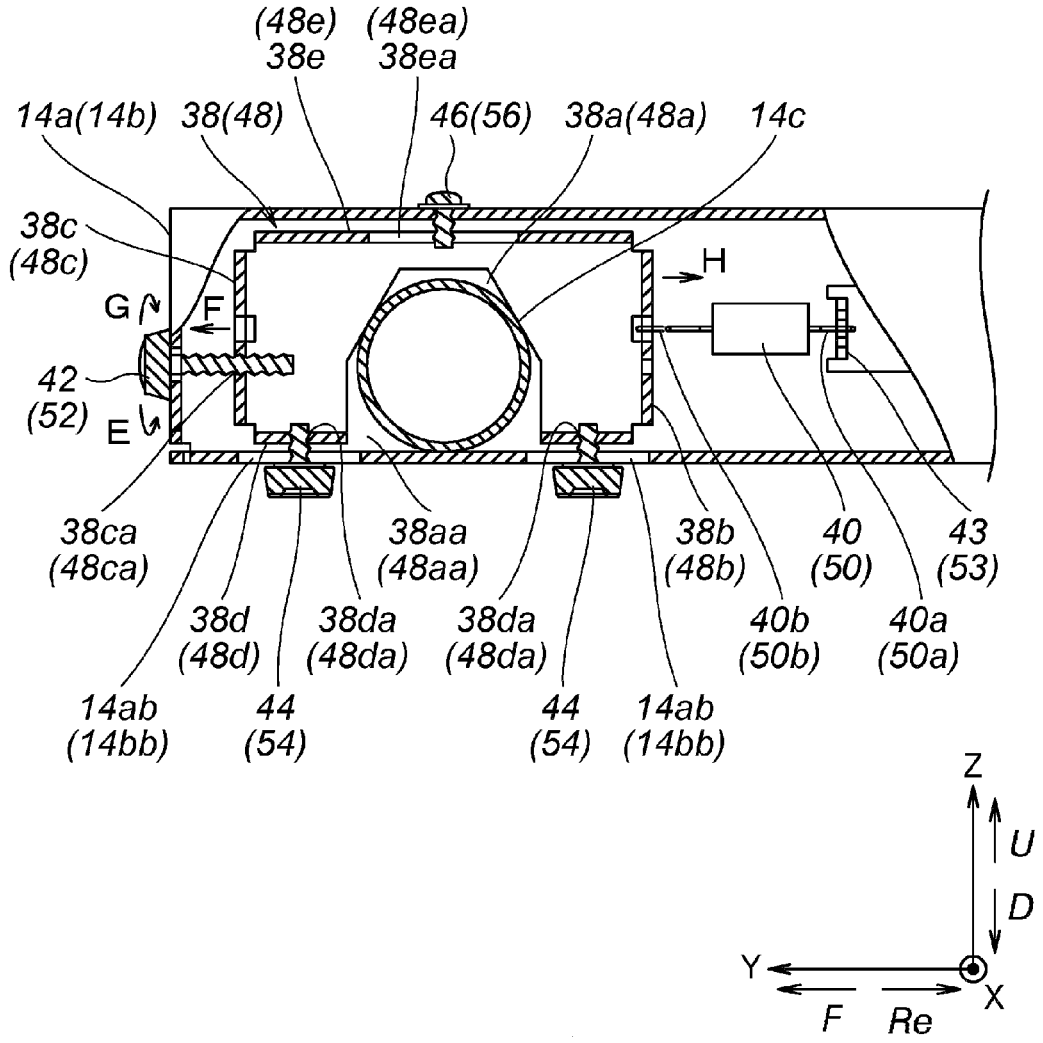
FIG. 6 is across-sectional view showing a portion of a support shaft of a second bar-shaped member.

When the screw 42 is turned in the direction of arrow E of FIG. 6 with the screws 44 loosened, the movable portion 38 moves in the direction of arrow F of FIG. 6 against the urging force of the spring 40. On the other hand, when the screw 42 is turned in the direction of arrow G of FIG. 6 with the screws 44 loosened, the movable portion 38 moves in the direction of arrow H of FIG. 6 by the urging force of the spring 40. The movable portion 38 is movable within the extent of the longitudinal dimension of the elongated holes 14*ab* and the longitudinal dimension of the elongated hole 38*ea*. Note that the positions of the elongated holes 14*ab* and the elongated hole 38*ea* are determined so that the bar member 14*c* pushes out the medium 300 forward even when the movable portion 38 is at the rearmost position.

The movable portion 38, having been moved to an intended position within its movable extent in the support shaft 14*a*, is fixed on the support shaft 14*a* by tightening the screws 44. Thus, the one end 14*cx* of the bar member 14*c* is sandwiched between the movable portion 38 and an inner surface 14*x* of the support shaft 14*a*. As a result, the one end 14*cx* of the bar member 14*c* is fixed on the support shaft 14*a*.

As shown in FIG. 6, the support shaft 14*b* includes a movable portion 38 and a spring 40. The movable portion 38 is disposed inside the support shaft 14*b*. The movable portion 38 moves inside the support shaft 14*b* along the extension direction of the support shaft 14*b*. The other end 14*cy* of the bar member 14*c* is connected to the movable portion 38. Note that the support shaft 14*b* is generally left-right symmetric with respect to the support shaft 14*a*. Thus, members and sections of like functions to those of the support shaft 14*a* are denoted by like reference signs, and detailed descriptions of the support shaft 14*b* will be omitted.

With the second bar-shaped member 14, the positions of the one end 14*cx* and the other end 14*cy* of the bar member 14*c* are adjusted by turning the screw 42 of the support shaft 14*a* and the screw 42 of the support shaft 14*b*. Thus, the bar member 14*c* is able to be fixed inclined by an angle within a predetermined range with respect to the X axis. That is, the bar member 14*c* is able to be fixed inclined by an angle within a predetermined range with respect to the center axis LO of the re-rolling section 110.

Referring to FIGS. 7A to 7H, how the bar member 14*c* is moved will be described. In FIGS. 7A to 7H, the solid line represents the second initial position of the bar member 14*c*, and the broken line represents the moved position of the bar member 14*c*. Herein, the second initial position is defined as the position of the movable portion 38 of the support shaft 14*a*, the movable portion 38 of the support shaft 14*b* and the bar member 14*c* when the pin 46 is located at the center of the elongated hole 38*ea*, the screws 44 are at the center of the respective elongated holes 14*ab*, and the bar member 14*c* is parallel to the X axis, as shown in FIG. 6.

Figure 7A:
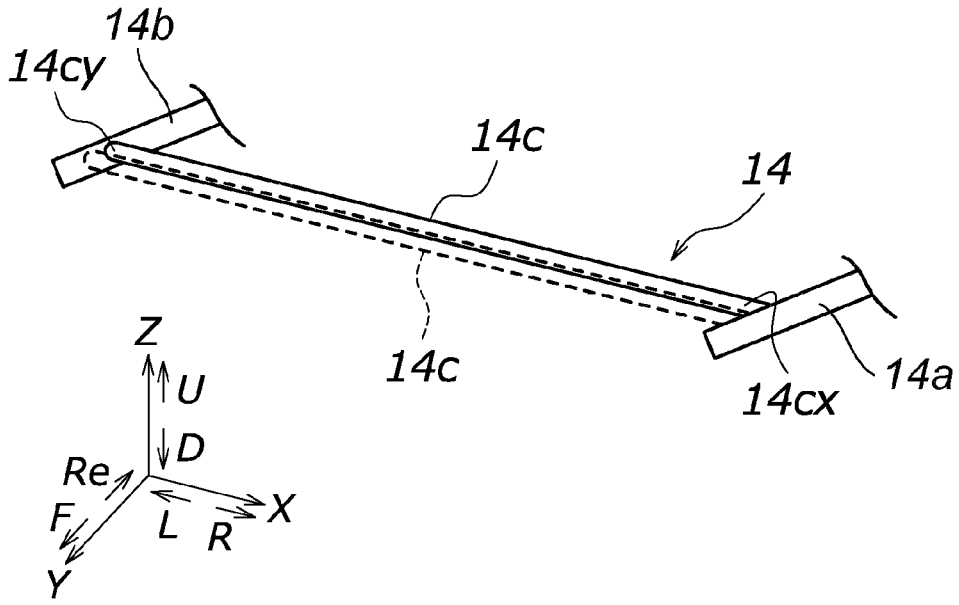
FIG. 7A is a diagram showing an initial position and a moved position of a bar member of the second bar-shaped member.

As shown in FIG. 7A, by moving the movable portions 38 of the support shaft 14*a* and the support shaft 14*b* by the same length in the direction of arrow F of FIG. 6 from the second initial position, it is possible to move the bar member 14*c* forward while being parallel to the X axis, and the bar member 14*c* is capable of being fixed there.

Figure 7B:
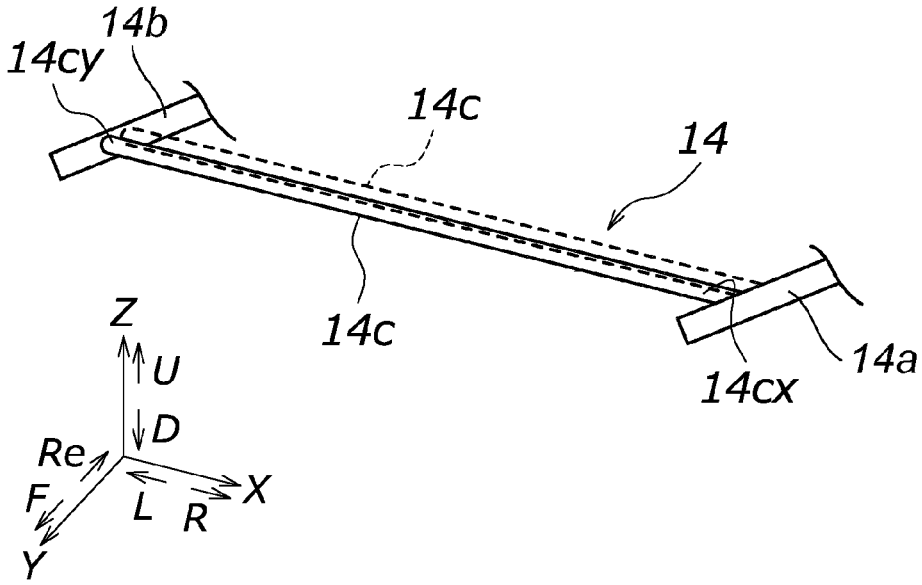
FIG. 7B is a diagram showing an initial position and a moved position of the bar member of the second bar-shaped member.

As shown in FIG. 7B, by moving the movable portions 38 of the support shaft 14*a* and the support shaft 14*b* by the same length in the direction of arrow H of FIG. 6 from the second initial position, it is possible to move the bar member 14*c* rearward while being parallel to the X axis, and the bar member 14*c* is capable of being fixed there.

Figure 7C:
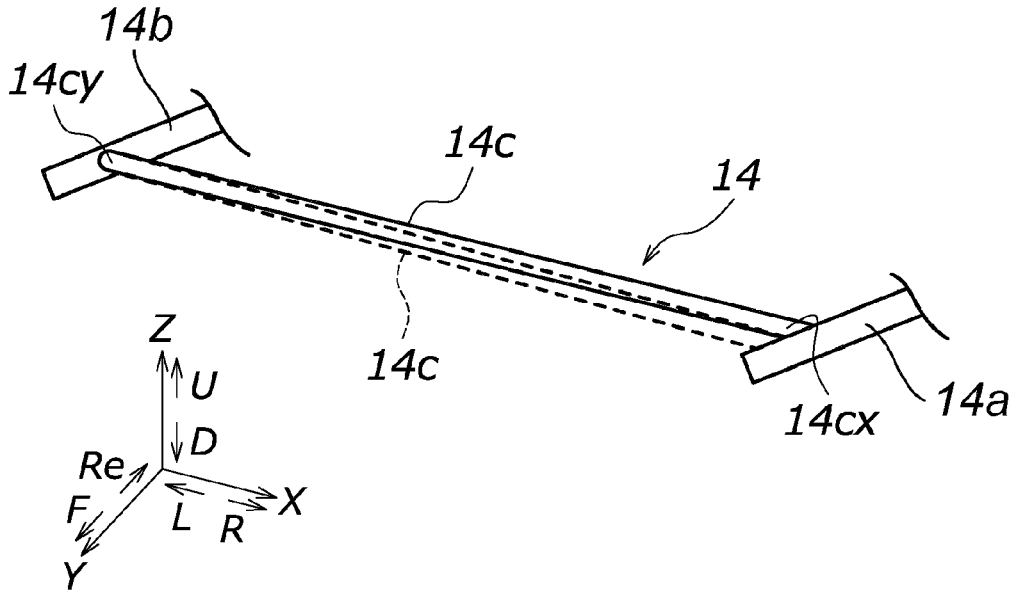
FIG. 7C is a diagram showing an initial position and a moved position of the bar member of the second bar-shaped member.

As shown in FIG. 7C, by moving only the movable portion 38 of the support shaft 14*a* in the direction of arrow F of FIG. 6 from the second initial position, it is possible to fix the bar member 14*c* inclined with respect to the X axis. That is, the one end 14*cx* of the bar member 14*c* is moved forward and fixed there. The bar member 14*c* is fixed so as to be inclined rearward as observed from the one end 14*cx* toward the other end 14*cy*.

Figure 7D:
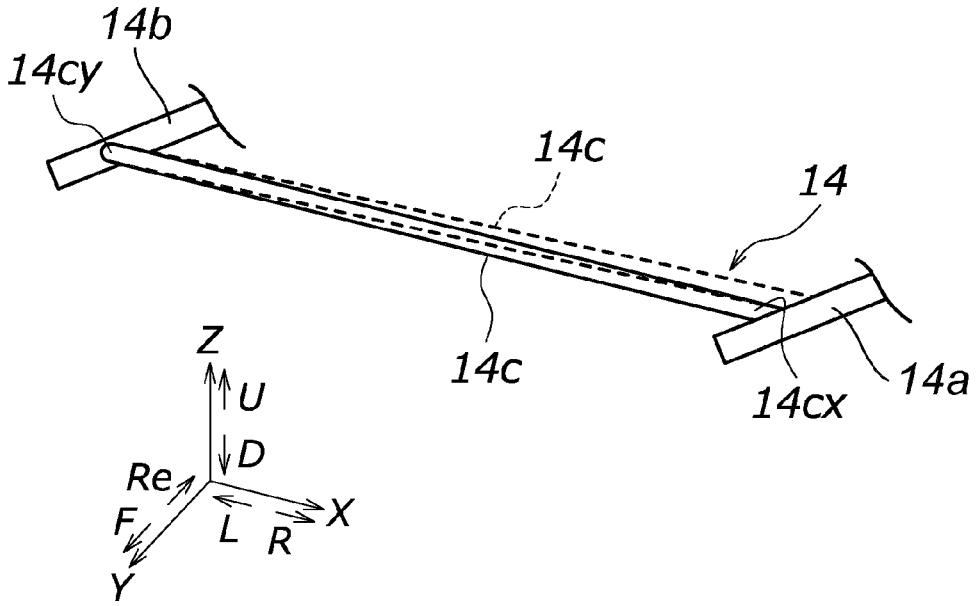
FIG. 7D is a diagram showing an initial position and a moved position of the bar member of the second bar-shaped member.

As shown in FIG. 7D, by moving only the movable portion 38 of the support shaft 14*a* in the direction of arrow H of FIG. 6 from the second initial position, it is possible to fix the bar member 14*c* inclined with respect to the X axis. That is, the one end 14*cx* of the bar member 14*c* is moved rearward and fixed there. The bar member 14*c* is fixed so as to be inclined forward as observed from the one end 14*cx* toward the other end 14*cy*.

Figure 7E:
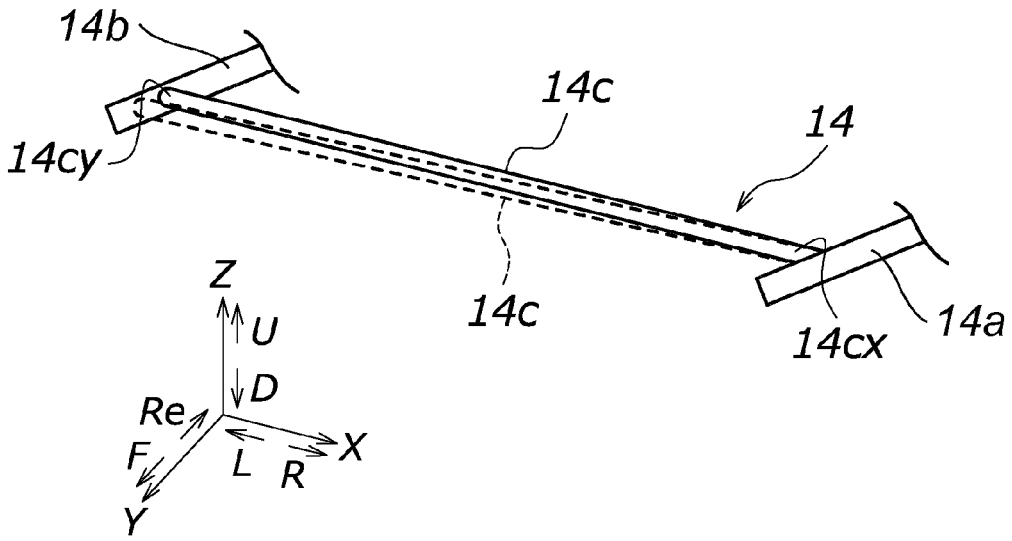
FIG. 7E is a diagram showing an initial position and a moved position of the bar member of the second bar-shaped member.

As shown in FIG. 7E, by moving only the movable portion 38 of the support shaft 14*b* in the direction of arrow F of FIG. 6 from the second initial position, it is possible to fix the bar member 14*c* inclined with respect to the X axis. That is, the other end 14*cy* of the bar member 14*c* is moved forward and fixed there. The bar member 14*c* is fixed so as to be inclined forward as observed from the one end 14*cx* toward the other end 14*cy*. Note that the bar member 14*c* is located farther forward as compared with a case where only the movable portion 38 of the support shaft 14*a* is moved in the direction of arrow H of FIG. 6.

Figure 7F:
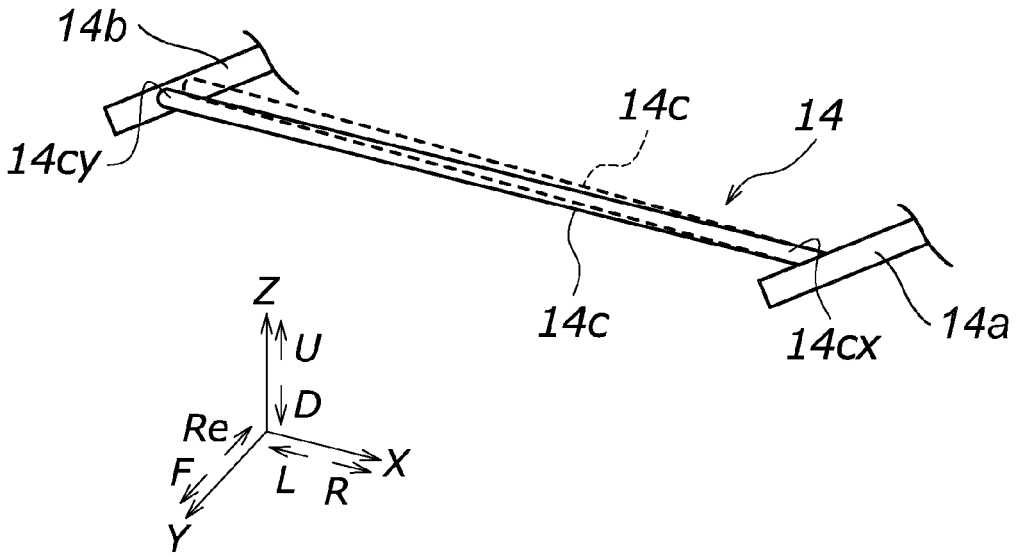
FIG. 7F is a diagram showing an initial position and a moved position of the bar member of the second bar-shaped member.

As shown in FIG. 7F, by moving only the movable portion 38 of the support shaft 14*b* in the direction of arrow H of FIG. 6 from the second initial position, it is possible to fix the bar member 14*c* inclined with respect to the X axis. That is, the other end 14*cy* of the bar member 14*c* is moved rearward and fixed there. The bar member 14*c* is fixed so as to be inclined rearward as observed from the one end 14*cx* toward the other end 14*cy*. Note that the bar member 14*c* is located farther rearward as compared with a case where only the movable portion 38 of the support shaft 14*a* is moved in the direction of arrow F of FIG. 6.

Figure 7G:
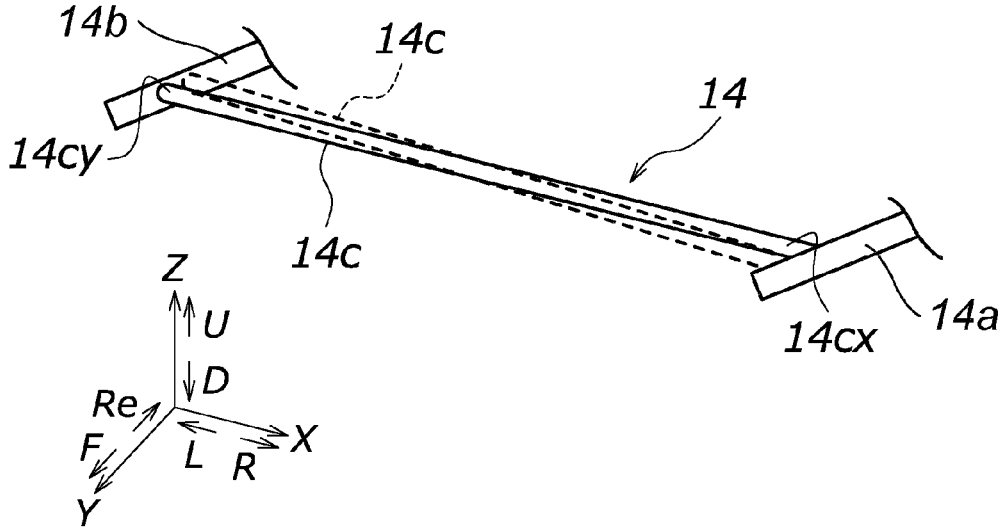
FIG. 7G is a diagram showing an initial position and a moved position of the bar member of the second bar-shaped member.

As shown in FIG. 7G, by moving the movable portion 38 of the support shaft 14*a* in the direction of arrow F of FIG. 6 from the second initial position and moving the movable portion 38 of the support shaft 14*b* in the direction of arrow H of FIG. 6 from the second initial position, it is possible to fix the bar member 14*c* inclined with respect to the X axis. That is, the one end 14*cx* of the bar member 14*c* and the other end 14*cy* of the bar member 14*c* are moved forward and rearward, respectively, and fixed there. The bar member 14*c* is fixed so as to be inclined rearward as observed from the one end 14*cx* toward the other end 14*cy*. Note that the inclination angle of the bar member 14*c* with respect to the center axis LO of the re-rolling section 110 is able to be made larger as compared with a case where only the movable portion 38 of the support shaft 14*a* is moved in the direction of arrow F of FIG. 6 or only the movable portion 38 of the support shaft 14*b* is moved in the direction of arrow H of FIG. 6.

Figure 7H:
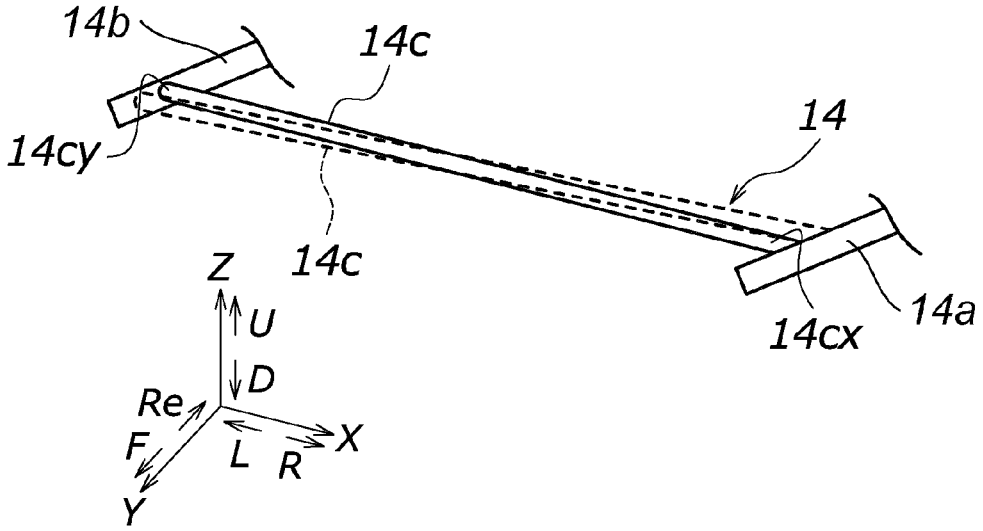
FIG. 7H is a diagram showing an initial position and a moved position of the bar member of the second bar-shaped member.

As shown in FIG. 7H, by moving the movable portion 38 of the support shaft 14*a* in the direction of arrow H of FIG. 6 from the second initial position and moving the movable portion 38 of the support shaft 14*b* in the direction of arrow F of FIG. 6 from the second initial position, it is possible to fix the bar member 14*c* inclined with respect to the X axis. That is, the one end 14*cx* of the bar member 14*c* and the other end 14*cy* of the bar member 14*c* are moved rearward and forward, respectively, and fixed there. The bar member 14*c* is fixed so as to be inclined forward as observed from the one end 14*cx* toward the other end 14*cy*. Note that the inclination angle of the bar member 14*c* with respect to the center axis LO of the re-rolling section 110 is able to be made larger as compared with a case where only the movable portion 38 of the support shaft 14*a* is moved in the direction of arrow H of FIG. 6 or only the movable portion 38 of the support shaft 14*b* is moved in the direction of arrow F of FIG. 6.

Note that the direction of movement and the amount of movement of the movable portions 38 of the support shaft 14*a* and the support shaft 14*b* are adjusted steplessly by the screws 42. Therefore, the inclination angle of the bar member 14*c* with respect to the center axis LO of the re-rolling section 110 is suitably determined by adjusting the screws 42.

In order to print on the medium 300 by using the inkjet printer 100 having such a configuration, settings are performed first so that the inkjet printer 100 is ready to carry the medium 300 and to re-roll the carried medium 300. Then, based on data of a printed image having been input to the microcomputer 60, the ink head 130 is moved in the X axis direction and the medium 300 is carried in the secondary scanning direction, while ink is discharged from the ink head 130 onto the medium 300, thus performing a predetermined printing operation on the medium 300.

More particularly, the medium 300 unrolled from the roll medium RM disposed in the roll medium accommodating section 108 is sandwiched between the grid rolls 124 and the pinch rolls 126. The medium 300 is carried in the secondary scanning direction by driving the grid rolls 124.

Then, the medium 300, having been carried to such a position that the medium 300 is capable of being re-rolled on the re-rolling section 110, is secured on the re-rolling section 110. A driving device (not shown) configured to control the rotation of the re-rolling section 110 is driven to re-roll the medium 300 on the re-rolling section 110. Then, the dancer roller 112 is pivoted so that the bar member 112*b* contacts the back surface of the medium 300.

Then, the medium 300 is re-rolled on the re-rolling section 110 while carrying the medium 300 by a certain amount by driving the grid rolls 124. Note that this position of the dancer roller 112 is defined as the initial position of the dancer roller 112. The initial state is controlled based on the inclination of the support shaft 112*a*.

As the medium 300 is carried in the secondary scanning direction when performing a predetermined printing operation on the medium 300, the dancer roller 112 inclines in a downward-forward diagonal direction by the own weight. When the inclination of the support shaft 112*a* of the dancer roller 112 is equal to a preset predetermined inclination, the inclination is detected by the sensor provided on the support shaft 112*a*. Based on the sensor detection result, a driving device (not shown) configured to control the rotation of the re-rolling section 110 is driven for a predetermined amount of time. Thus, the re-rolling section 110 rotates to re-roll the medium 300 having been carried. In this process, the support shaft 112*a* of the dancer roller 112 moves in an upward-rearward diagonal direction to return to the initial state.

With the inkjet printer 100, a process of correcting the carrying path of the medium 300 is performed at a predetermined point in time, such as at the time of shipping. That is, the length of the right side edge 300*a* and the length of the left side edge 300*b* of the medium 300 being carried are adjusted to be equal to each other by using the first bar-shaped member 12 and the second bar-shaped member 14. The length of the right side edge 300*a* and the length of the left side edge 300*b* of the medium 300 located within the extent from the roll medium RM to the re-rolling section 110 are adjusted to be equal to each other by adjusting the direction, amount and angle of movement of the bar member 12*c* and those of the bar member 14*c*.

Figure 8:
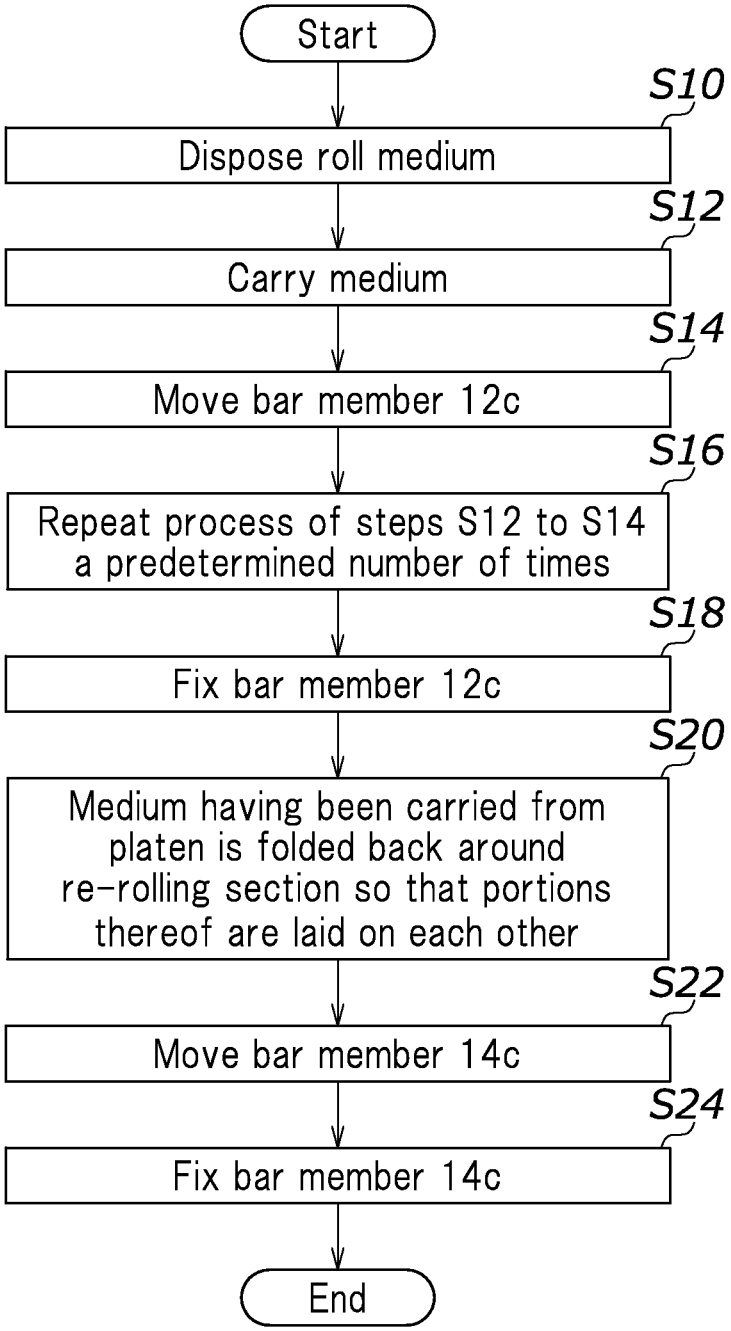
FIG. 8 is a flow chart showing a procedure of a process of correcting a carrying path of a medium.

The process of correcting the carrying path of the medium 300 will now be described with reference to the flow chart of FIG. 8.

First, in step S10, the roll medium RM is disposed in the roll medium accommodating section 108.

In step S12, the medium 300 unrolled from the roll medium RM is sandwiched between the grid rolls 124 and the pinch rolls 126. Then, the medium 300 is carried by a predetermined amount (e.g., 500 mm) by the grid rolls 124. Note that in step S12, the medium 300 is carried while the bar member 12*c* is in the first initial position.

Now, if the center axis RO of the roll medium RM disposed in the roll medium accommodating section 108 is not parallel to the X axis, there is a gap between the medium 300 and the bar member 12*c*.

Figure 9A:
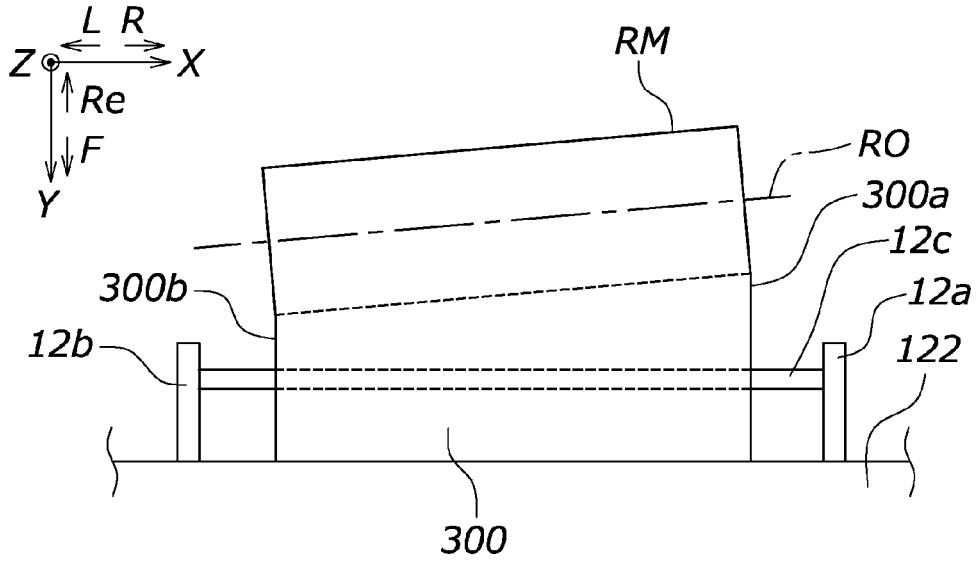
FIG. 9A is a diagram showing the medium from the roll medium to the platen where the center axis of the roll medium is not parallel to the X axis.

For example, if the center axis RO of the roll medium RM is inclined with respect to the X axis as shown in FIG. 9A, there is no gap between the right side edge 300*a* of the medium 300 and the bar member 12*c* while there is a gap between the left side edge 300*b* of the medium 300 and the bar member 12*c*. In such a case, the medium 300 is carried askew in a forward-rightward diagonal direction.

Figure 9B:
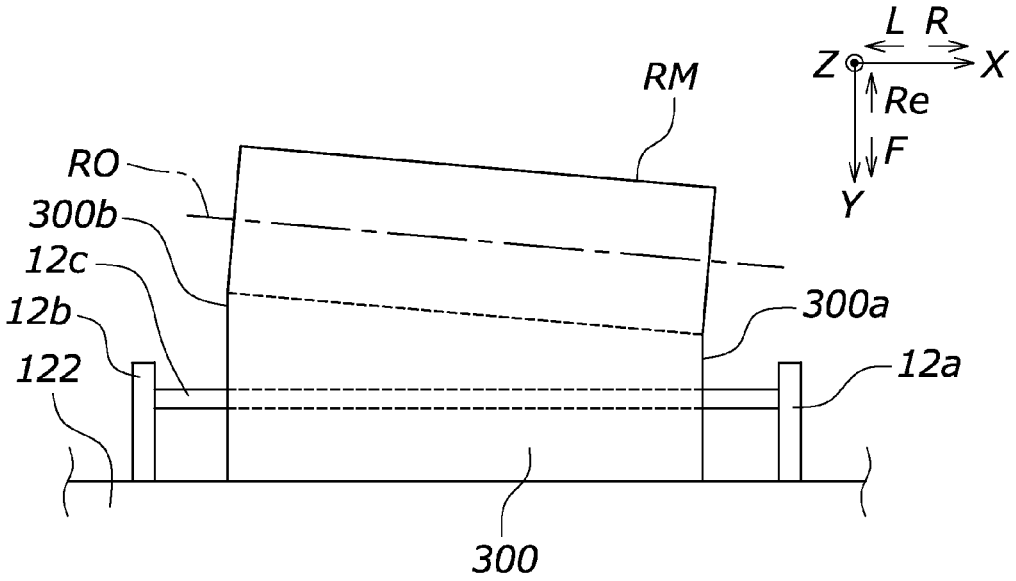
FIG. 9B is a diagram showing the medium from the roll medium to the platen where the center axis of the roll medium is not parallel to the X axis.

For example, if the center axis RO of the roll medium RM is inclined with respect to the X axis as shown in FIG. 9B, there is a gap between the right side edge 300*a* of the medium 300 and the bar member 12*c* while there is no gap between the left side edge 300*b* of the medium 300 and the bar member 12*c*. In such a case, the medium 300 is carried askew in a forward-leftward diagonal direction.

In step S14, if there is a gap between the medium 300 and the bar member 12*c*, the bar member 12*c* is moved by adjusting the positions of the movable portions 18 of the support shaft 12*a* and the support shaft 12*b* so that there is no longer a gap between the right side edge 300*a* or the left side edge 300*b* of the medium 300 and the bar member 12*c*. That is, the carrying path of the medium 300 is changed by moving the bar member 12*c*.

For example, in the case of FIG. 9A, the movable portion 18 of the support shaft 12*a* is moved in the direction of arrow D of FIG. 4 and the movable portion 18 of the support shaft 12*b* is moved in the direction of arrow B of FIG. 4. Then, the movable portion 18 of the support shaft 12*a* and the movable portion 18 of the support shaft 12*b* are temporarily fixed there by the screws 24. Note that only the movable portion 18 of the support shaft 12*a* may be moved in the direction of arrow D of FIG. 4, or only the movable portion 18 of the support shaft 12*b* may be moved in the direction of arrow B of FIG. 4.

For example, in the case of FIG. 9B, the movable portion 18 of the support shaft 12*a* is moved in the direction of arrow B of FIG. 4, and the movable portion 18 of the support shaft 12*b* is moved in the direction of arrow D of FIG. 4. Then, the movable portion 18 of the support shaft 12*a* and the movable portion 18 of the support shaft 12*b* are temporarily fixed there by the screws 24. Note that only the movable portion 18 of the support shaft 12*a* may be moved in the direction of arrow B of FIG. 4, or only the movable portion 18 of the support shaft 12*b* may be moved in the direction of arrow D of FIG. 4.

In step S16, the process of steps S12 to S14 is repeated a plurality of times (e.g., three times) until there is no longer a gap between the bar member 12*c* and the medium 300.

In step S18, the movable portion 18 of the support shaft 12*a* and the movable portion 18 of the support shaft 12*b* are fixed by the screws 24. Thus, the bar member 12*c* is fixed.

Figure 10:
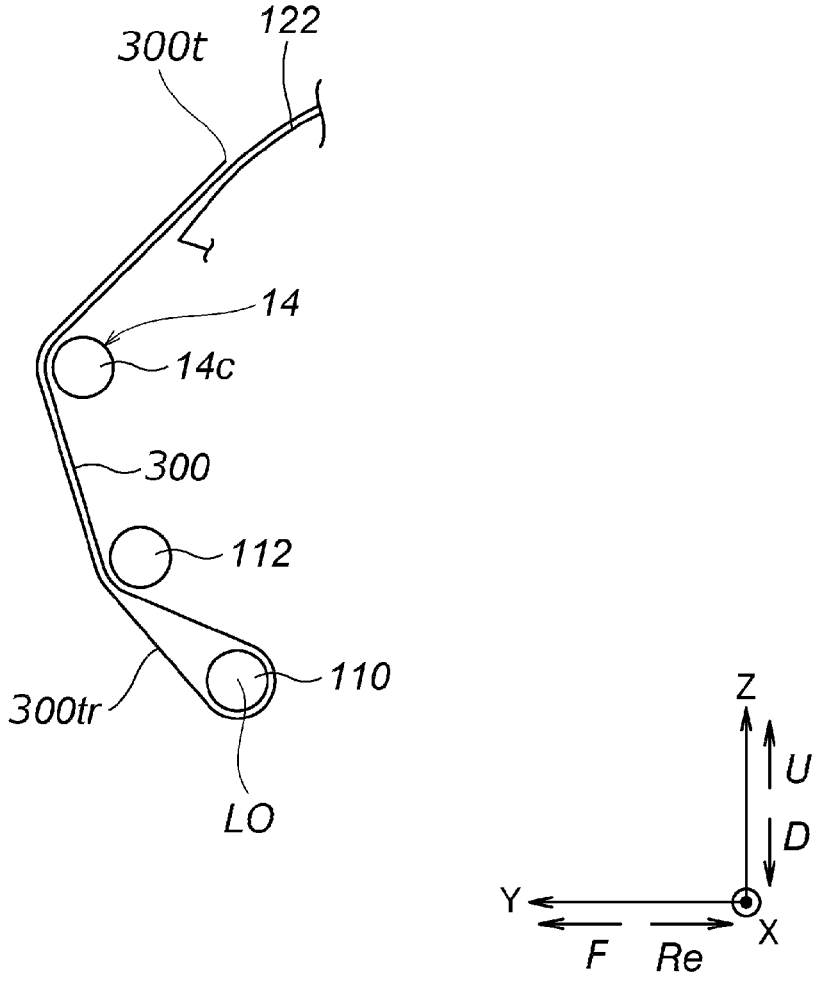
FIG. 10 is a diagram showing a state where the medium is folded back around the re-rolling section.

In step S20, the medium 300 having been carried from the platen 122 is folded back around the re-rolling section 110 so that portions of the medium 300 are laid on each other. That is, as shown in FIG. 10, the medium 300 having been carried via the second bar-shaped member 14 is folded back around the re-rolling section 110 so that a folded-back medium 300*tr* is laid on the unfolded portion of the medium 300. A tip 300*t* of the medium 300 is disposed on the platen 122. At this point, the medium 300 and the medium 300*tr* are under a predetermined tension by the dancer roller 112. Note that in step S20, the medium 300 is carried while the bar member 14*c* is in the second initial position.

If the re-rolling section 110 is not parallel to the X axis, the medium 300 is not completely aligned with the folded-back medium 300*tr*.

Figure 11A:
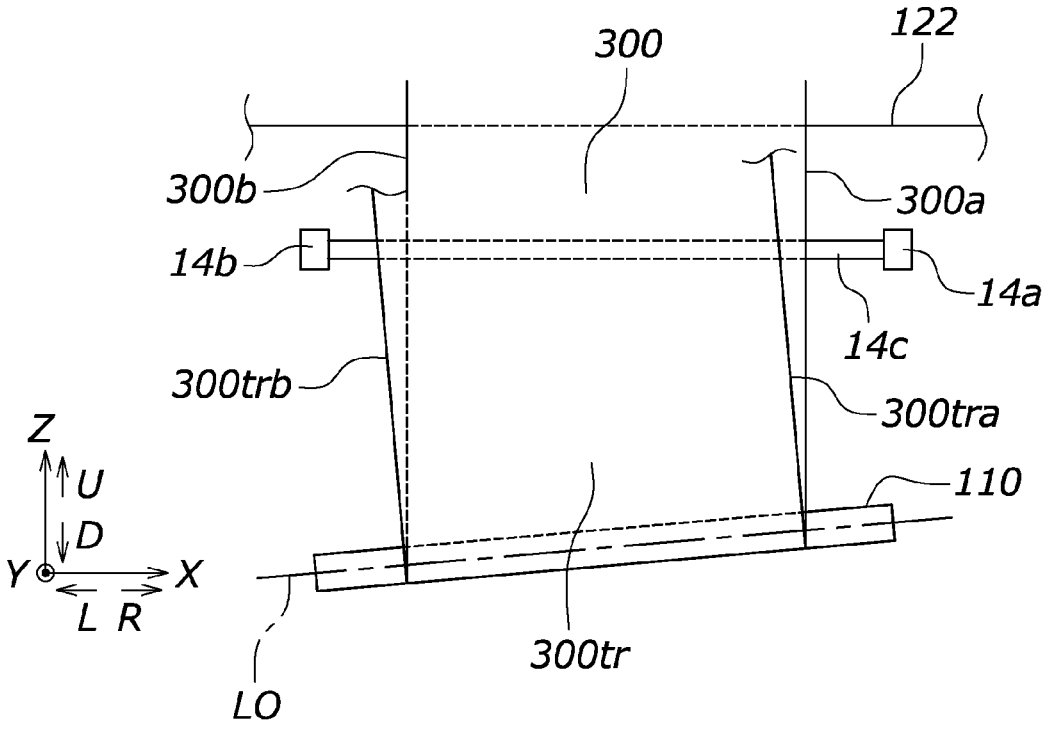
FIG. 11A is a diagram showing a state where the medium is folded back around the re-rolling section where the re-rolling section is not parallel to the X axis.

For example, the center axis LO of the re-rolling section 110 is inclined with respect to the X axis as shown in FIG. 11A, there is a gap between the right side edge 300*a* of the medium 300 and the bar member 12*c* while there is no gap between the left side edge 300*b* of the medium 300 and the bar member 12*c*. The right side edge 300*a* and the left side edge 300*b* of the unfolded portion of the medium 300 are not aligned with a right side edge 300*tra* and a left side edge 300*trb*, respectively, of the folded-back medium 300*tr*. The edge 300*tra* is located to the left of the edge 300*a* while the edge 300*trb* is located to the left of the edge 300*b*. That is, the medium 300 is carried around the re-rolling section 110 while running askew in a forward-leftward diagonal direction.

Figure 11B:
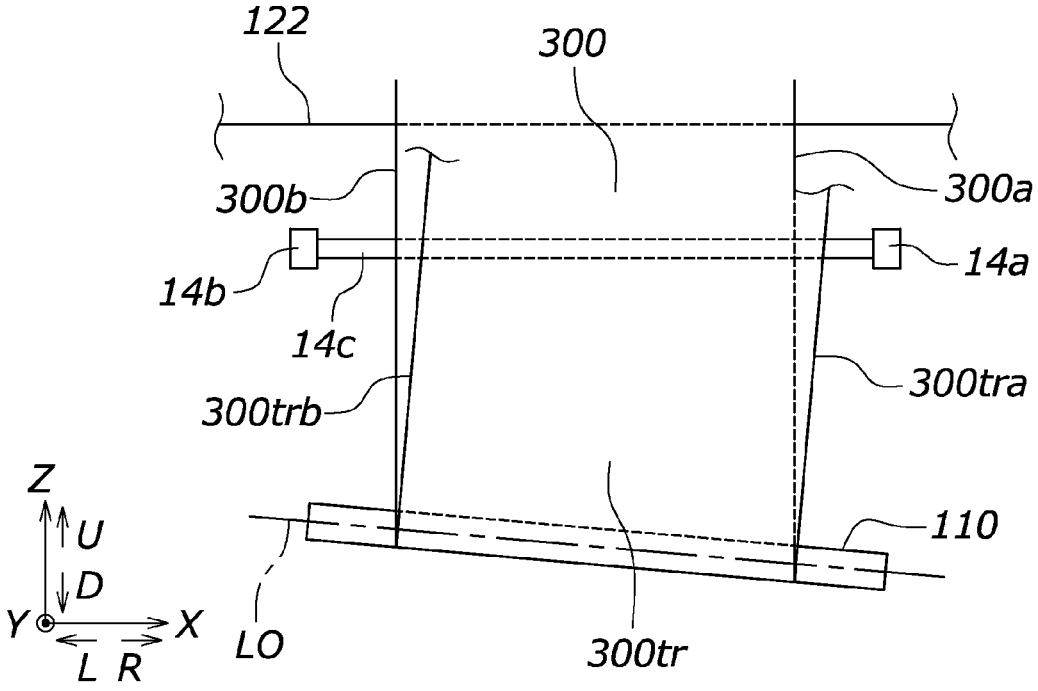
FIG. 11B is a diagram showing a state where the medium is folded back around the re-rolling section where the re-rolling section is not parallel to the X axis.

For example, as shown in FIG. 11B, if the center axis LO of the re-rolling section 110 is inclined with respect to the X axis, there is no gap between the right side edge 300*a* of the medium 300 and the bar member 12*c* while there is a gap between the left side edge 300*b* of the medium 300 and the bar member 12*c*. Moreover, the right side edge 300*a* and the left side edge 300*b* of the unfolded portion of the medium 300 are not aligned with the right side edge 300*tra* and the left side edge 300*trb* of the folded-back medium 300*tr*. The edge 300*tra* is located to the right of the edge 300*a* while the edge 300*trb* is located to the right of the edge 300*b*. That is, the medium 300 is carried around the re-rolling section 110 while running askew in a forward-rightward diagonal direction.

In step S22, if the unfolded portion of the medium 300 and the folded-back medium 300*tr* are not aligned with each other, the bar member 14*c* is moved after adjusting the positions of the movable portions 38 of the support shaft 14*a* and the support shaft 14*b* so that the edge 300*a* and the edge 300*tra* are aligned with each other with no left-right misalignment and the edge 300*b* and the edge 300*trb* are aligned with each other with no left-right misalignment. That is, the carrying path of the medium 300 is changed by moving the bar member 14*c*.

For example, in the case of FIG. 11A, the movable portion 38 of the support shaft 14*a* is moved in the direction of arrow F of FIG. 6 and the movable portion 38 of the support shaft 14*b* is moved in the direction of arrow H of FIG. 6. Then, the movable portion 38 of the support shaft 14*a* and the movable portion 38 of the support shaft 14*b* are temporarily fixed there by the screws 44. Note that only the movable portion 38 of the support shaft 14*a* may be moved in the direction of arrow F of FIG. 6, or only the movable portion 38 of the support shaft 14*b* may be moved in the direction of arrow H of FIG. 6.

For example, in the case of FIG. 11B, the movable portion 38 of the support shaft 14*a* is moved in the direction of arrow H of FIG. 6, and the movable portion 38 of the support shaft 14*b* is moved in the direction of arrow F of FIG. 6. Then, the movable portion 38 of the support shaft 14*a* and the movable portion 38 of the support shaft 14*b* are temporarily fixed there by the screws 44. Note that only the movable portion 38 of the support shaft 14*a* may be moved in the direction of arrow H of FIG. 6, or only the movable portion 38 of the support shaft 14*b* may be moved in the direction of arrow F of FIG. 6.

In step S24, the movable portion 38 of the support shaft 14*a* and the movable portion 38 of the support shaft 14*b* are fixed by the screws 44. Thus, the bar member 14*c* is fixed.

With the inkjet printer 100 having the carrier device 115 of the present preferred embodiment, the bar member 12*c* contacting the medium 300 being carried so as to press the medium 300 can be fixed inclined with respect to the center axis RO of the roll medium RM, and the bar member 14*c* configured to press the medium 300 is capable of being fixed inclined with respect to the center axis LO of the re-rolling section 110. Thus, the length of the right side edge 300*a* and the length of the left side edge 300*b* of the medium 300 can be made equal to each other by changing the carrying path of the medium 300 located within the extent from the roll medium RM to the re-rolling section 110. Therefore, even if the center axis of the roll medium RM is not parallel to the X axis or the re-rolling section 110 is not disposed parallel to the X axis due to how the carrier device 115 is arranged, component precision errors in various components, and the like, it is possible to rectify the medium 300 running askew, and it is possible to re-roll the medium 300 on the re-rolling section 110 without the medium 300 running askew.

Second Preferred Embodiment

Figure 12:
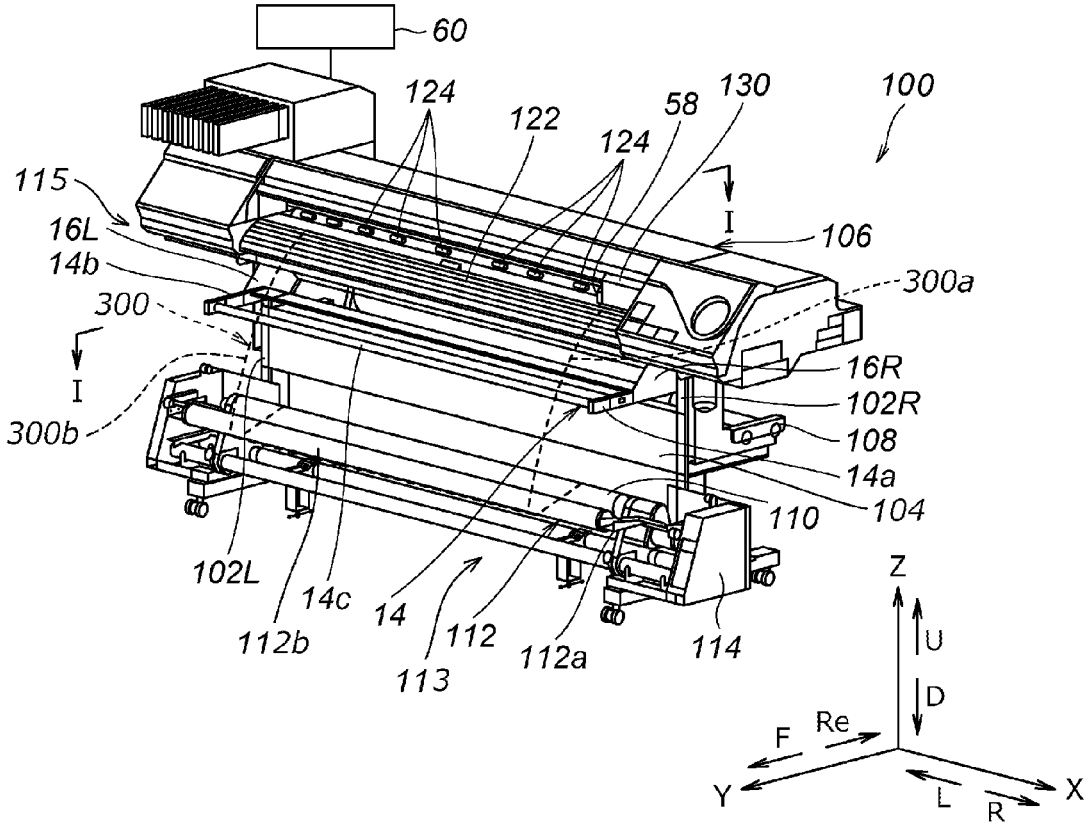
FIG. 12 is a front perspective view showing a schematic configuration of an inkjet printer according to another preferred embodiment of the present invention.

As shown in FIG. 12, the inkjet printer 100 preferably further includes a sensor 58. The sensor 58 is provided on the left side surface of the ink head 130. The sensor 58 moves together with the ink head 130 in the X axis direction. When the sensor 58 moves in the X axis direction together with the movement of the ink head 130, the sensor 58 obtains the X coordinate value of one end in the X axis direction (primary scanning direction) of the medium 300 located on the platen 122. Note that the sensor 58 may be provided on the right side surface of the ink head 130.

Figure 13:
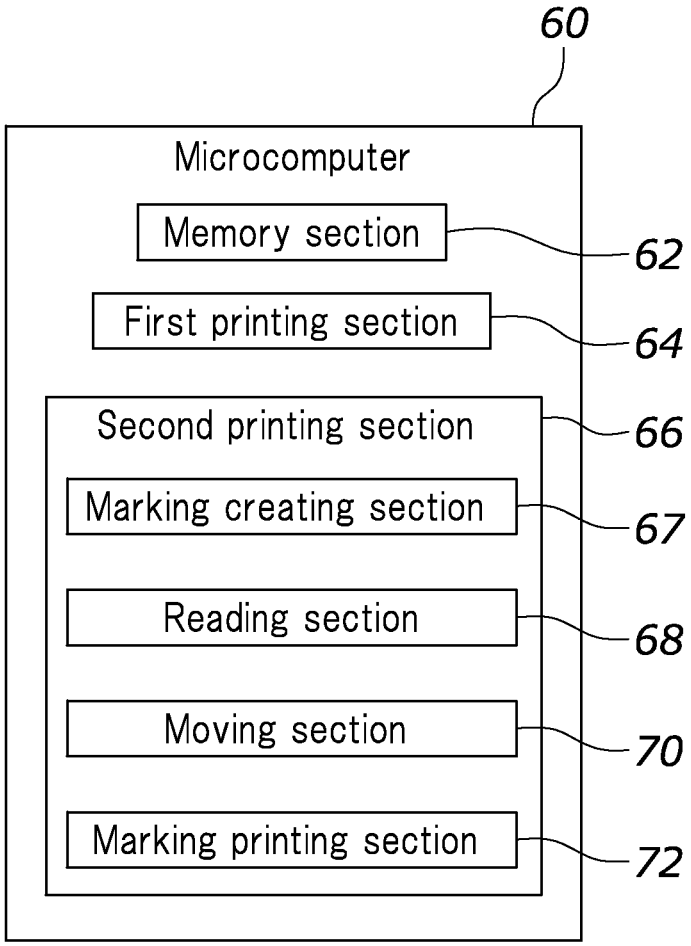
FIG. 13 is a block diagram of a microcomputer according to a preferred embodiment of the present invention.

As shown in FIG. 13, the microcomputer 60 includes a memory section 62 configured to store various data, such as data of a printed image received, a first printing section 64 configured to perform a predetermined printing operation on the medium 300 based on the data of a printed image, and a second printing section 66 configured to print marks to adjust the medium 300 by using preset values stored in the memory section 62.

The memory section 62 is configured to store various data such as data of a printed image and data used to print an adjustment marking. The data of a printed image is output to the first printing section 64. Data used to print the adjustment marking is output to the second printing section 66.

Based on the data of a printed image stored in the memory section 62, the first printing section 64 is configured to control the ink head 130, the grid rolls 124 and the re-rolling section 110 so as to perform a predetermined printing operation on the medium 300.

The second printing section 66 includes a marking creating section 67, a reading section 68, a moving section 70, and a marking printing section 72. The marking creating section 67 is configured to create markings to adjust the medium 300. The reading section 68 is configured to read one edge of the medium 300 in the primary scanning direction. The moving section 70 is configured to control the carrying section 127 so as to carry the medium 300 by a predetermined amount. The marking printing section 72 is configured to control the ink head 130 so as to print markings having been created by the marking creating section 67 so that each marking is centered at a central position that is a predetermined distance away in the X axis direction (primary scanning direction) from the edge of the medium 300 read by the reading section 68.

The marking creating section 67 is configured to create a reference marking $S_0$ and adjustment markings $S_1$ and $S_2$ to be printed on the medium 300. The reference marking $S_0$ and the adjustment markings $S_1$ and $S_2$ having been created are stored in the memory section 62. The reference marking $S_0$ is commonly used both when printing the adjustment marking $S_1$ and when printing the adjustment marking $S_2$.

Figure 14A:
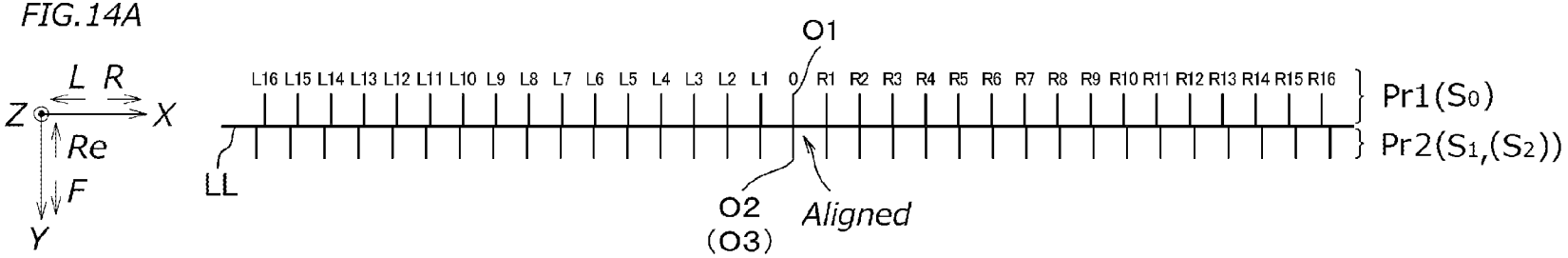
FIG. 14A is a diagram showing a reference marking and an adjustment marking.
Figure 14B:
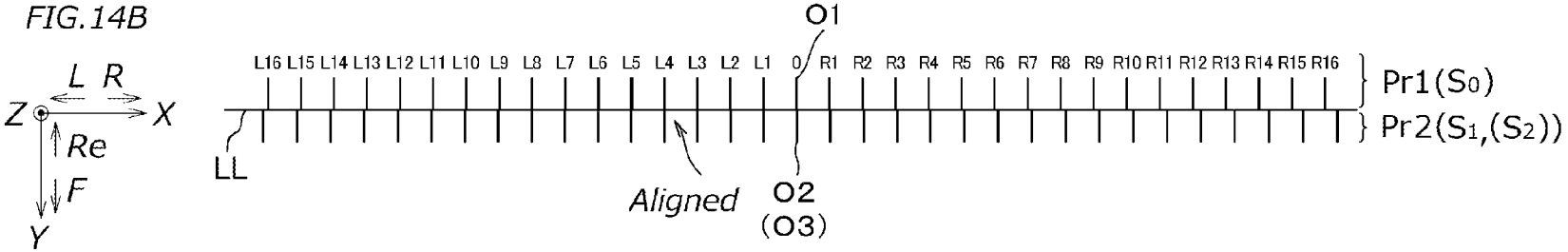
FIG. 14B is a diagram showing a reference marking and an adjustment marking.
Figure 14C:
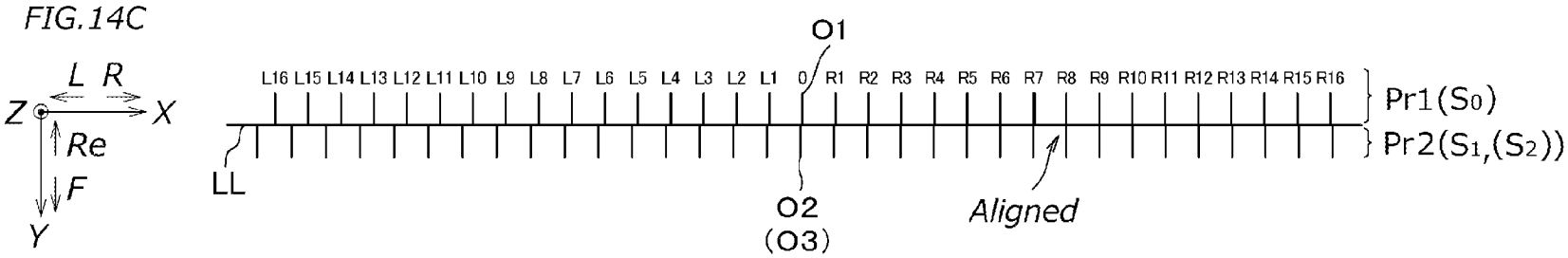
FIG. 14C is a diagram showing a reference marking and an adjustment marking.

As shown in FIGS. 14A to 14C, the reference marking $S_0$ includes a line LL extending in the X axis direction (primary scanning direction), and a plurality of marks extending rearward from the line LL. The reference marking $S_0$ includes the same number of marks on the left side and on the right side of the central position O1. Each mark of the reference marking $S_0$ is labeled, on the rear side, with a letter representing the left or right side, accompanied by a number sequentially assigned starting from the central position O1. The central position O1 is labeled "0".

Each mark located to the left of the central position O1 is labeled "Ln" of which "L" means the left side of the central position O1 and the number "n" indicates that it is the $n^{th}$ mark (n is a positive integer) to the left of the central position O1. For example, a mark next to the central position O1 on the left side is labeled "L1" of which "L" means the left side of the central position O1 and "1" indicates that it is the $1^{st}$ mark to the left of the central position O1.

Each mark located to the right of the central position O1 is labeled "Rn" of which "R" means the right side of the central position O1 and the number "n" indicates that it is the $n^{th}$ mark (n is a positive integer) to the right of the central position O1. For example, a mark next to the central position O1 on the right side is labeled "R1" of which "R" means the right side of the central position O1 and "1" indicates that it is the $1^{st}$ mark to the right of the central position O1.

The adjustment marking $S_1$ is a marking used to adjust the first bar-shaped member 12. The adjustment marking $S_1$ is a marking to adjust the inclination angle of the bar member 12*c* with respect to the X axis. That is, the adjustment marking $S_1$ is a marking used to adjust the inclination angle of the bar member 12*c* with respect to the center axis RO of the roll medium RM. As shown in FIG. 14A, the adjustment marking $S_1$ includes a plurality of marks extending forward from the line LL of the reference marking $S_0$. The adjustment marking $S_1$ includes the same number of marks on the left side and on the right side of the central position O2.

The adjustment marking $S_2$ is an adjustment marking used to adjust the second bar-shaped member 14. The adjustment marking $S_2$ is a marking to adjust the inclination angle of the bar member 14*c* with respect to the X axis. That is, the adjustment marking $S_2$ is a marking to adjust the inclination angle of the bar member 14*c* with respect to the center axis LO of the re-rolling section 110. As shown in FIG. 14A, the adjustment marking $S_2$ includes a plurality of marks extending forward from the line LL of the reference marking $S_0$. The adjustment marking $S_2$ includes the same number of marks on the left side and on the right side of the central position O3.

Note that the number of marks of the reference marking $S_0$ and those of the adjustment markings $S_1$ and $S_2$ are determined based on the number of turns the screws 22 and 42 can be turned.

For example, the number of marks is determined as follows in a case where the pins 26 inserted through the elongated holes 18*ea* of the movable portions 18 securing the opposite ends of the bar member 12*c* are each located at one end of the elongated hole 18*ea* in the longitudinal direction, and the pins 46 inserted through the elongated holes 38*ea* of the movable portions 38 securing the opposite ends of the bar member 14*c* are each located at one end of the elongated hole 38*ea* in the longitudinal direction.

For example, if the screws 22 and 42 of the support shafts 12*a*, 12*b*, 14*a* and 14*b* can each be turned 19.8 turns, the number of turns that can be guaranteed is determined to be 16, taking into consideration the tolerances of parts, the assembly thereof, etc. This number of turns "16" is used as the number of marks of each of the reference marking $S_0$ and the adjustment markings $S_1$ and $S_2$ on the left side and on the right side.

As shown in FIG. 14A, the reference marking $S_0$ includes 16 marks (L1 to L16) created on the left side and 16 marks (R1 to R16) created on the right side of the central position O1. The adjustment marking $S_1$, $S_2$ includes 16 marks created on the left side and 16 marks created on the right side of the central position O2, O3, respectively.

Note that the number of turns can be different between the screws 22 of the support shaft 12*a* and 12*b* and the screws 42 of the support shafts 14*a* and 14*b*, and the number of marks of the reference marking $S_0$ is set to be equal to the larger one of the number of marks of the adjustment marking $S_1$ and the number of marks of the adjustment marking $S_2$.

That is, if the number of turns that the screws 22 of the support shaft 12*a* and 12*b* can be turned is 22.8, for example, while the number of turns the screws 42 of the support shafts 14*a* and 14*b* can be turned is 28.6, for example, the number of turns that can be guaranteed is determined to be "19" for the screws 22 and "25" for the screws 42. The number of turns "19" is used as the number of marks of the adjustment marking $S_1$ on the left side and on the right side, and the number of turns "25" is used as the number of marks of the adjustment marking $S_2$ on the left side and on the right side. For the reference marking $S_0$, the number of marks on the left side and on the right side is set to "25", which is equal to the number of marks of the adjustment marking $S_2$ which includes more marks.

For example, where the bar member 12*c* is in the first initial position and the bar member 14*c* is in the first initial position, the number of marks is determined as follows.

For example, if the screws 22 and 42 of the support shafts 12*a*, 12*b*, 14*a* and 14*b* can each be turned 22.8 turns, the number of turns that can be guaranteed is determined to be 19, taking into consideration the tolerances of components, the assembly thereof, etc. One half of this number of turns "19" is used as the number of marks of the reference marking $S_0$ and the adjustment marking $S_1$, $S_2$ on the left side and on the right side. When the number of turns is an odd number, a calculated value obtained by rounding up the decimal point is regarded as one half of the number of turns.

The reference marking $S_0$ includes 10 marks (L1 to L10) created on the left side and 10 marks (R1 to R10) created on the right side of the central position O1. The adjustment marking $S_1$, $S_2$ includes 10 marks created on the left side and 10 marks created on the right side of the central position O2, O3, respectively.

The reference marking $S_0$ is created based on the reference pitch. The adjustment marking $S_1$ is created based on the first adjustment pitch. The adjustment marking $S_2$ is created based on the second adjustment pitch. The reference pitch, the first adjustment pitch and the second adjustment pitch are input by the operator.

The reference pitch is a value representing the interval between adjacent marks of the reference marking $S_0$. This value is determined based on the resolution and the printing width of the inkjet printer 100, the number of marks of the reference marking $S_0$, etc.

Specifically, a rough value between adjacent marks of the reference marking $S_0$ is obtained based on the printing width, which is obtained based on the length of the medium 300 in the primary scanning direction, and the number of marks of the reference marking $S_0$, which has been determined. That is, the rough value between marks is obtained by dividing the printing width by the number of marks. The obtained value is fitted to the resolution of the inkjet printer 100, thus obtaining the reference pitch. That is, if the obtained value does not fit the resolution, the obtained value is adjusted to a nearest value that fits the resolution, and the adjusted value is used as the reference pitch.

The first adjustment pitch is a value representing the interval between marks of the adjustment marking $S_1$. This value is the reference pitch plus the amount of shift in the print result to be introduced by one turn of the screw 22. The amount of shift in the print result to be introduced by one turn of the screw 22 is calculated by a CAD system in advance. For example, if the reference pitch is 9.984 mm and the amount of shift in the print result to be introduced by one turn of the screw 22 is 0.07258 mm, the first adjustment pitch is 10.056 mm (the value is rounded down to the same decimal place as the reference pitch). Note that one turn of the screw 22 is also referred to as a "one-step adjustment" of the screw.

The second adjustment pitch is a value representing the interval between marks of the adjustment marking $S_2$. This value is the reference pitch plus the amount of shift in the print result to be introduced by one turn of the screw 42. The amount of shift in the print result to be introduced by one turn of the screw 42 is calculated by a CAD system in advance. For example, if the reference pitch is 9.984 mm and the amount of shift in the print result to be introduced by one turn of the screw 42 is 0.03382 mm, the second adjustment pitch is 10.017 mm (the value is rounded down to the same decimal place as the reference pitch). Note that one turn of the screw 42 is also referred to as a "one-step adjustment" of the screw.

The reference pitch and the first adjustment pitch are different from each other. Therefore, the reference marking $S_0$ and the adjustment marking $S_1$ align with each other for every common multiple between the reference pitch and the first adjustment pitch. Therefore, the reference pitch and the first adjustment pitch are determined so that the least common multiple therebetween is not integrally divisible or so that the markings will not align with each other within the number of marks of the reference marking $S_0$.

Specifically, where the number of marks is 19 on the left side and on the right side, the reference pitch is 9.984 mm, and the first adjustment pitch is 10.06 mm, the least common multiple is 100.44 mm. That is, the reference marking $S_0$ and the adjustment marking $S_1$ align with each other at a position of 100.44 mm from the central position O1. Note that 100.44 mm is not integrally divisible by either the reference pitch or the first adjustment pitch. Therefore, there will not be an alignment because no mark is created at such a position.

Even though the $131^{st}$ mark on the left side (or on the right side) of the reference marking $S_0$ would align with the $130^{th}$ mark on the left side (or on the right side) of the adjustment marking $S_1$, this is beyond the number of marks (19) to be printed on the left side and on the right side.

Note that a plurality of marks may sometimes appear to be coinciding due to bleeding after printing, or the like. In such a case, the intermediate value between numbers assigned to the marks of the reference marking $S_0$ is used. Specifically, when marks of the reference marking $S_0$ labeled "L3" and "L4" appear to align with marks of the adjustment marking $S_1$, it is taken to mean 3.5 turns of the screw located on the left side. Note that while the relationship between the reference pitch and the first adjustment pitch has been described above, the description similarly applies to the relationship between the reference pitch and the second adjustment pitch.

Figure 15A:
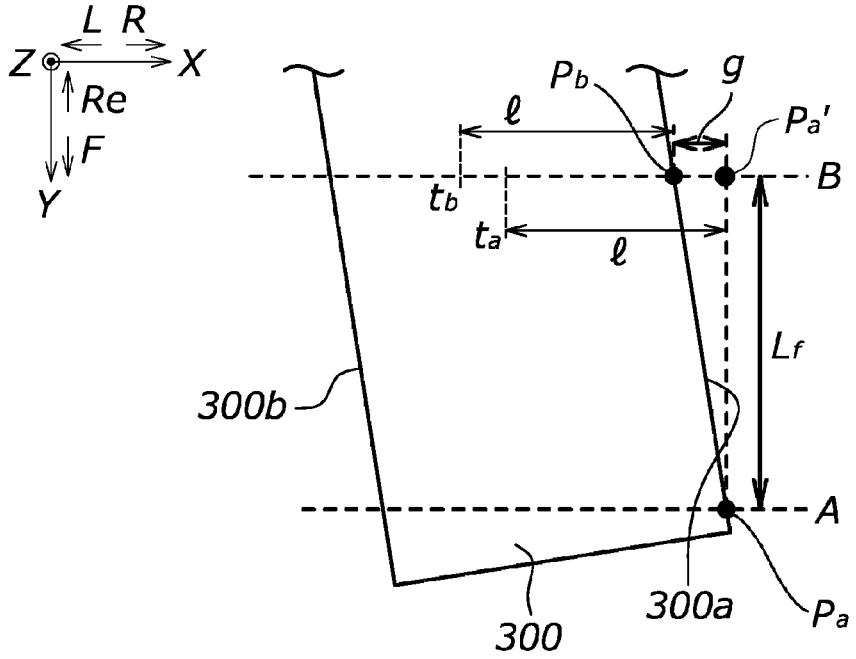
FIG. 15A is a diagram showing a concept of a printing method by an adjustment marking printing process.

The reading section 68 is configured to control the sensor 58 to read the right side edge (e.g., the X coordinate value of the edge) of the medium 300 in the primary scanning direction. As shown in FIG. 15A, the reading section 68 is configured to read the right side edge Pa of the medium 300 at a predetermined position A. The reading section 68 is configured to read the right side edge Pb of the medium 300 at the position B to be reached after the medium 300 is carried from the predetermined position A by a predetermined amount $L_f$.

Specifically, at the predetermined position A and at the position B to be reached after the medium 300 is carried by the moving section 70, the right side edge Pa, $P_b$ of the medium 300 is read by the sensor 58 provided on the left side surface of the ink head 130 as the ink head 130 moves in the X axis direction above the medium 300 located on the platen 122. Note that the reading section 68 may be configured to read the left side edge of the medium 300 in the primary scanning direction at the predetermined position A and at the position B to be reached after the medium 300 is carried by the carrying section 127.

If the medium 300 is not running askew, the position in the primary scanning direction of the right side edge Pa of the medium 300 at the position A aligns with that of the right side edge Pb of the medium 300 at the position B. On the other hand, if the medium 300 is running askew as shown in FIG. 15A, there is an amount of shift between the position in the primary scanning direction of the right side edge Pa at the position A and that of the right side edge Pb of the medium 300 at the position B.

The skew angle when there is a shift between the right side edge Pa and the right side edge Pb, i.e., when the medium 300 is running askew, is represented by Expression (1) below.

$$\text{Skew Angle} \approx \text{atan}(P_a - P_b)/L_f \quad (1)$$

Figure 15B:
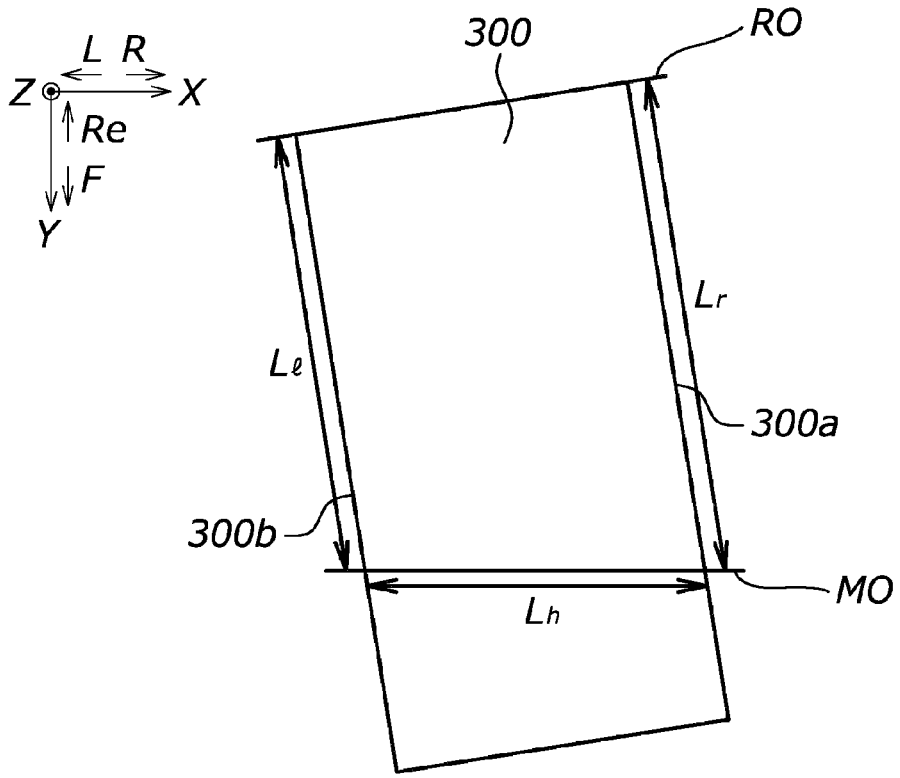
FIG. 15B is a diagram showing a concept of a printing method by an adjustment marking printing process.

$P_a$: X coordinate value of right side edge of medium at position A $P_b$: X coordinate value of right side edge of medium at position B $L_f$: Distance from position A to position B Now, a reason why the medium 300 being carried can run askew is that the length $L_r$ of the right side edge 300*a* of the medium 300 from the center axis RO of the roll medium RM to the carrying axis MO is not equal to the length $L_l$ of the left side edge 300*b* of the medium 300 from the center axis RO of the roll medium RM to the carrying axis MO when the medium 300 unrolled from the roll medium RM is set ready to be carried (see FIG. 15B). The carrying axis MO is an axis that connects together the centers of the grid rolls 124 provided along the primary scanning direction (see FIG. 1).

Using the length $L_r$ of the right side edge 300*a* and the length $L_l$ of the left side edge 300*b*, the skew angle of the medium 300 running askew can be represented by Expression (2) below.

$$\text{Skew Angle} \approx \text{atan}(L_r - L_l)/L_h \quad (2)$$

$L_r$: Length of right side edge of medium from center axis of roll medium to carrying axis $L_l$: Length of left side edge of medium from center axis of roll medium to carrying axis $L_h$: Distance from right side edge to left side edge of medium on carrying axis Based on Expressions (1) and (2) above, the following expression holds true.

$$(P_a - P_b)/L_f \approx (L_r - L_l)/L_h$$

Since $L_f$ and $L_h$ are constants, one can assume $P_a - P_b \sim L_r - L_l$. Thus, it is possible to quantitatively determine the difference between the length $L_r$ of the right side edge 300*a* and the length $L_l$ of the left side edge 300*b* of the medium 300 based on the amount of shift in the print result ($P_a - P_b$).

It is possible to numerically calculate the relationship between the amount by which the screws 22 and 42 of the first bar-shaped member 12 and the second bar-shaped member 14 are adjusted and the lengths $L_r$ and $L_l$ of the left and right edges 300*a* and 300*b* of the medium 300. That is, since it is possible to calculate the amount of change in the lengths $L_r$ and $L_l$ of the left and right edges 300*a* and 300*b* of the medium 300 to be introduced by one turn (a one-step adjustment) of the screws 22 and 42, it is possible to obtain the amount of shift in the print result in the primary scanning direction (the X axis direction) to be introduced by one turn of the screws 22 and 42.

The moving section 70 is configured to control the carrying section 127 so as to carry the medium 300 by a predetermined amount. The carrying amount is such a value that the amount of shift in the print result to be introduced by one turn of the screws 22 and 42 is ensured. That is, the carrying amount is determined so that the amount of shift in the primary scanning direction (the X axis direction) between the right side edge Pa of the medium 300 at the predetermined position A and the right side edge Pb of the medium 300 at the position B to be reached after the medium 300 is carried from the predetermined position A by a predetermined amount is greater than or equal to the amount of shift in the print result to be introduced by one turn of the screws 22 and 42. Specifically, the carrying amount $L_{f1}$ (see FIG. 16) used when adjusting the first bar-shaped member 12 is determined to be greater than or equal to the amount of shift in the print result to be introduced by one turn of the screw 22. The carrying amount $L_{f2}$ (see FIG. 17) used when adjusting the second bar-shaped member 14 is determined to be greater than or equal to the amount of shift in the print result to be introduced by one turn of the screw 42. Note that the carrying amount is preset by the operator and is stored in the memory section 62.

The marking printing section 72 is configured to control the ink head 130 so as to print the adjustment marking $S_1$ on the medium 300. The marking printing section 72 is configured to control the ink head 130 so as to print the adjustment marking $S_2$ on the medium 300.

As shown in FIG. 15A, the reference marking $S_0$ is printed on the medium 300 at the moved position B so as to be centered at a position ta that is a predetermined distance l away from a point $P_a'$ read by the reading section 68, which point $P_a'$ corresponds to the right side edge 300*a* of the medium 300 at the predetermined position A. That is, the reference marking $S_0$ is printed at the moved position B so that the central position O1 of the reference marking $S_0$ is located at the position ta that is a predetermined distance l away from the point $P_a'$, which point $P_a'$ corresponds to the right side edge 300*a* of the medium 300 at the predetermined position A.

As shown in FIG. 15A, the adjustment marking $S_1$ is printed at the moved position B in the vicinity of the reference marking $S_0$ having been printed on the medium 300 so that the adjustment marking $S_1$ is centered at the position tb that is the predetermined distance 1 away from a point Pb, which point Pb corresponds to the right side edge 300*a* of the medium 300 at the position B. That is, the adjustment marking $S_1$ is printed at the moved position B so that the central position O2 of the adjustment marking $S_1$ is printed at a position tb that is the predetermined distance l away from the right side edge 300*a* of the medium 300 at the position B.

As shown in FIG. 15A, the adjustment marking $S_2$ is printed at the moved position B in the vicinity of the reference marking $S_0$ having been printed on the medium 300 so that the adjustment marking $S_2$ is centered at the position tb that is the predetermined distance l away from the point Pb, which point Pb corresponds to the right side edge 300*a* of the medium 300 at the position B. That is, the adjustment marking $S_2$ is printed at the moved position B so that the central position O3 of the adjustment marking $S_2$ is printed at a position tb that is the predetermined distance l away from the right side edge 300*a* of the medium 300 at the position B.

Note that the predetermined distance l is determined based on the number of marks of the reference marking $S_0$, and the interval between adjacent marks (the reference pitch). The predetermined distance l is stored in the memory section 62. For example, if the number of marks of the reference marking $S_0$ on the right side is 19 and the reference pitch is 10 mm, the predetermined distance l needs to be a value greater than 190 mm. Further taking into consideration the medium 300 running askew, the predetermined distance l is determined to be 200 mm, for example.

A non-limiting example of a process of correcting the carrying path of the medium 300 will now be described with reference to the flow chart of FIG. 18.

First, in step S100, the roll medium RM is disposed in the roll medium accommodating section 108.

In step S110, the medium 300 unrolled from the roll medium RM is sandwiched between the grid rolls 124 and the pinch rolls 126 so as to set the medium 300 ready to be carried. That is, the medium 300 is sandwiched between the grid rolls 124 and the pinch rolls 126 while being pushed up by the bar member 12*c*. Note that in step S110, the bar member 12*c* is in the first initial position.

Note that if the center axis RO of the roll medium RM disposed in the roll medium accommodating section 108 is inclined with respect to the X axis when the medium 300 is set ready to be carried, there is a gap between one of the right side edge 300*a* and the left side edge 300*b* of the medium 300 and the bar member 12*c*. In such a case, the medium 300 is carried while running askew.

Figure 19:
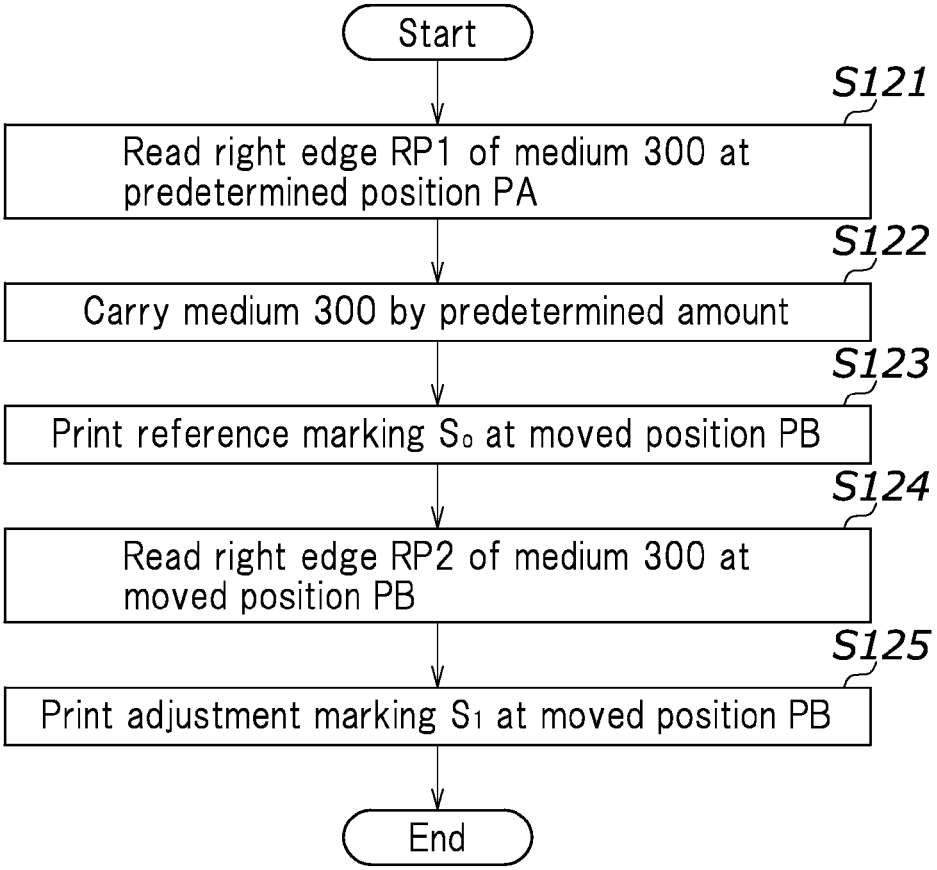
FIG. 19 is a flow chart showing a procedure of the first adjustment marking printing process.

In step S120, the first adjustment marking printing process is performed in order to correct the medium 300 being carried while running askew. The flow chart shown in FIG. 19 shows, in detail, specific operations of the first adjustment marking printing process of step S120.

Figure 16:
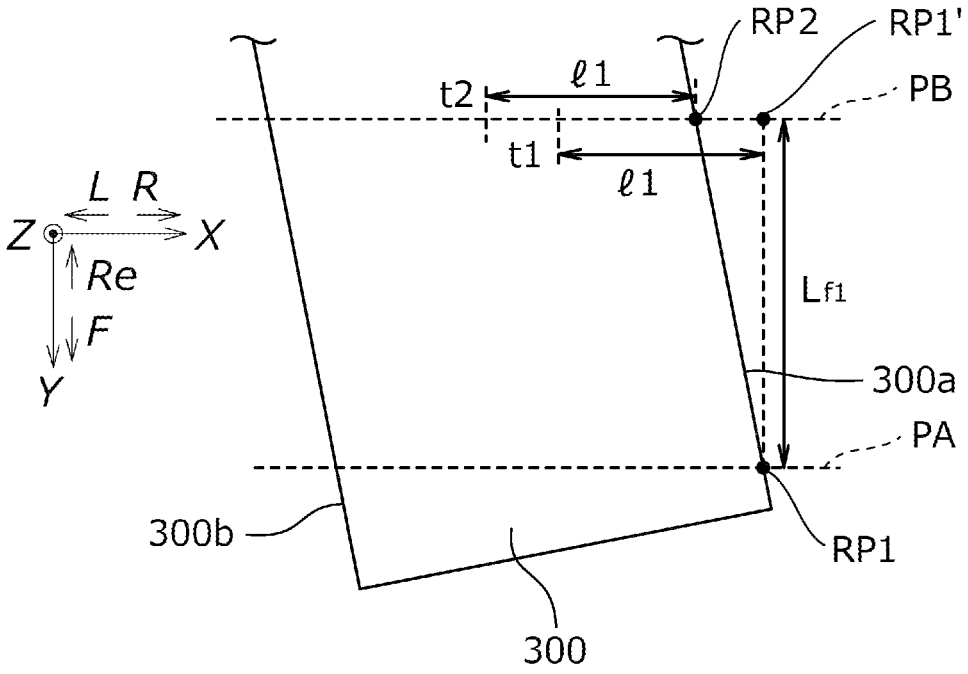
FIG. 16 is a diagram showing the position at which the central position of the reference marking is printed and the position at which the central position of the adjustment marking is printed in the first adjustment marking printing process.

In step S121, the medium 300 is carried by a predetermined amount, and the reading section 68 reads a point RP1 at which the right side edge 300*a* of the medium 300 is located at a predetermined position PA after the medium 300 is carried (see FIG. 16). That is, the reading section 68 reads the X coordinate value of the point RP1 at which the right side edge 300*a* of the medium 300 is located at the predetermined position PA.

In step S122, the medium 300 is carried by a predetermined amount. That is, the moving section 70 carries the medium 300 by the carrying amount $L_{f1}$ stored in advance in the memory section 62.

In step S123, the reference marking $S_0$ is printed at the moved position PB with respect to the X coordinate value of the point RP1 at which the right side edge 300*a* is located at the predetermined position PA. That is, as shown in FIG. 16, the marking printing section 72 prints the reference marking $S_0$ at the moved position PB so that the central position O1 of the reference marking $S_0$ is located at a position t1 that is a predetermined distance l1 away from a point RP1', which point RP1' corresponds to the point RP1 at which the right side edge 300*a* is located at the predetermined position PA.

In step S124, the reading section 68 reads a point RP2 at which the right side edge 300*a* of the medium 300 is located at the moved position PB (see FIG. 16). That is, the reading section 68 reads the X coordinate value of the point PR2 at which the right side edge 300*a* of the medium 300 is located at the moved position PB.

In step S125, the adjustment marking $S_1$ is printed at the moved position PB with respect to the X coordinate value of the point RP2 at which the right side edge 300*a* is located at the moved position PB. That is, as shown in FIG. 16, the marking printing section 72 prints the adjustment marking $S_1$ at the moved position PB so that the central position O2 of the adjustment marking $S_1$ is located at a position t2 that is the predetermined distance l1 away from the point RP2 at which the right side edge 300*a* is located at the moved position PB. After the adjustment marking $S_1$ is printed, the process proceeds to step S130 (see FIG. 18).

In step S130, based on the reference marking $S_0$ and the adjustment marking $S_1$ having been printed, it is determined which one of the screw 22 of the support shaft 12*a* and the screw 22 of the support shaft 12*b* needs to be turned and how much it needs to be turned, and the inclination angle of the bar member 12*c* is adjusted with respect to the center axis RO of the roll medium RM.

Specifically, if the reference marking $S_0$ and the adjustment marking $S_1$ are printed as shown in FIG. 14A, for example, the reference marking $S_0$ and the adjustment marking $S_1$ align with each other at the mark labeled "0" of the reference marking $S_0$, i.e., at the central position O1. Then, the central position O1 of the reference marking $S_0$ aligns with the central position O2 of the adjustment marking $S_1$. Thus, it is determined that the medium 300 is not carried while running askew. That is, it is determined that there is no need to adjust the inclination angle of the bar member 12*c* with respect to the center axis RO of the roll medium RM, and the screws 22 of the support shaft 12*a* and the support shaft 12*b* are not turned.

Specifically, if the reference marking $S_0$ and the adjustment marking $S_1$ are printed as shown in FIG. 14B, for example, the reference marking $S_0$ and the adjustment marking $S_1$ align with each other at the mark labeled "L4" of the reference marking $S_0$. In this case, the central position O1 is not aligned with the central position O2. Therefore, it is determined that the medium 300 is carried while running askew. Then, based on the label "L4", the screw 22 of the support shaft 12*b* is turned four turns to adjust the inclination angle of the bar member 12*c* with respect to the center axis RO of the roll medium RM.

Figure 20A:
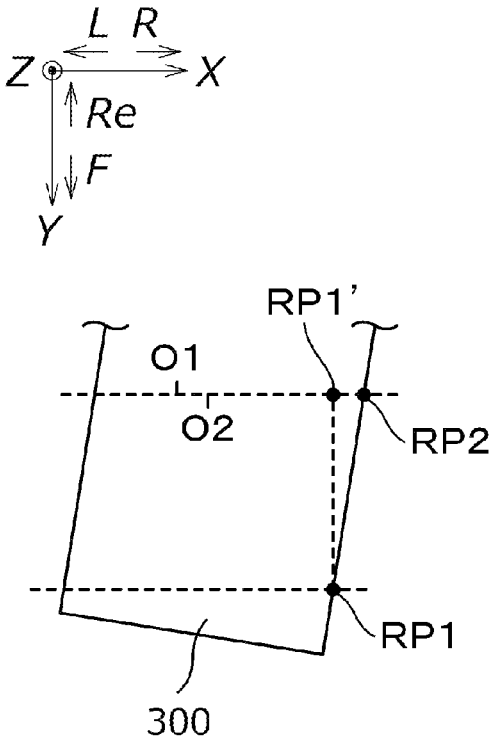
FIG. 20A is a diagram showing the position at which the central position of the reference marking is printed and the position at which the central position of the adjustment marking is printed in the first adjustment marking printing process.

In this case, the central position O1 is located on the left side of the central position O2, as shown in FIG. 20A. Therefore, the medium 300 being carried over the platen 122 is running askew in a forward-leftward diagonal direction. This is because the roll medium RM disposed in the roll medium accommodating section 108 is in such a position as shown in FIG. 9B, for example. Therefore, the bar member 12*c* needs to be brought to such a position that the force by which the one end 12*cx* presses the medium 300 in an upward-rearward diagonal direction is increased (see, for example, FIG. 5C) or such a position that the force by which the other end 12*cy* presses the medium 300 in an upward-rearward diagonal direction is decreased (see, for example, FIG. 5F).

Here, the screw 22 of the support shaft 12*b* is adjusted, thus decreasing the force by which the other end 12*cy* presses the medium 300 in an upward-rearward diagonal direction. That is, the operator turns the screw 22 of the support shaft 12*b* four turns in the direction of arrow C of FIG. 4, thus moving the movable portion 18 in the direction of arrow D of FIG. 4.

Specifically, if the reference marking $S_0$ and the adjustment marking $S_1$ are printed as shown in FIG. 14C, for example, the reference marking $S_0$ and the adjustment marking $S_1$ align with each other at the mark labeled "R8" of the reference marking $S_0$. In this case, the central position O1 is not aligned with the central position O2. Therefore, it is determined that the medium 300 is carried while running askew. Then, based on the label "R8", the screw 22 of the support shaft 12*a* is turned eight turns to adjust the inclination angle of the bar member 12*c* with respect to the center axis RO of the roll medium RM.

Figure 20B:
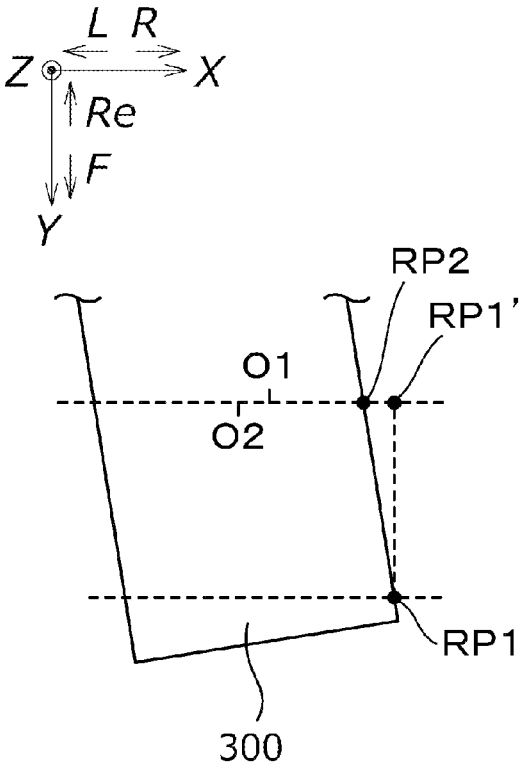
FIG. 20B is a diagram showing the position at which the central position of the reference marking is printed and the position at which the central position of the adjustment marking is printed in the first adjustment marking printing process.

In this case, the central position O1 is located on the right side of the central position O2, as shown in FIG. 20B. Therefore, the medium 300 being carried over the platen 122 is running askew in a forward-rightward diagonal direction. This is because the roll medium RM disposed in the roll medium accommodating section 108 is in such a position as shown in FIG. 9A, for example. Therefore, the bar member 12*c* needs to be brought to such a position that the force by which the other end 12*cy* presses the medium 300 in an upward-rearward diagonal direction is increased (see, for example, FIG. 5E) or such a position that the force by which the one end 12*cx* presses the medium 300 in an upward-rearward diagonal direction is decreased (see, for example, FIG. 5D).

Here, the screw 22 of the support shaft 12*a* is adjusted, thus decreasing the force by which the one end 12*cx* presses the medium 300 in an upward-rearward diagonal direction. That is, the operator turns the screw 22 of the support shaft 12*a* eight turns in the direction of arrow C of FIG. 4, thus moving the movable portion 18 in the direction of arrow D of FIG. 4.

The operator reads the label on a mark of the reference marking $S_0$ that aligns with a mark of the adjustment marking $S_1$, and turns the screw 22 of the support shaft 12*b* if the label contains the letter "L" or the screw 22 of the support shaft 12*a* if the label contains the letter "R". The operator turns the screw 22 of the support shaft 12*a* or the support shaft 12*b* "n" times (n is a positive integer), where "n" is the number on the label. Note that the direction in which the screw 22 of the support shaft 12*a* or the support shaft 12*b* is turned is the direction of arrow C of FIG. 4, which decreases the force by which the one end 12*cx* or the other end 12*cy* of the bar member 12*c* presses the medium 300.

After adjusting the angle of the bar member 12*c* with respect to the X axis, in step S140, the medium 300 is removed from the platen 122, and the roll medium RM is removed from the roll medium accommodating section 108. Then, the roll medium RM is disposed in the re-rolling section 110.

In step S150, the medium 300 unrolled from the roll medium RM disposed in the re-rolling section 110 is sandwiched between the grid rolls 124 and the pinch rolls 126 via the dancer roller 112 and the bar-shaped member 14 so as to set the medium 300 ready to be carried. That is, the medium 300 unrolled from the roll medium RM disposed in the re-rolling section 110 is sandwiched between the grid rolls 124 and the pinch rolls 126 while being pushed out by the bar member 14*c* via the dancer roller 112. At this point, a predetermined length of the medium 300 is present behind the carrying section 127. This predetermined length is greater than the length by which the medium 300 is carried in step S162 to be described below. Note that in step S150, the bar member 14*c* is in the second initial position.

Note that with the medium 300 set ready to be carried in the secondary scanning direction, if the center axis RO of the roll medium RM disposed in the re-rolling section 110 is inclined with respect to the X axis, there is a gap between one of the right side edge 300*a* and the left side edge 300*b* of the medium 300 and the bar member 14*c*. In such a case, the medium 300 is carried while running askew.

Figure 21:
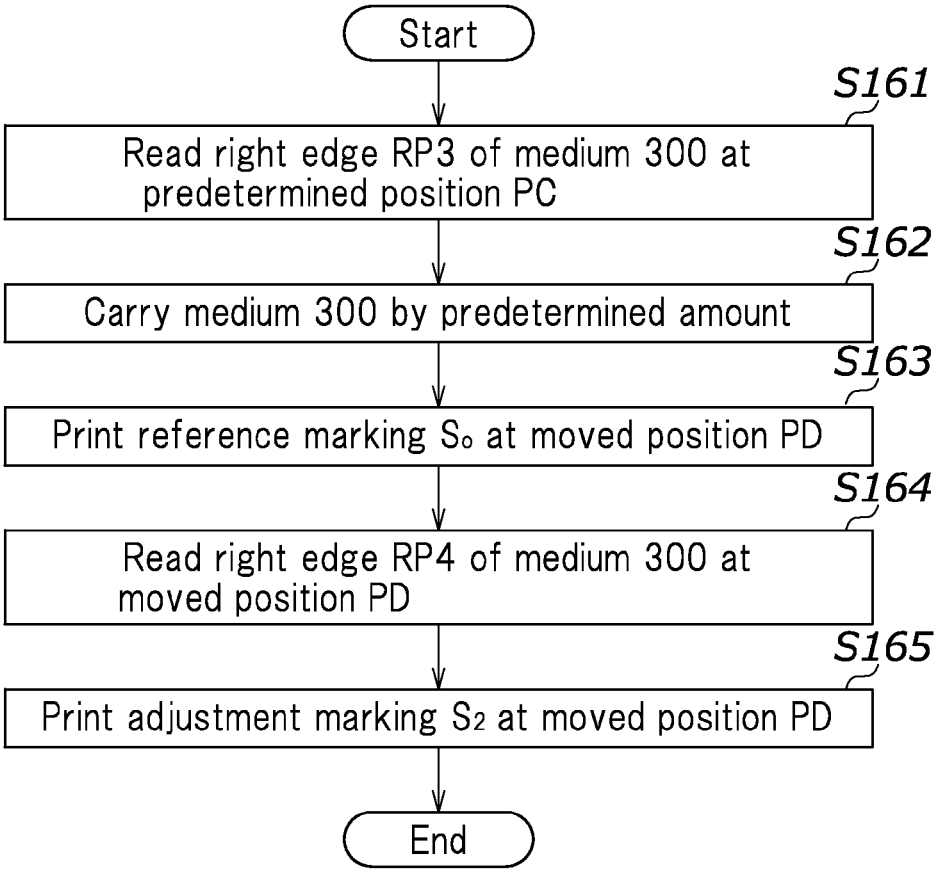
FIG. 21 is a flow chart showing a procedure of the second adjustment marking printing process.

In step S160, the second adjustment marking printing process is performed in order to correct the medium 300 being carried while running askew. The flow chart shown in FIG. 21 shows, in detail, specific operations of the second adjustment marking printing process of step S160.

Figure 17:
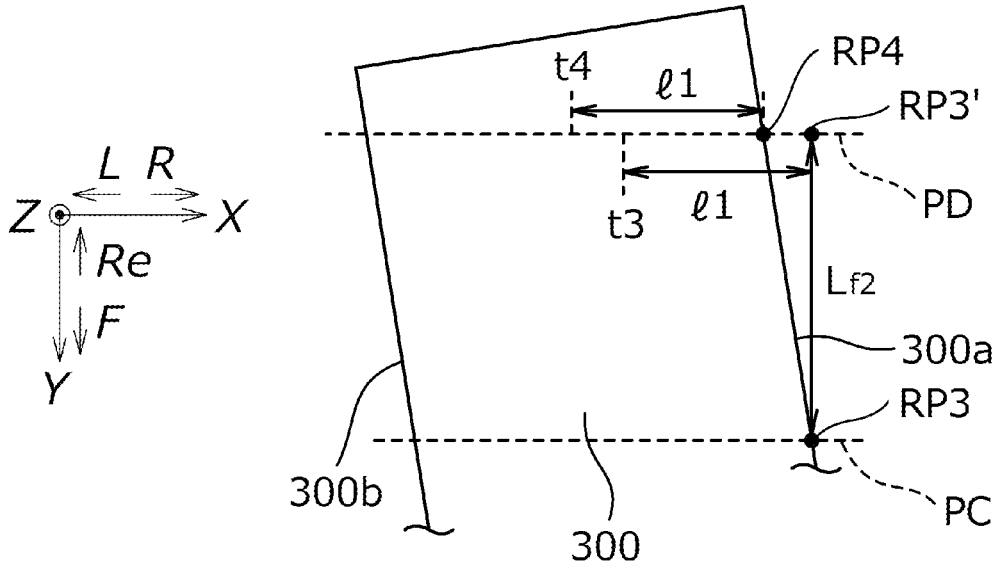
FIG. 17 is a diagram showing the position at which the central position of the reference marking is printed and the position at which the central position of the adjustment marking is printed in the second adjustment marking printing process.

In step S161, the medium 300 is carried by a predetermined amount, and the reading section 68 reads a point RP3 at which the right side edge 300*a* of the medium 300 is located at a predetermined position PC after the medium 300 is carried (see FIG. 17). That is, the reading section 68 reads the X coordinate value of the point RP3 at which the right side edge 300*a* of the medium 300 is located at the predetermined position PC.

In step S162, the medium 300 is carried by a predetermined amount. That is, the moving section 70 carries the medium 300 by the carrying amount $L_{f2}$ stored in advance in the memory section 62.

In step S163, the reference marking $S_0$ is printed at the moved position PD with respect to the X coordinate value of the point RP3 at which the right side edge 300*a* is located at the predetermined position PC. That is, as shown in FIG. 17, the marking printing section 72 prints the reference marking $S_0$ at the moved position PD so that the central position O1 of the reference marking $S_0$ is located at a position t3 that is a predetermined distance l1 away from a point RP3', which point RP3' corresponds to the point RP3 at which the right side edge 300*a* is located at the predetermined position PC.

In step S164, the reading section 68 reads a point RP4 at which the right side edge 300*a* of the medium 300 is located at the moved position PD (see FIG. 17). That is, the reading section 68 reads the X coordinate value of a point PR4 at which the right side edge 300*a* of the medium 300 is located at the moved position PD.

In step S165, the adjustment marking $S_2$ is printed at the moved position PD with respect to the X coordinate value of the point RP4 at which the right side edge 300*a* is located at the moved position PD. That is, as shown in FIG. 17, the marking printing section 72 prints the adjustment marking $S_2$ at the moved position PD so that the central position O3 of the adjustment marking $S_2$ is located at a position t4 that is the predetermined distance l1 away from the point RP4 at which the right side edge 300*a* is located at the moved position PD. After the adjustment marking $S_2$ is printed, the process proceeds to step S170 (see FIG. 18).

In step S170, based on the reference marking $S_0$ and the adjustment marking $S_2$ having been printed, it is determined which one of the screw 42 of the support shaft 14*a* and the screw 42 of the support shaft 14*b* needs to be turned and how much it needs to be turned, and the inclination angle of the bar member 14*c* is adjusted with respect to the center axis LO of the re-rolling section 110.

Specifically, if the reference marking $S_0$ and the adjustment marking $S_2$ are printed as shown in FIG. 14A, for example, the reference marking $S_0$ and the adjustment marking $S_2$ align with each other at the central position O1. Then, the central position O1 aligns with the central position O3. Thus, it is determined that the medium 300 is not carried while running askew.

Specifically, if the reference marking $S_0$ and the adjustment marking $S_2$ are printed as shown in FIG. 14B, for example, the reference marking $S_0$ and the adjustment marking $S_2$ align with each other at the mark labeled "L4" of the reference marking $S_0$. In this case, the central position O1 is not aligned with the central position O3. Therefore, it is determined that the medium 300 is carried while running askew. Then, based on the label "L4", the screw 42 of the support shaft 14*b* is turned four turns to adjust the inclination angle of the bar member 14*c* with respect to the center axis LO of the re-rolling section 110.

Figure 22A:
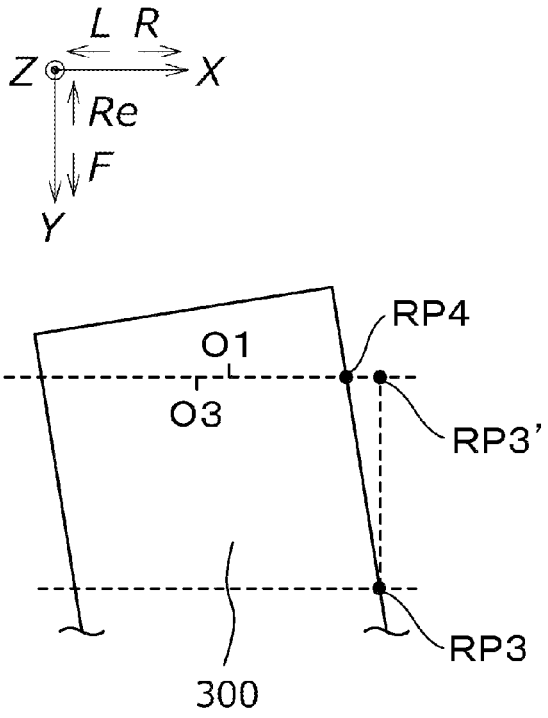
FIG. 22A is a diagram showing the position at which the central position of the reference marking is printed and the position at which the central position of the adjustment marking is printed in the second adjustment marking printing process.

In this case, the central position O1 is located on the right side of the central position O3, as shown in FIG. 22A. Therefore, the medium 300 being carried over the platen 122 is running askew in a forward-rightward diagonal direction. This is because the roll medium RM disposed in the re-rolling section 110 is in such a position as shown in FIG. 11A, for example. Therefore, the bar member 14*c* needs to be brought to such a position that the force by which the one end 14*cx* presses the medium 300 forward is increased (see, for example, FIG. 7C) or such a position that the force by which the other end 14*cy* presses the medium 300 forward is decreased (see, for example, FIG. 7F).

Here, the screw 42 of the support shaft 14*b* is adjusted, thus decreasing the force by which the other end 14*cy* presses the medium 300 forward. That is, the operator turns the screw 42 of the support shaft 14*b* four turns in the direction of arrow G of FIG. 6, thus moving the movable portion 38 in the direction of arrow H of FIG. 6.

Specifically, if the reference marking $S_0$ and the adjustment marking $S_2$ are printed as shown in FIG. 14C, for example, the reference marking $S_0$ and the adjustment marking $S_2$ align with each other at the mark labeled "R8" of the reference marking $S_0$. In this case, the central position O1 is not aligned with the central position O3. Therefore, it is determined that the medium 300 is carried while running askew. Then, based on the label "R8", the screw 42 of the support shaft 14*a* is turned eight turns to adjust the inclination angle of the bar member 14*c* with respect to the center axis LO of the re-rolling section 110.

Figure 22B:
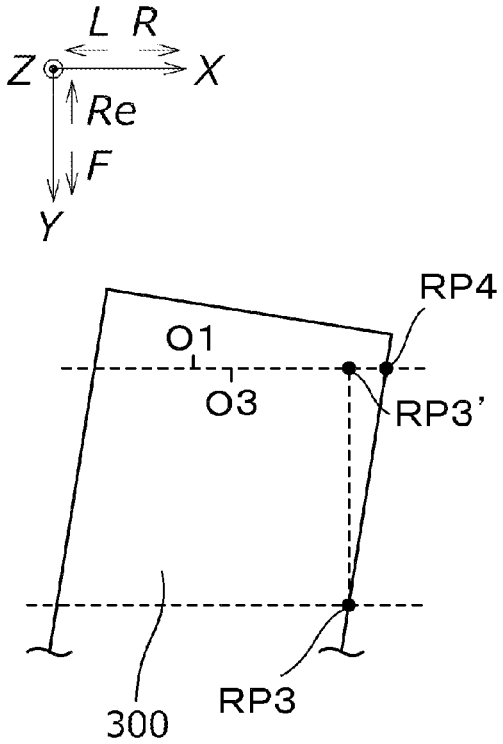
FIG. 22B is a diagram showing the position at which the central position of the reference marking is printed and the position at which the central position of the adjustment marking is printed in the second adjustment marking printing process.

In this case, the central position O1 is located on the left side of the central position O3, as shown in FIG. 22B. Therefore, the medium 300 being carried over the platen 122 is running askew in a forward-leftward diagonal direction. This is because the roll medium RM disposed in the re-rolling section 110 is in such a position as shown in FIG. 11B, for example. Therefore, the bar member 14*c* needs to be brought to such a position that the force by which the other end 14*cy* presses the medium 300 forward is increased (see, for example, FIG. 7E) or such a position that the force by which the one end 14*cx* presses the medium 300 forward is decreased (see, for example, FIG. 7D).

Here, the screw 42 of the support shaft 14*a* is adjusted, thus decreasing the force by which the one end 14*cx* presses the medium 300 forward. That is, the operator turns the screw 42 of the support shaft 14*b* eight turns in the direction of arrow G of FIG. 6, thus moving the movable portion 38 in the direction of arrow H of FIG. 6.

The operator reads the label on a mark of the reference marking $S_0$ that aligns with a mark of the adjustment marking $S_2$, and turns the screw 42 of the support shaft 14*b* if the label contains the letter "L" or the screw 42 of the support shaft 14*a* if the label contains the letter "R". The operator turns the screw 42 of the support shaft 14*a* or the support shaft 14*b* "n" times (n is a positive integer), where "n" is the number on the label. In this process, the direction in which the screw 42 of the support shaft 14*a* or the support shaft 14*b* is turned is the direction of arrow G of FIG. 6, which decreases the force by which the one end 14*cx* or the other end 14*cy* of the bar member 14*c* presses the medium 300.

With the inkjet printer 100 of the present preferred embodiment, it is possible to determine which one of the screws 22 and 42 needs to be turned and how many turns it needs to be turned based on the location where the reference marking $S_0$ is aligned with the adjustment marking $S_1$, $S_2$, and to thus adjust the inclination angle of the bar member 12*c*, 14*c* with respect to the X axis. Therefore, it is possible to easily correct the medium 300 running askew.

Figure 18:
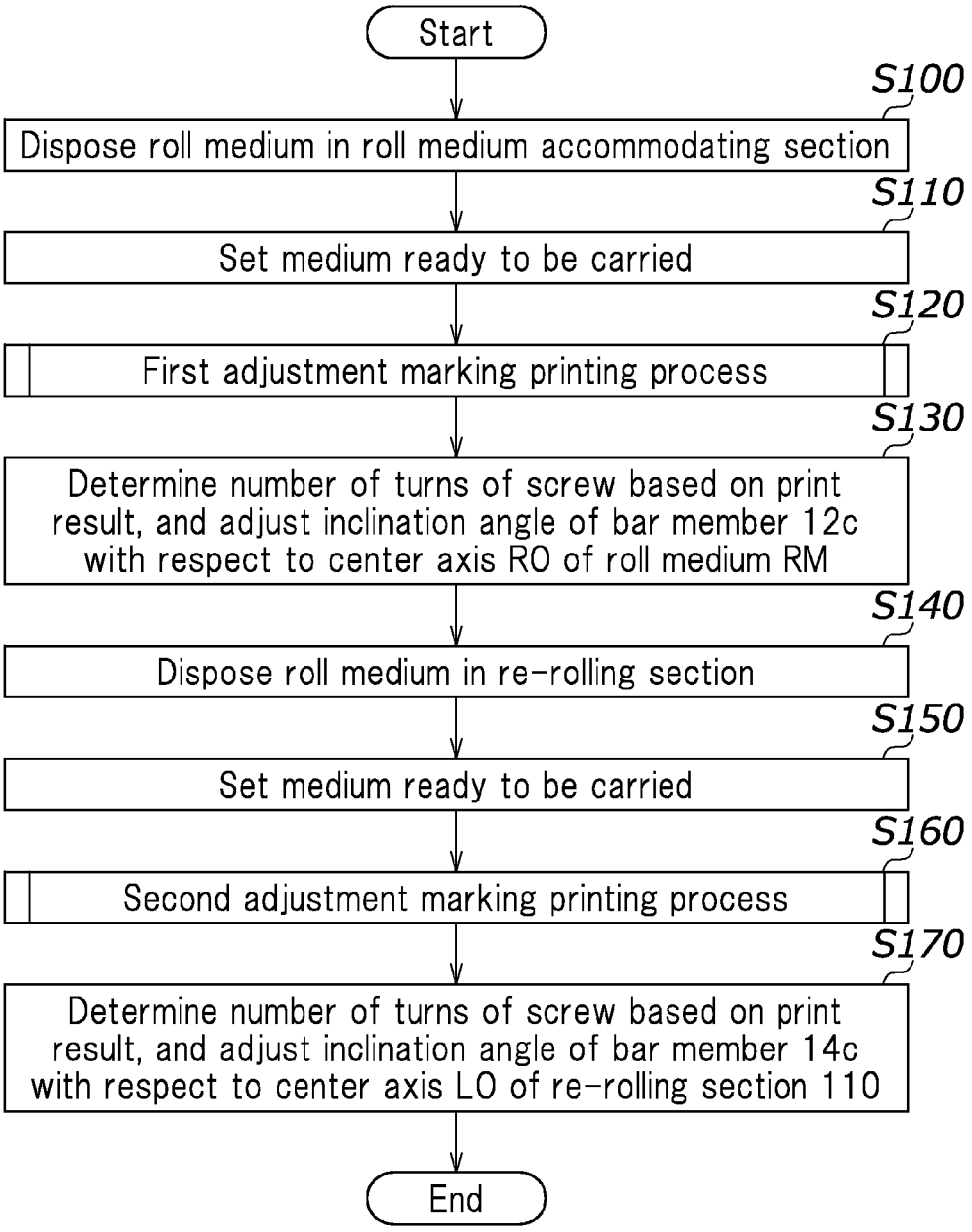
FIG. 18 is a flow chart showing a procedure of another process of correcting a carrying path of a medium.

While the first adjustment pitch is a value obtained by adding the amount of shift in the print result to be introduced by one turn of the screw 22 to the reference pitch in the second preferred embodiment described above, the present invention is not limited thereto. The first adjustment pitch may be a value obtained by subtracting the amount of shift in the print result to be introduced by one turn of the screw 22 from the reference pitch.

Where the first adjustment pitch is a value obtained by subtracting the amount of shift in the print result to be introduced by one turn of the screw 22 from the reference pitch, the process of step S130 of FIG. 18 is performed as follows.

Figure 23A:
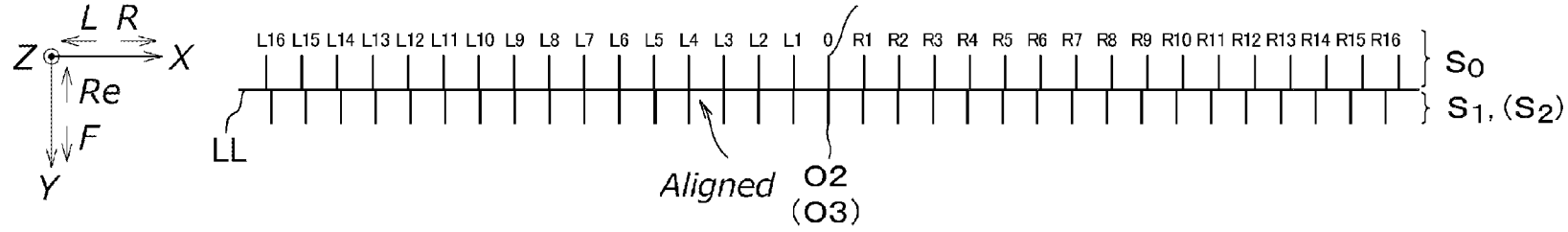
FIG. 23A is a diagram showing a variation of the reference marking and the adjustment marking.

If the reference marking $S_0$ and the adjustment marking $S_1$ align with each other at the mark labeled "L4" of the reference marking $S_0$, as shown in FIG. 23A, the screw 22 of the support shaft 12*b* is turned four turns according to the label "L4", thus adjusting the inclination angle of the bar member 12*c* with respect to the center axis RO of the roll medium RM.

In this case, the central position O1 is located on the right side of the central position O2, as shown in FIG. 20B. Therefore, the medium 300 is running askew in a forward-rightward diagonal direction. This is because the roll medium RM disposed in the roll medium accommodating section 108 is in such a position as shown in FIG. 9A, for example. Therefore, the bar member 12*c* needs to be brought to such a position that the force by which the other end 12*cy* presses the medium 300 in an upward-rearward diagonal direction is increased (see, for example, FIG. 5E) or such a position that the force by which the one end 12*cx* presses the medium 300 in an upward-rearward diagonal direction is decreased (see, for example, FIG. 5D).

Here, the screw 22 of the support shaft 12*b* is adjusted, thus increasing the force by which the other end 12*cy* presses the medium 300 in an upward-rearward diagonal direction. That is, the operator turns the screw 22 of the support shaft 12*b* four turns in the direction of arrow A of FIG. 4, thus moving the movable portion 18 in the direction of arrow B of FIG. 4.

Figure 23B:
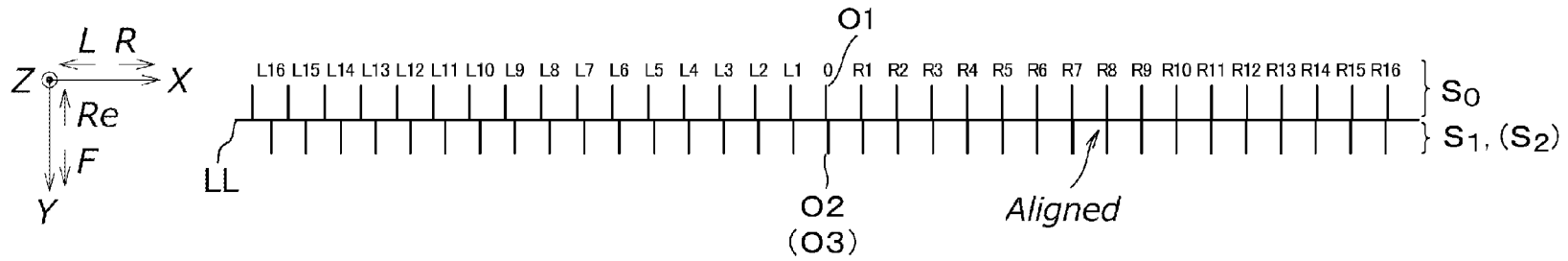
FIG. 23B is a diagram showing a variation of the reference marking and the adjustment marking.

If the reference marking $S_0$ and the adjustment marking $S_1$ align with each other at the mark labeled "R8" of the reference marking $S_0$, as shown in FIG. 23B, the screw 22 of the support shaft 12*a* is turned eight turns according to the label "R8", thus adjusting the inclination angle of the bar member 12*c* with respect to the center axis RO of the roll medium RM.

In this case, the central position O1 is located on the left side of the central position O2, as shown in FIG. 20A. Therefore, the medium 300 is running askew in a forward-leftward diagonal direction. This is because the roll medium RM disposed in the roll medium accommodating section 108 is in such a position as shown in FIG. 9B, for example. Therefore, the bar member 12*c* needs to be brought to such a position that the force by which the one end 12*cx* presses the medium 300 in an upward-rearward diagonal direction is increased (see, for example, FIG. 5C) or such a position that the force by which the other end 12*cy* presses the medium 300 in an upward-rearward diagonal direction is decreased (see, for example, FIG. 5F).

Here, the screw 22 of the support shaft 12*a* is adjusted, thus increasing the force by which the one end 12*cx* presses the medium 300 in an upward-rearward diagonal direction. That is, the operator turns the screw 22 of the support shaft 12*a* eight turns in the direction of arrow A of FIG. 4, thus moving the movable portion 18 in the direction of arrow B of FIG. 4.

Note that the direction in which the screws 22 of the support shaft 12*a* and the support shaft 12*b* are turned is the direction of arrow A of FIG. 4, which increases the force by which the one end 12*cx* or the other end 12*cy* of the bar member 12*c* presses the medium 300.

While the second adjustment pitch is a value obtained by adding the amount of shift in the print result to be introduced by one turn of the screw 42 to the reference pitch in the second preferred embodiment described above, the present invention is not limited thereto. The second adjustment pitch may be a value obtained by subtracting the amount of shift in the print result to be introduced by one turn of the screw 42 from the reference pitch.

Where the second adjustment pitch is a value obtained by subtracting the amount of shift in the print result to be introduced by one turn of the screw 42 from the reference pitch, the process of step S170 of FIG. 18 is performed as follows.

If the reference marking $S_0$ and the adjustment marking $S_2$ align with each other at the mark labeled "L4" of the reference marking $S_0$, as shown in FIG. 23A, the screw 42 of the support shaft 14*b* is turned four turns according to the label "L4", thus adjusting the inclination angle of the bar member 14*c* with respect to the center axis LO of the re-rolling section 110.

In this case, the central position O1 is located on the left side of the central position O3, as shown in FIG. 22B. Therefore, the medium 300 is running askew in a forward-leftward diagonal direction. This is because the roll medium RM disposed in the re-rolling section 110 is in such a position as shown in FIG. 11B, for example. Therefore, the bar member 14*c* needs to be brought to such a position that the force by which the other end 14*cy* presses the medium 300 forward is increased (see, for example, FIG. 7E) or such a position that the force by which the one end 14*cx* presses the medium 300 forward is decreased (see, for example, FIG. 7D).

Here, the screw 42 of the support shaft 14*b* is adjusted, thus increasing the force by which the other end 14*cy* presses the medium 300 forward. That is, the operator turns the screw 42 of the support shaft 14*b* four turns in the direction of arrow E of FIG. 6, thus moving the movable portion 38 in the direction of arrow F of FIG. 6.

If the reference marking $S_0$ and the adjustment marking $S_2$ align with each other at the mark labeled "R8" of the reference marking $S_0$, as shown in FIG. 23B, the screw 42 of the support shaft 14*a* is turned eight turns according to the label "R8", thus adjusting the inclination angle of the bar member 14*c* with respect to the center axis LO of the re-rolling section 110.

In this case, the central position O1 is located on the right side of the central position O3, as shown in FIG. 22A. Therefore, the medium 300 is running askew in a forward-rightward diagonal direction. This is because the roll medium RM disposed in the re-rolling section 110 is in such a position as shown in FIG. 11A, for example. Therefore, the bar member 14*c* needs to be brought to such a position that the force by which the one end 14*cx* presses the medium 300 forward is increased (see, for example, FIG. 7C) or such a position that the force by which the other end 14*cy* presses the medium 300 forward is decreased (see, for example, FIG. 7F).

Here, the screw 42 of the support shaft 14*a* is adjusted, thus increasing the force by which the one end 14*cx* presses the medium 300 forward. That is, the operator turns the screw 22 of the support shaft 14*b* eight turns in the direction of arrow E of FIG. 6, thus moving the movable portion 38 in the direction of arrow F of FIG. 6.

Note that the direction in which the screws 42 of the support shaft 14*a* and the support shaft 14*b* are turned is the direction of arrow E of FIG. 6, which increases the force by which the one end 14*cx* or the other end 14*cy* of the bar member 14*c* presses the medium 300.

Figure 24:
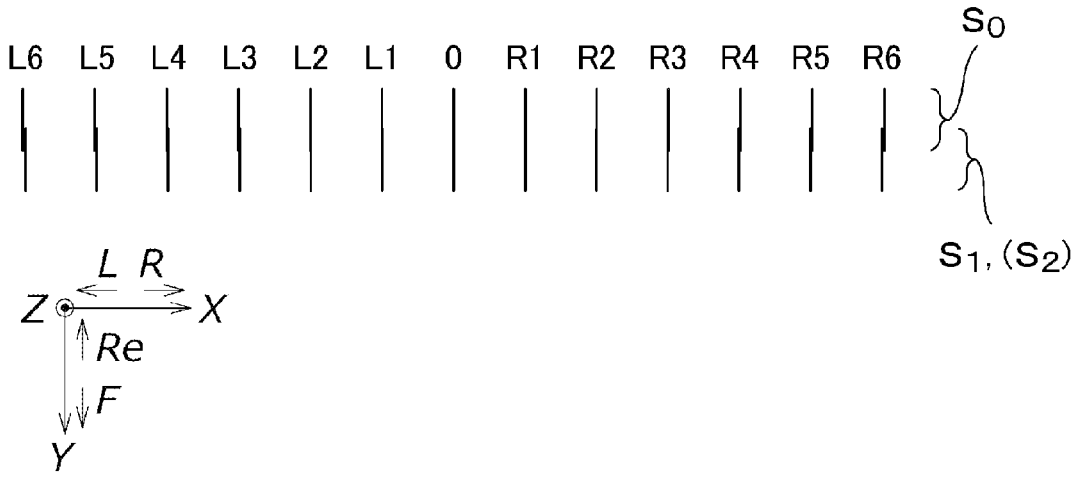
FIG. 24 is a diagram showing a print result obtained by using a variation of the reference marking.

While the reference marking $S_0$ preferably includes the line LL extending in the X axis direction in the second preferred embodiment described above, the line LL may be absent. In such a case, the marks of the adjustment marking $S_1$, $S_2$ may be printed to be partially overlap with the marks of the reference marking $S_0$, as shown in FIG. 24.

While the inkjet printer 100 preferably includes the carrier device 115 in the preferred embodiments described above, the present invention is not limited thereto. For example, the carrier device 115 may be provided in an image cutting device configured to cut out a predetermined image from a medium being carried by a roll-to-roll system.

Figure 25:
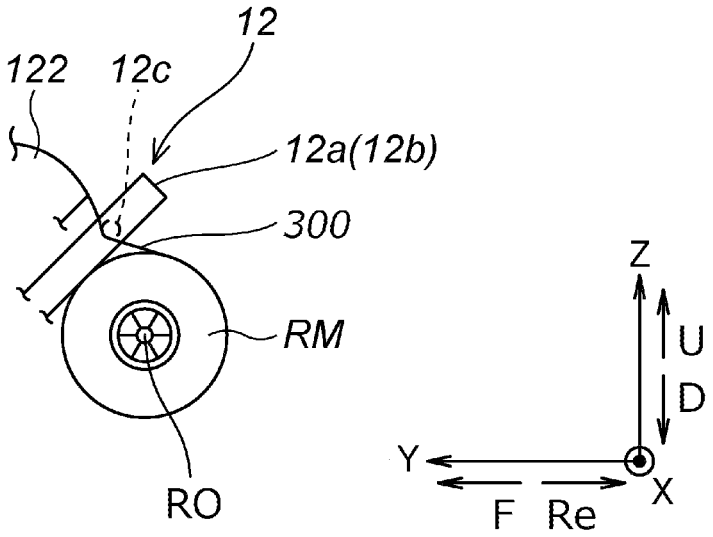
FIG. 25 is a diagram showing a variation of a first bar-shaped member.

While the first bar-shaped member 12 preferably pushes up the medium 300 in an upward-rearward diagonal direction in the preferred embodiments described above, the present invention is not limited thereto. For example, as shown in FIG. 25, the first bar-shaped member 12 may push out the medium 300 in a downward-forward diagonal direction. That is, the bar member 12*c* may be brought into contact with the surface of the medium 300 so as to pull down the medium 300 in a downward-forward diagonal direction by the bar member 12*c*.

Figure 26:
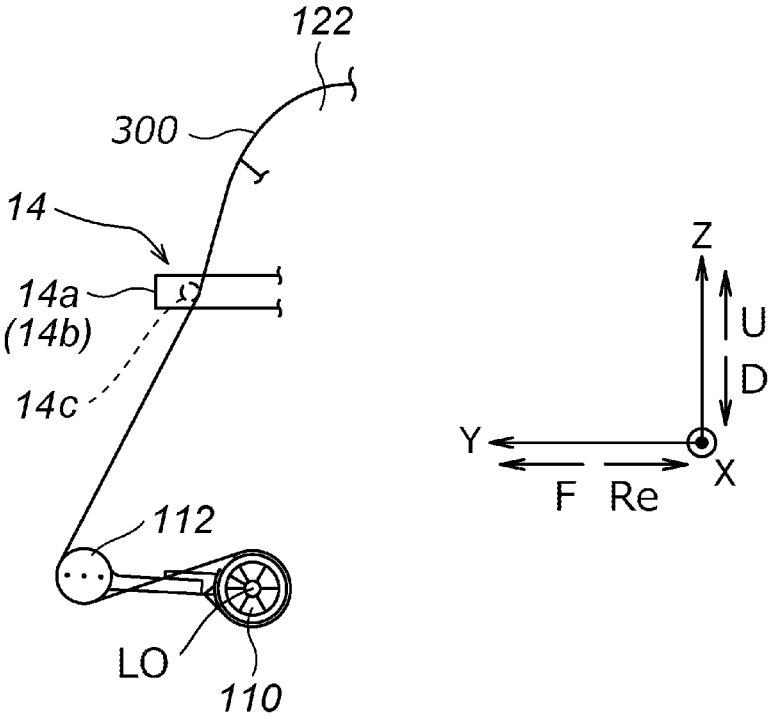
FIG. 26 is a diagram showing a variation of a second bar-shaped member.
Figure 27A:
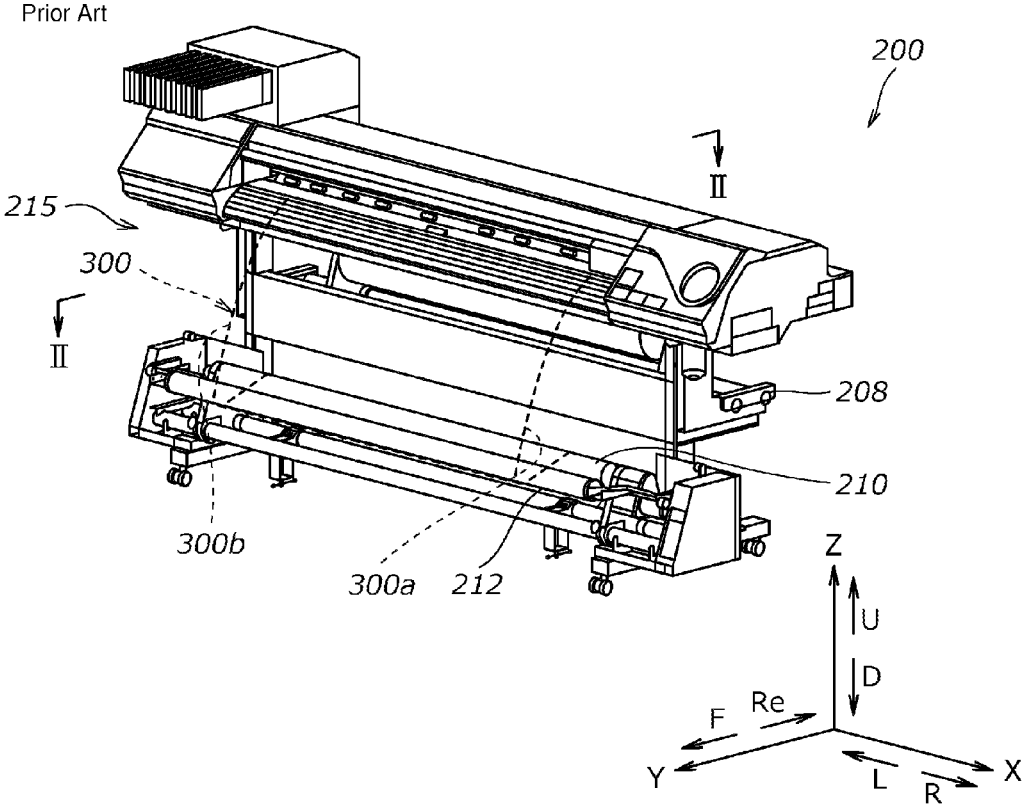
FIG.27A Prior Art
FIG. 27A is a front perspective view showing a structure of a conventional inkjet printer.
Figure 27B:
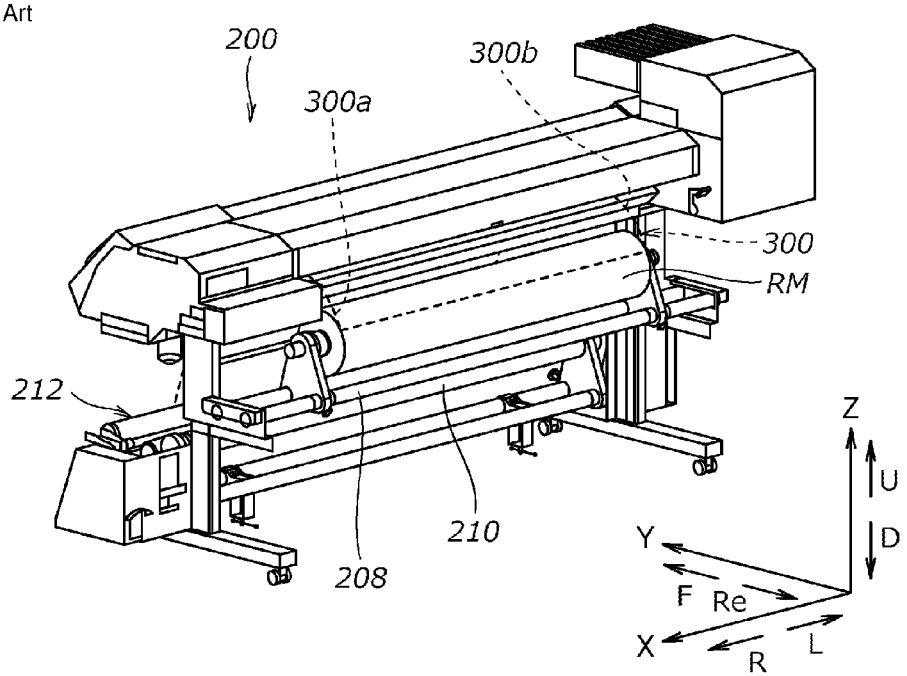
FIG.27B Prior Art
FIG. 27B is a back perspective view showing a structure of the conventional inkjet printer.
Figure 27C:
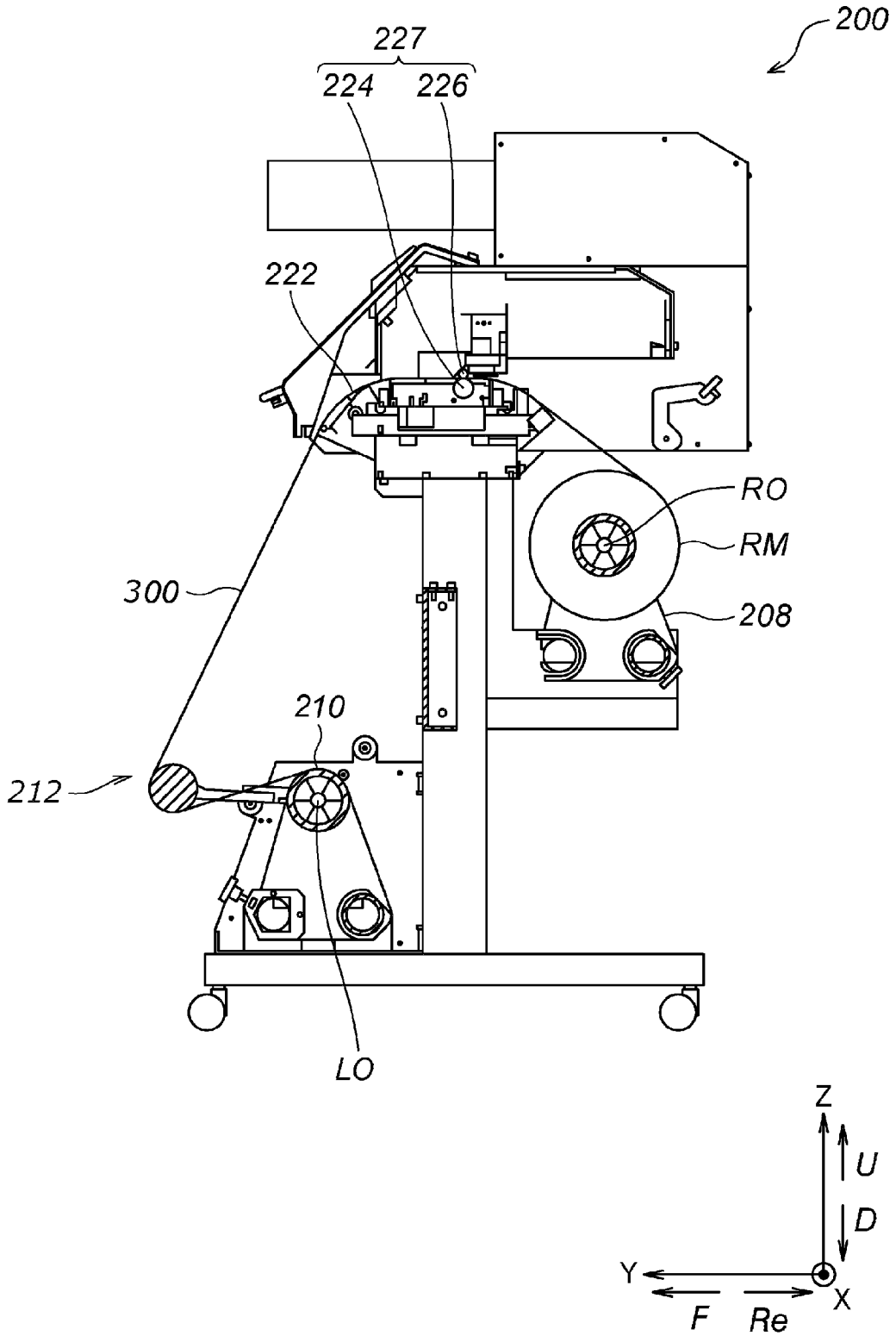
FIG.27C Prior Art
FIG. 27C is a cross-sectional view taken along line II-II of FIG. 27A.

The second bar-shaped member 14 preferably pushes out the medium 300 forward in the preferred embodiments described above, the present invention is not limited thereto. For example, the second bar-shaped member 14 may push out the medium 300 rearward as shown in FIG. 26. That is, the bar member 14*c* may be brought into contact with the surface of the medium 300 so as to pull the medium 300 rearward by the bar member 14*c*.

While the one end 12*cx* and the other end 12*cy* of the bar member 12*c* are preferably both movably provided at the support shafts 12*a* and 12*b*, respectively, in the preferred embodiments described above, one of them may be provided fixedly. Also, while the one end 14*cx* and the other end 14*cy* of the bar member 14*c* are both provided movably at the support shafts 14*a* and 14*b*, respectively, one of them may be provided fixedly.

While the re-rolling section 110 and the dancer roller 112 preferably are integral with the inkjet printer 100 in the preferred embodiments described above, they may be provided separately from the inkjet printer 100.

While the direction of movement and the amount of movement of the movable portions 18 of the support shaft 12*a* and the support shaft 12*b* preferably are adjusted steplessly by the screws 22 of the support shaft 12*a* and the support shaft 12*b* in the preferred embodiments described above, the adjustment may be stepwise. Similarly, the direction of movement and the amount of movement of the movable portions 38 of the support shaft 14*a* and the support shaft 14*b* may be adjusted stepwise by the screws 42 of the support shaft 14*a* and the support shaft 14*b*.

While the bar member 12*c* before being adjusted preferably is set in the first initial position and the bar member 14*c* before being adjusted is set in the second initial position in the preferred embodiments described above, the present invention is not limited thereto. For example, the bar member 12*c* before being adjusted may be set so that the pin 26 is at one end or the other end of the elongated hole 18*ea* in the longitudinal direction thereof. The bar member 14*c* before being adjusted may be set so that the pin 46 is at one end or the other end of the elongated hole 38*ea* in the longitudinal direction thereof.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A carrier device comprising:

a medium accommodating section configured to accommodate a roll medium which extends in a primary scanning direction and which is formed by rolling a web of medium;

a carrying section configured to carry the medium unrolled from the roll medium in a secondary scanning direction perpendicular to the primary scanning direction;

a re-rolling section extending in the primary scanning direction, the re-rolling section configured to re-roll the medium having been carried;

a dancer section configured to apply a predetermined tension on the medium being carried from the carrying section toward the re-rolling section;

a first altering section disposed between the medium accommodating section and the carrying section, the first altering section configured to press the medium being carried from the medium accommodating section toward the carrying section so as to alter a carrying path of the medium; and a second altering section disposed between the carrying section and the re-rolling section, the second altering section configured to press the medium being carried from the carrying section toward the re-rolling section so as to alter the carrying path of the medium; wherein the first altering section includes:

a first bar member extending in the primary scanning direction; and a first support shaft including a first movable portion and to which one end of the first bar member is connected, and a second support shaft including a second movable portion and to which the other end of the first bar member is connected;

the first bar member is configured so that an inclination angle thereof is adjustable with respect to a center axis of the roll medium, and is inclined with respect to the center axis of the roll medium by independently moving the first movable portion and the second movable portion;

the second altering section includes:

a second bar member extending in the primary scanning direction; and a third support shaft including a third movable portion and to which one end of the second bar member is connected, and a fourth support shaft including a fourth movable portion and to which the other end of the second bar member is connected;

the second altering section is configured to press the medium being carried from the carrying section toward the re-rolling section; and the second bar member is configured so that an inclination angle thereof is adjustable with respect to a center axis of the re-rolling section, and is inclined with respect to the center axis of the re-rolling section by independently moving the third movable portion and the fourth movable portion.

2. An inkjet printer comprising:

the carrier device according to claim 1; and an ink head configured to move in the primary scanning direction and to discharge ink onto the medium.

3. An ink jet printer comprising:

a medium accommodating section configured to accommodate a roll medium which extends in a primary scanning direction and which is formed by rolling a web of medium;

a carrying section configured to carry the medium unrolled from the roll medium in a secondary scanning direction perpendicular to the primary scanning direction;

a re-rolling section extending in the primary scanning direction, the re-rolling section configured to re-roll the medium having been carried;

a dancer section configured to apply a predetermined tension on the medium being carried from the carrying section toward the re-rolling section;

a first altering section disposed between the medium accommodating section and the carrying section, the first altering section configured to press the medium being carried from the medium accommodating section toward the carrying section so as to alter a carrying path of the medium; and a second altering section disposed between the carrying section and the re-rolling section, the second altering section configured to press the medium being carried from the carrying section toward the re-rolling section so as to alter the carrying path of the medium;

an ink head configured to move in the primary scanning direction and to discharge ink onto the medium;

a sensor configured to read one end, in the primary scanning direction, of the medium being carried by the carrying section;

a creating section configured to create:

a first marking including a plurality of marks arranged starting from a first central position and spaced apart from one another by a predetermined interval;

a second marking including a plurality of marks arranged starting from a second central position and spaced apart from one another by an interval that is the predetermined interval plus or minus an amount of shift in a print result to be introduced when the carrying path is altered by the first altering section; and a third marking including a plurality of marks arranged starting from a third central position and spaced apart from one another by an interval that is the predetermined interval plus or minus an amount of shift in a print result to be introduced when the carrying path is altered by the second altering section;

a reading section configured to read a first end and a second end by using the sensor when the carrying path of the medium is altered by the first altering section; wherein the first end is one end in the primary scanning direction of the medium at a first position and the second end is one end in the primary scanning direction of the medium at a second position that is a position to be reached after the medium is carried by a predetermined amount from the first position, and configured to read a third end and a fourth end by using the sensor when the carrying path of the medium is altered by the second altering section;

the third end is one end in the primary scanning direction of the medium at a third position and the fourth end is one end in the primary scanning direction of the medium at a fourth position that is a position to be reached after the medium is carried by a predetermined amount from the third position; and a print controller configured or programmed to control the ink head so as to print, at the second position, the first marking so that the first central position is located a predetermined distance away in the primary scanning direction from a point corresponding to the first end and to print the second marking so that the second central position is located the predetermined distance away in the primary scanning direction from the second end, and so as to print, at the fourth position, the first marking so that the first central position is located the predetermined distance away in the primary scanning direction from a point corresponding to the third end and to print the third marking so that the third central position is located the predetermined distance away in the primary scanning direction from the fourth end.

4. The inkjet printer according to claim 3, wherein:

the first altering section includes a first adjustment mechanism configured to adjust the carrying path of the medium;

the second marking includes a plurality of marks arranged starting from the second central position and spaced apart from one another by an interval that is the predetermined interval plus or minus an amount of shift in a print result to be introduced when the first adjustment mechanism is adjusted by one step;

the second altering section includes a second adjustment mechanism configured to adjust the carrying path of the medium; and the third marking includes a plurality of marks arranged starting from the third central position and spaced apart from one another by an interval that is the predetermined interval plus or minus an amount of shift in a print result to be introduced when the second adjustment mechanism is adjusted by one step.

5. The inkjet printer according to claim 4, wherein a number of the plurality of marks of the second marking and a number of the plurality of marks of the third marking are smaller than a number of steps in which the first adjustment mechanism is adjustable and a number of steps in which the second adjustment mechanism is adjustable, respectively.

6. The inkjet printer according to claim 4, wherein a number of the plurality of marks of the second marking and a number of the plurality of marks of the third marking are different from each other, and a number of the plurality of marks of the first marking is equal to a larger one of the number of the plurality of marks of the second marking and the number of the plurality of marks of the third marking.

7. A carrying method for use with an inkjet printer, the inkjet printer comprising:

a medium accommodating section configured to accommodate a roll medium which extends in a primary scanning direction and which is formed by rolling a web of medium;

a carrying section configured to carry the medium unrolled from the roll medium in a secondary scanning direction perpendicular to the primary scanning direction;

a re-rolling section configured to re-roll the medium having been carried;

a dancer section configured to apply a predetermined tension on the medium being carried from the carrying section toward the re-rolling section;

a first altering section disposed between the medium accommodating section and the carrying section, the first altering section configured to press the medium being carried from the medium accommodating section toward the carrying section so as to alter a carrying path of the medium;

a second altering section disposed between the carrying section and the re-rolling section, the second altering section configured to press the medium being carried from the carrying section toward the re-rolling section so as to alter the carrying path of the medium;

an ink head configured to move in the primary scanning direction and discharging ink onto the medium; and a sensor configured to read one end, in the primary scanning direction, of the medium being carried by the carrying section; wherein the carrying method is a method for carrying the medium, unrolled from the roll medium, from the medium accommodating section to the carrying section and for re-rolling and collecting the medium having been carried from the carrying section to the re-rolling section, the carrying method comprising:

creating a first marking including a plurality of marks arranged starting from a first central position and spaced apart from one another by a predetermined interval; a second marking including a plurality of marks arranged starting from a second central position and spaced apart from one another by an interval that is the predetermined interval plus or minus an amount of shift in a print result to be introduced when the carrying path is altered by the first altering section; and a third marking including a plurality of marks arranged starting from a third central position and spaced apart from one another by an interval that is the predetermined interval plus or minus an amount of shift in a print result to be introduced when the carrying path is altered by the second altering section;

reading a first end which is one end in the primary scanning direction of the medium at a first position, carrying the medium by a predetermined amount from the first position to a second position, then printing, at the second position, the first marking so that the first central position is located a predetermined distance away in the primary scanning direction from a point corresponding to the first end, reading a second end which is one end in the primary scanning direction of the medium at the second position, and printing, at the second position, the second marking so that the second central position is located the predetermined distance away in the primary scanning direction from the second end; and reading a third end which is one end in the primary scanning direction of the medium at a third position, carrying the medium by a predetermined amount from the third position to a fourth position, then printing, at the fourth position, the first marking so that the first central position is located the predetermined distance away in the primary scanning direction from a point corresponding to the third end, reading a fourth end which is one end in the primary scanning direction of the medium at the fourth position, and printing, at the fourth position, the third marking so that the third central position is located the predetermined distance away in the primary scanning direction from the fourth end.

8. The carrying method according to claim 7, wherein:

the first altering section includes a first adjustment mechanism configured to adjust the carrying path of the medium;

the second marking includes a plurality of marks arranged starting from the second central position and spaced apart from one another by an interval that is the predetermined interval plus or minus an amount of shift in a print result to be introduced when the first adjustment mechanism is adjusted by one step;

the second altering section includes a second adjustment mechanism configured to adjust the carrying path of the medium; and the third marking includes a plurality of marks arranged starting from the third central position and spaced apart from one another by an interval that is the predetermined interval plus or minus an amount of shift in a print result to be introduced when the second adjustment mechanism is adjusted by one step.

9. The carrying method according to claim 8, wherein a number of the plurality of marks of the second marking and a number of the plurality of marks of the third marking are smaller than a number of steps in which the first adjustment mechanism is adjustable and a number of steps in which the second adjustment mechanism is adjustable, respectively.

10. The carrying method according to claim 8, wherein a number of the plurality of marks of the second marking and a number of the plurality of marks of the third marking are different from each other, and a number of the plurality of marks of the first marking is equal to a larger one of the number of the plurality of marks of the second marking and the number of the plurality of marks of the third marking.

* * * * *